US005443943A

United States Patent [19]

Szajewski et al.

[11] Patent Number: 5,443,943

[45] Date of Patent: Aug. 22, 1995

[54] METHOD OF PROCESSING ORIGINATING PHOTOGRAPHIC ELEMENTS CONTAINING TABULAR SILVER CHLORIDE GRAINS BOUNDED BY {100} FACES

[75] Inventors: Richard P. Szajewski; John M. Buchanan, both of Rochester, N.Y.

[73] Assignee: Eastman Kodak Company, Rochester, N.Y.

[21] Appl. No.: 35,347

[22] Filed: Mar. 22, 1993

[51] Int. Cl.[6] ..... G03C 5/44; G03C 1/035; G03C 1/43

[52] U.S. Cl. ..... 430/393; 430/428; 430/430; 430/461; 430/567; 430/955

[58] Field of Search ..... 430/376, 567, 393, 434, 430/380, 435, 436, 442, 957, 398, 399, 400, 955

[56] References Cited

U.S. PATENT DOCUMENTS

| | | | |
|---|---|---|---|
| 3,489,566 | 1/1970 | Anselm | 430/380 |
| 4,063,951 | 12/1977 | Bogg et al. | 96/94 |
| 4,386,156 | 5/1983 | Mignot | 430/567 |
| 4,400,463 | 8/1983 | Maskasky | 430/434 |
| 4,414,306 | 11/1983 | Wey et al. | 430/434 |
| 4,713,323 | 12/1987 | Maskasky | 430/569 |
| 4,783,398 | 11/1988 | Takada et al. | 430/567 |
| 4,818,664 | 4/1989 | Ueda et al. | 430/393 |
| 4,952,490 | 8/1990 | Takada et al. | 430/567 |
| 4,952,491 | 8/1990 | Nishikawa et al. | 430/570 |
| 4,959,299 | 9/1990 | Sakanoue et al. | 430/955 |
| 4,983,508 | 1/1991 | Ishiguro et al. | 430/569 |
| 5,043,253 | 8/1991 | Ishikawa | 430/393 |
| 5,063,144 | 11/1991 | Wernicke | 430/435 |
| 5,063,145 | 11/1991 | Sakanoue | 430/955 |
| 5,104,775 | 4/1992 | Abe et al. | 430/372 |
| 5,116,721 | 5/1992 | Yamamoto et al. | 430/351 |
| 5,176,987 | 1/1993 | Nakamura et al. | 430/380 |
| 5,188,925 | 2/1993 | Hagiwara et al. | 430/372 |
| 5,275,930 | 1/1994 | Maskasky | 430/567 |
| 5,292,632 | 3/1994 | Maskasky | 430/567 |
| 5,320,938 | 6/1994 | House et al. | 430/567 |

FOREIGN PATENT DOCUMENTS

| | | |
|---|---|---|
| 0468780 | 7/1991 | European Pat. Off. . |
| 534395 | 3/1993 | European Pat. Off. . |
| 2-024643 | 1/1990 | Japan . |
| 4-101135 | 8/1990 | Japan . |

OTHER PUBLICATIONS

Endo & Ikaji, "An Empiricial Rule to Modify the Habit of Silver Chloride to Form Tabular Grains In An Emulsion", The Journal of Photographic Science, vol. 36, pp. 182–188, 1988.

Mumaw & Haugh, "Silver Halide Precipitation Coalescence Processes", Journal of Imaging Science, vol. 30, No. 5, Sep./Oct. 1986, pp. 198–209.

Torino 1963, Photographic Science, Edited by C. Semerano & U. Mazzucato, Focal Press, pp. 52–55.

*Primary Examiner*—Charles L. Bowers, Jr.
*Assistant Examiner*—J. Pasterczyk
*Attorney, Agent, or Firm*—Sarah Meeks Roberts; J. Lanny Tucker

[57] ABSTRACT

Unique imagewise exposed and developed originating color silver halide photographic elements can be processed with bleaching and/or fixing solutions. The element is characterized by several important features. It contains a silver halide grain population of at least 50 mole percent chloride, based on total silver forming the grain population projected area, wherein at least 50 percent of total grain projected area is accounted for by intrinsically stable tabular grains (1) bounded by {100} major faces having adjacent edge ratios of less than 10, and (2) an aspect ratio of at least 2. Also, at least 50 mole % of the element silver halide is silver chloride, and no more than 2 mole % silver iodide. It also contains a bleach accelerator releasing compound. The element is also free of a desilvering rate retarding amount of a development inhibitor releasing compound having a free sulfur valence which binds to silver.

14 Claims, 2 Drawing Sheets

2μm

2 μm

METHOD OF PROCESSING ORIGINATING PHOTOGRAPHIC ELEMENTS CONTAINING TABULAR SILVER CHLORIDE GRAINS BOUNDED BY {100} FACES

FIELD OF THE INVENTION

This invention relates to an improved processing method for developing and/or desilvering originating photographic elements and display photographic elements.

BACKGROUND OF THE INVENTION

The basic image-forming process of color photography comprises exposing a silver halide photographic recording material to light, and chemically processing the material to reveal a useable image. The fundamental steps of this processing typically entail: (1) treating the exposed silver halide with a color developer wherein some or all of the silver halide is reduced to metallic silver while an organic dye is formed from the oxidized color developer; and (2) removing the silver metal thus formed and any residual silver halide by the desilvering steps of bleaching, wherein the developed silver is oxidized to silver salts, and fixing, wherein the silver salts are dissolved and removed from the photographic material. The bleaching and fixing steps may be performed sequentially or as a single step, which is discussed herein as blixing. In some methods of color image formation, additional color or black & white development steps, chemical fogging steps and ancillary stopping, washing, accelerating and stabilizing steps may be employed.

In many situations, the useable image is provided to a customer by a multi-stage method which involves exposing a light sensitive originating element to a scene, and developing and desilvering that originating element to form a color image. The originating element may, for example, be a color negative film or a motion picture negative film. The resultant color image is then used to modulate the exposure of a light sensitive display element, with optional enlargement, in a printer. The display element may, for example, be a color paper, an intermediate film, or a motion picture projection film. The exposed display element is then developed and desilvered to form a useful color image which duplicates the original scene.

Originating elements are typically designed to allow good exposure with available light under a wide variety of lighting conditions, that is, good sensitivity (speed/grain) and dynamic range (long latitude and low gamma) are desired. Conversely, display elements are typically designed so as to allow a full range of density formation after well defined exposure and process conditions in a printer, that is, good image discrimination (high density and low fog), low dynamic range (short latitude and high gamma) and easy and consistent processing are desired. These greatly different needs are typically met by providing originating and display elements that differ markedly in silver halide content and composition as well as in the layer orders and types and quantities of image forming chemicals employed in each. One major difference in composition is evidenced in the use of silver iodobromide emulsions in the originating element, a color negative film for example, for their high sensitivity and desirable image structure properties and the use of silver chloride or silver chlorobromide emulsions in the display element, a color paper for example, for their low sensitivity, short latitude and good developability, as well as their ease of reproducible desilvering.

These differences in design needs have resulted in a situation where different developing and desilvering (bleaching and fixing) agents are commercially preferred for each type of film, with the iodide containing originating films typically requiring more potent developing, bleaching and fixing agents. These differing requirements result in both an ecological burden due to the nature of the more potent reagents required and a commercial burden due to the need for a photofinisher, for example to stock and employ a wide variety of process chemicals.

Several approaches to resolving these environmental and commercial difficulties have been reported.

European Patent Application 0,468,780 describes less active developer formulations especially useful with a color negative originating film in which the silver iodobromide emulsions have been replaced by cubic silver chloride emulsions featuring <100> crystallographic faces much like those employed in a color paper. This reference utilizes traditional film desilvering processes.

U.S. Pat. No. 4,952,490 describes a color negative film employing large, optimally sensitized regular shaped silver chloride emulsions featuring <111> crystallographic faces. Organic grain surface stabilizers and sensitizing dyes are added at precipitation to stabilize the grain surface and shape. It is suggested that this color negative film is suitable for simultaneous processing with color paper. Images printed from emulsions containing a large volume of regular shaped silver chloride grains are generally grainy. Normally, high sensitivity is not available because of roll-off in sensitivity of even larger symmetric emulsions due to decreased intralayer light scatter, decreased dye density yield on color development and decreased quantum sensitivity with increased grain surface area.

U.S. Pat. No. 4,952,491 describes a color negative film employing large, optimally sensitized tabular shaped, low aspect ratio, silver chloride emulsions featuring <111> crystallographic faces. Organic grain surface stabilizers and sensitizing dyes are added at precipitation to stabilize the grain surface and shape. With tabular shaped grains, one typically expects to achieve increased sensitivity by increasing the grain surface area without increasing the grain volume, i.e. by increasing the grain aspect ratio. With these emulsions, greater sensitivities resulting from higher aspect ratios are apparently not available because of increased and unacceptable pressure fog reportedly encountered on increasing the aspect ratio.

Japanese Kokai 04-101,135 describes a method for processing a color paper and a color negative film both comprising silver chloride cubic emulsions in common process chemicals so as to enable both rapid and convenient processing. Cubic shaped emulsions appear to be employed in both the color negative film and the color paper and known processing solutions are employed. Such negative films again face the low sensitivity problem previously described.

U.S. Pat. No. 5,104,775 describes a method for processing a silver iodobromide based color negative film and a silver bromochloride based color paper using common bleach-fix and stabilizer-wash solutions. The method minimizes the formation of sensitizing dye stain in the color paper and the color negative film but suffers from poor desilvering of silver iodobromide based films in bleach-fix baths and gives no improvement in process time.

U.S. Pat. No. 5,116,721 describes the rapid processing of silver bromochloride based color papers using the so called "jet-stream" method whereby high surface agitation is obtained. The use of this method for the processing of both an originating film and a display film in common processing solutions is not described.

There remains a need for a method of processing both originating and display photographic elements in substantially the same processing solutions. Such processing solutions must be economical and environmentally sound, without sacrificing the photographic sensitivity and stability of the originating film or the speed and convenience with which these display images can be provided to a customer.

RELATED PATENT APPLICATIONS

Maskasky U.S. Ser. No. 08/035,349, filed concurrently herewith as a continuation-in-part of U.S. Ser. No. 955,010, filed Oct. 1, 1992, which is in turn a continuation-in-part of U.S. Ser. No. 764,868, filed Sep. 24, 1991, titled HIGH TABULARITY HIGH CHLORIDE EMULSIONS WITH INHERENTLY STABLE GRAIN FACES, commonly assigned, hereinafter referred to as Maskasky III, discloses high aspect ratio tabular grain high chloride emulsions containing tabular grains that are internally free of iodide and that have {100} major faces. In a preferred form, Maskasky III employs an organic compound containing a nitrogen atom with a resonance stabilized p electron pair to favor formation of {100} faces.

House, Brust, Hartsell and Black U.S. Ser. No. 08/034,060, filed concurrently herewith as a continuation-in-part of U.S. Ser. No. 940,404, filed Sep. 3, 1992, which is in turn a continuation-in-part of U.S. Ser. No. 826,338, filed Jan. 27, 1992, each commonly assigned, titled HIGH ASPECT RATIO TABULAR GRAIN EMULSIONS, discloses emulsions containing tabular grains bounded by {100} major faces accounting for 50 percent of total grain projected area selected on the criteria of adjacent major face edge ratios of less than 10 and thicknesses of less than 0.3 mm and having higher aspect ratios than any remaining tabular grains satisfying these criteria (1) have an average aspect ratio of greater than 8 and (2) internally at their nucleation site contain iodide and at least 50 mole percent chloride.

Brust, House, Hartsell and Black U.S. Ser. No. 08/035,009, abandoned, filed concurrently herewith and commonly assigned, titled MODERATE ASPECT RATIO TABULAR GRAIN EMULSIONS AND PROCESSES FOR THEIR PREPARATION, discloses radiation sensitive emulsions comprised of a dispersing medium and silver halide grains. At least 50 percent of total grain projected area is accounted for by tabular grains bounded by {100} major faces having adjacent edge ratios of less than 10, each having an aspect ratio of at least 2 and an average aspect ratio of up to 8, and internally at their nucleation site containing iodide and at least 50 mole percent chloride. A process of preparing the emulsions is also disclosed.

House, Brust, Hartsell, Black, Antoniades, Tsaur and Chang U.S. Ser. No. 08/033,738, filed concurrently herewith as a continuation-in-part of U.S. Ser. No. 940,404, filed Sep. 3, 1992, which is in turn a continuation-in-part of U.S. Ser. No. 826,338, filed Jan. 27, 1992, each commonly assigned, titled PROCESSES OF PREPARING TABULAR GRAIN EMULSIONS, discloses processes of preparing emulsions containing tabular grains bounded by {100} major faces of which tabular grains bounded by {100} major faces account for 50 percent of total grain projected area selected on the criteria of adjacent major face edge ratios of less than 10 and thicknesses of less than 0.3 mm and internally at their nucleation site contain iodide and at least 50 mole percent chloride, comprised of the steps of (1) introducing silver and halide salts into the dispersing medium so that nucleation of the tabular grains occurs in the presence of iodide with chloride accounting for at least 50 mole percent of the halide present in the dispersing medium and the pCl of the dispersing medium being maintained in the range of from 0.5 to 3.5 and (2) following nucleation completing grain growth under conditions that maintain the {100} major faces of the tabular grains until the tabular grains exhibit an average aspect ratio of greater than 8.

Puckett U.S. Ser. No. 08/033,739, abandoned, filed concurrently herewith and commonly assigned, titled OLIGOMER MODIFIED TABULAR GRAIN EMULSIONS discloses radiation sensitive emulsions and processes for their preparation. At least 50 percent of total grain projected area is accounted for by high chloride tabular grains bounded by {100} major faces having adjacent edge ratios of less than 10, each having an aspect ratio of at least 2, containing on average at least one pair of metal ions chosen from group VIII, periods 5 and 6, at adjacent cation sites in their crystal lattice, and internally at their nucleation site containing iodide and at least 50 mole percent chloride.

Brust, House, Hartsell, Black, Marchetti and Budz U.S. Ser. No. 08/034,982, abandoned, filed concurrently herewith as a continuation-in-part of U.S. Ser. No. 940,404, filed Sep. 3, 1992, which is in turn a continuation-in-part of U.S. Ser. No. 826,338, filed Jan. 27, 1992, each commonly assigned, titled COORDINATION COMPLEX LIGAND MODIFIED TABULAR GRAIN EMULSIONS, discloses emulsions containing tabular grains bounded by {100} major faces accounting for 50 percent of total grain projected area selected on the criteria of adjacent major face edge ratios of less than 10 and thicknesses of less than 0.3 mm and having higher aspect ratios than any remaining tabular grains satisfying these criteria (1) have an average aspect ratio of greater than 8 and (2) internally at their nucleation site contain iodide and at least 50 mole percent chloride. The tabular grain contain non-halide coordination complex ligands.

Budz, Ligtenberg and Roberts U.S. Ser. No. 08/034,050, abandoned, filed concurrently herewith and commonly assigned, titled DIGITAL IMAGING WITH TABULAR GRAIN EMULSIONS, discloses digitally imaging photographic elements containing tabular grain emulsions comprised of a dispersing medium and silver halide grains containing at least 50 mole percent chloride, based on silver. At least 50 percent of total grain projected area is accounted for by tabular grains bounded by {100} major faces having adjacent edge ratios of less than 10, each having an aspect ratio of at least 2.

Szajewski U.S. Ser. No. 08/214,908, filed Mar. 3, 1994 and commonly assigned, titled FILM AND CAMERA, discloses roll films and roll film containing cameras containing at least one emulsion layer is present containing tabular grain emulsions comprised of a dispersing medium and silver halide grains containing at least 50 mole percent chloride, based on silver. At least 50 percent of total grain projected area is accounted for by tabular grains bounded by {100} major faces having adjacent edge ratios of less than 10, each having an aspect ratio of at least 2.

Szajewski, House, Brust, Hartsell, Black, Bohan and Merrill U.S. Ser. No. 08/069,236, now U.S. Pat. No. 5,356,764, filed Jun. 1, 1993 as a continuation-in-part of U.S. Ser. No. 940,404, filed Sep. 3, 1992, which is in turn a continuation-in-part of U.S. Ser. No. 826,338, filed Jan. 27, 1992, each commonly assigned, titled DYE IMAGE FORMING PHOTOGRAPHIC ELEMENTS, discloses dye image forming photographic elements containing at least one tabular grain emulsion comprised of a dispersing medium and silver halide grains. At least 50 percent of total grain projected area is accounted for by tabular grains bounded by {100} major faces having adjacent edge ratios of less than 10, each having an aspect ratio of at least 2, and internally at their nucleation site containing iodide and at least 50 mole percent chloride.

Lok and Budz U.S. Ser. No. 08/034,317, abandoned, filed concurrently herewith and commonly assigned, titled TABULAR GRAIN EMULSIONS CONTAINING ANTIFOGGANTS AND STABILIZERS discloses tabular grain emulsions comprised of a dispersing medium, silver halide grains containing at least 50 mole percent chloride, based on silver, and at least one selected antifoggant or stabilizer. At least 50 percent of total grain projected area is accounted for by tabular grains bounded by {100} major faces having adjacent edge ratios of less than 10, each having an aspect ratio of at least 2, and internally at their nucleation site containing iodide and at least 50 mole percent chloride.

Maskasky U.S. Ser. No. 08/034,998, now U.S. Pat. No. 5,264,337, filed concurrently herewith and commonly assigned, titled MODERATE ASPECT RATIO TABULAR GRAIN HIGH CHLORIDE EMULSIONS WITH INHERENTLY STABLE GRAIN FACES, discloses an emulsion containing a grain population internally free of iodide at the grain nucleation site and comprised of at least 50 mole percent chloride. At least 50 percent of the grain population projected area is accounted for by {100} tabular grains each having an aspect ratio of at least 2 and together having an average aspect ratio of up to 7.5.

SUMMARY OF THE INVENTION

This invention provides a method of processing an exposed originating silver halide photographic element and its counterpart exposed display silver halide photographic element comprising the steps of developing and desilvering, by blixing or bleaching and fixing, the originating silver halide photographic element and the steps of developing and desilvering, by blixing or bleaching and fixing, the display silver halide photographic element;

wherein the originating silver halide photographic element comprises a radiation sensitive emulsion containing a silver halide grain population comprised of at least 50 mole percent chloride, based on total silver forming the grain population projected area, wherein at least 50 percent of total grain projected area is accounted for by intrinsically stable tabular grains (1) bounded by {100} major faces having adjacent edge ratios of less than 10 and (2) each having an aspect ratio of at least 2, and wherein the silver halide content of the photographic element comprises at least 50 mole % silver chloride and no more than 2 mole % silver iodide;

wherein the silver halide content of the display silver halide photographic element comprises at least 50 mole % silver chloride and no more than 2 mole % silver iodide; and wherein one or more of the corresponding developing, blixing, or bleaching and fixing solutions used for the originating and display photographic elements have substantially the same chemical compositions.

The originating photographic elements of this invention may be developed and desilvered in developing and desilvering solutions normally utilized for display elements. This will allow processors to utilize the same developing and desilvering solutions for both originating and display elements. Not only is this more convenient for processors, it is also beneficial to the environment because processing solutions used for developing and desilvering display elements generally are more environmentally benign. Only the originating elements of this invention, containing <100> faced tabular grains, enable a camera speed color negative material with the above advantages.

DETAILED DESCRIPTION OF THE INVENTION

Figure 1:
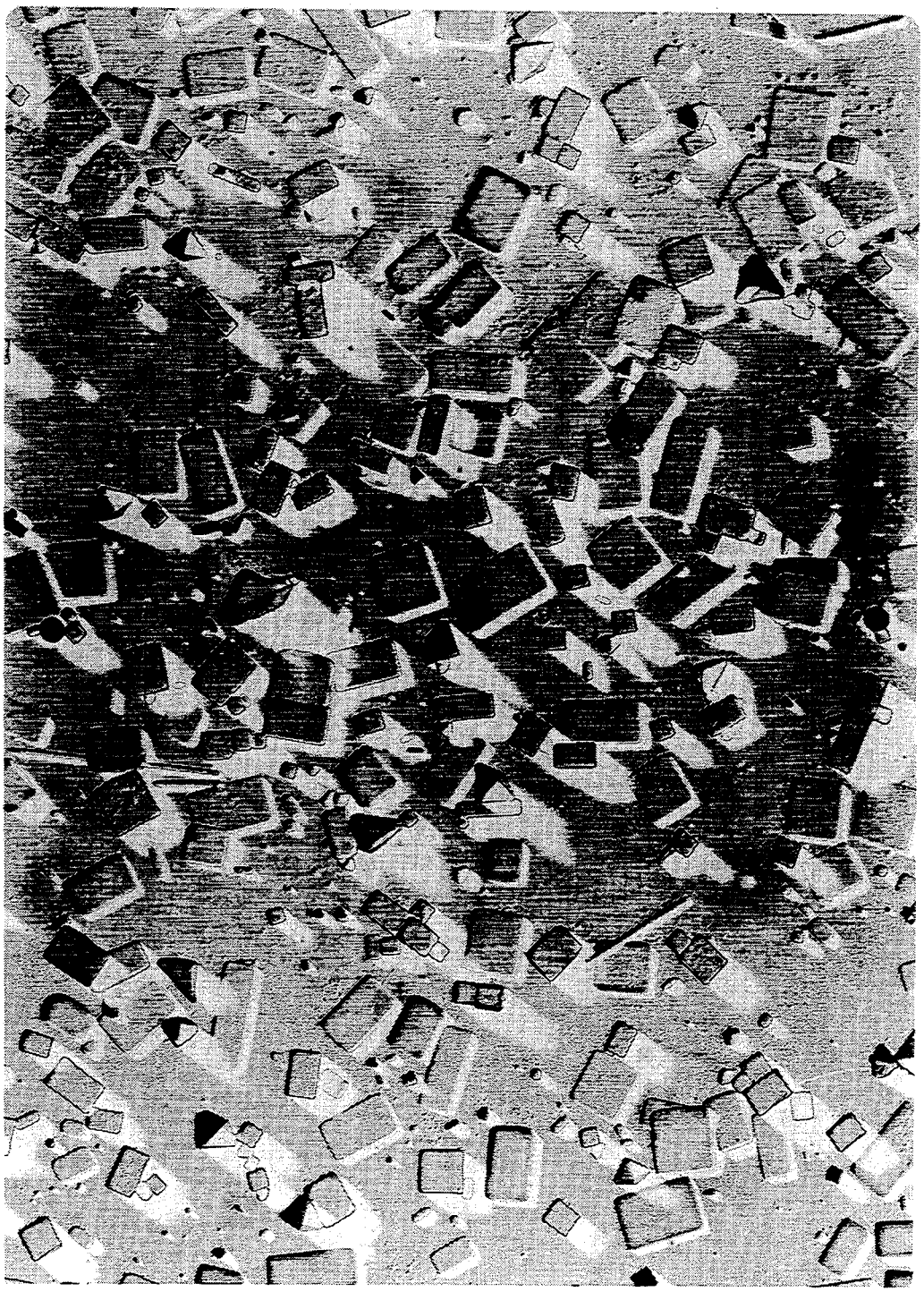
FIG. 1 is a shadowed photomicrograph of carbon grain replicas of an emulsion of the invention and FIG. 2 is a shadowed photomicrograph of carbon grain replicas of a control emulsion.

The originating silver halide photographic elements of this invention allow good exposure with available light under a wide variety of lighting conditions. They provide good speed with low graininess. At a minimum the originating elements of this invention have an ISO speed rating of 25 or greater, with greater than 50 being preferred.

The speed or sensitivity of color negative photographic materials is inversely related to the exposure required to enable the attainment of a specified density above fog after processing. Photographic speed for color negative films with a gamma of about 0.65 has been specifically defined by the American National Standards Institute (ANSI) as ANSI Standard Number PH 2.27-1979 (ASA speed) and relates to the exposure levels required to enable a density of 0.15 above fog in the green light sensitive and least sensitive recording unit of a multicolor negative film. This definition conforms to the International Standards Organization (ISO) film speed rating.

It is appreciated that according to the above definition, speed depends on film gamma. Color negative films intended for other than direct optical printing may be formulated or processed to achieve a gamma greater or less than 0.65. For the purposes of this application, the speeds of such films are determined by first linearly amplifying or deamplifying the achieved density vs log exposure relationship (i.e. the gamma) to a value of 0.65 and then determining the speed according to the above definitions.

The photographic emulsions used in the originating element may include, among others, silver chloride, silver bromochloride, silver bromide, silver iodobromochloride, silver iodochloride or silver iodobromide. Silver chloride and silver bromochloride emulsions are preferred. Whatever the emulsion mix, the originating photographic element must contain at least about 50 mole % silver chloride, with 70 mole % being preferrred and over 98 mole % being most preferred. The total amount of silver iodide in the photographic element must be less than about 2 mole %, and preferrably less than 1 mole %. The total amount of coated silver may be from about 1 to about 10 grams per square meter, with less than 7 grams per square meter preferred, and less than 4 grams per square meter being most preferred.

The originating photographic elements of this invention contain at least one radiation sensitive silver halide emulsion containing a dispersing agent and a high chloride silver halide grain population. At least 50 percent of total grain projected area of the high chloride grain population is accounted for by tabular grains which (1) are bounded by {100} major faces having adjacent edge ratios of less than 10 and (2) each have an aspect ration of at least 2. The tabular grains of this invention are intrinsically stable and do not require the use of stabilizers such as thiirane, thiepine, thiophene, thiazole and other such cyclic sulfides; mercaptoacetic acids, cysteine, penicillamine and other thiols; and acetylthiophenol and related thioesters and thiocarbanimides to maintain their shape. Such stabilizers may restrain development.

It has further been discovered that the use of a certain class of development inhibitors can inhibit the desilvering of the originating photographic elements of this invention. Development inhibitors typically comprise a silver halide binding group having a sulfur, selenium, tellurium or heterocyclic nitrogen or carbon with a free valence that can form a bond to silver atoms, as well as a ballast moiety. Originating photographic elements which contain development inhibitors having a sulfur with a free valence that can form a bond to a silver atom appear to desilver more slowly than those containing other classes of development inhibitors or no development inhibitor. Therefore, with this invention it is preferred to use development inhibitors with a heterocyclic nitrogen as a silver binding group, such as oxazoles, thiazoles, diazoles, triazoles, oxadiazoles, thiadiazoles, oxathiazoles, thiatriazoles, benzotriazoles, tetrazoles, benzimidazoles, indazoles, isoindazoles,benzodiazolesor benzisodiazoles. Development inhibitors having a sulfur with a free valence can, however, have other advantages and may be utilized in limited quantities which do not greatly effect desilvering.

The identification of emulsions satisfying the requirements of the invention and the significance of the selection parameters can be better appreciated by considering a typical emulsion. FIG. 1 is a shadowed photomicrograph of carbon grain replicas of a representative emulsion of the invention, described in detail in Example 1 below. It is immediately apparent that most of the grains have orthogonal tetragonal (square or rectangular) faces. The orthogonal tetragonal shape of the grain faces indicates that they are {100} crystal faces.

The projected areas of the few grains in the sample that do not have square or rectangular faces are noted for inclusion in the calculation of the total grain projected area, but these grains clearly are not part of the tabular grain population having {100} major faces.

A few grains may be observed that are acicular or rod-like grains (hereinafter referred as rods). These grains are more than 10 times longer in one dimension than in any other dimension and can be excluded from the desired tabular grain population based on their high ratio of edge lengths. The projected area accounted for by the rods is low, but, when rods are present, their projected area is noted for determining total grain projected area.

The grains remaining all have square or rectangular major faces, indicative of {100} crystal faces. To identify the tabular grains it is necessary to determine for each grain its ratio of ECD to thickness (t)—i.e., ECD/t. ECD is determined by measuring the protected area (the product of edge lengths) of the upper surface of each grain. From the grain projected area the ECD of the grain is calculated. Grain thickness is commonly determined by oblique illumination of the grain population resulting in the individual grains casting shadows. From a knowledge of the angle of illumination (the shadow angle) it is possible to calculate the thickness of a grain from a measurement of its shadow length. The grains having square or rectangular faces and each having a ratio of ECD/t of at least 2 are tabular grains having {100} major faces. When the projected areas of the {100} tabular grains account for at least 50 percent of total grain projected area, the emulsion is a tabular grain emulsion.

In the emulsion of FIG. 1 tabular grains account for more than 50 percent of total grain projected area. From the definition of a tabular grain above, it is apparent that the average aspect ratio of the tabular grains can only approach 2 a minimum limit. In fact, tabular grain emulsions of the invention typically exhibit average aspect ratios of 5 or more, with high average aspect ratios (>8) being preferred. That is, preferred emulsions according to the invention are high aspect ratio tabular grain emulsions. In specifically preferred emulsions according to the invention average aspect ratios of the tabular grain population are at least 12 and optimally at least 20. Typically the average aspect ratio of the tabular grain population ranges up to 50, but higher aspect ratios of 100, 200 or more can be realized. Emulsions within the contemplation of the invention in which the average aspect ratio approaches the minimum average aspect ratio limit of 2 still provide a surface to volume ratio that is 200 percent that of cubic grains.

The tabular grain population can exhibit any grain thickness that is compatible with the average aspect ratios noted above. However, particularly when the selected tabular grain population exhibits a high average aspect ratio, it is preferred to additionally limit the grains included in the selected tabular grain population to those that exhibit a thickness of less than 0.3 mm and, optimally, less than 0.2 mm. It is appreciated that the aspect ratio of a tabular grain can be limited either by limiting its equivalent circular diameter or increasing its thickness. Thus, when the average aspect ratio of the tabular grain population is in the range of from 2 to 8, the tabular grains accounting for at least 50 percent of total grain projected area can also each exhibit a grain thickness of less than 0.3 mm or less than 0.2 mm. Nevertheless, in the aspect ratio range of from 2 to 8 particularly, there are specific photographic applications that can benefit by greater tabular grain thicknesses. For example, in constructing a blue recording emulsion layer of maximum achievable speed it is specifically contemplated that tabular grain thicknesses that are on average 1 mm or or even larger can be tolerated. This is because the eye is least sensitive to the blue record and hence higher levels of image granularity (noise) can be tolerated without objection. There is an additional incentive for employing larger grains in the blue record in that it is sometimes difficult to match in the blue record the highest speeds attainable in the green and red record. A source of this difficulty resides in the blue photon deficiency of sunlight. While sunlight on an energy basis exhibits equal parts of blue, green and red light, at shorter wavelengths the photons have higher energy. Hence on a photon distribution basis daylight is slightly blue deficient.

The tabular grain population preferably exhibits major face edge length ratios of less than 5 and optimally less than 2. The nearer the major face edge length ratios approach 1 (i.e., equal edge lengths) the lower is the probability of a significant rod population being present in the emulsion. Further, it is believed that tabular grains with lower edge ratios are less susceptible to pressure desensitization.

In one specifically preferred form of the invention the tabular grain population accounting for at least 50 percent of total grain projected area is provided by tabular grains also exhibiting 0.2 mm. In other words, the emulsions are in this instance thin tabular grain emulsions.

Surprisingly, ultrathin tabular grain emulsions have been prepared satisfying the requirements of the invention. Ultrathin tabular grain emulsions are those in which the selected tabular grain population is made up of tabular grains having an average thickness of less than 0.06 mm. Prior to the present invention the only ultrathin tabular grain emulsions of a halide content exhibiting a cubic crystal lattice structure known in the art contained tabular grains bounded by {111} major faces. In other words, it was thought essential to form tabular grains by the mechanism of parallel twin plane incorporation to achieve ultrathin dimensions. Emulsions according to the invention can be prepared in which the tabular grain population has a mean thickness down to 0.02 mm and even 0.01 mm. Ultrathin tabular grains have extremely high surface to volume ratios. This permits ultrathin grains to be photographically processed at accelerated rates. Further, when spectrally sensitized, ultrathin tabular grains exhibit very high ratios of speed in the spectral region of sensitization as compared to the spectral region of native sensitivity. For example, ultrathin tabular grain emulsions according to the invention can have entirely negligible levels of blue sensitivity, and are therefore capable of providing a green or red record in a photographic product that exhibits minimal blue contamination even when located to receive blue light.

The characteristic of tabular grain emulsions that sets them apart from other emulsions is the ratio of grain ECD to thickness (t). This relationship has been expressed quantitatively in terms of aspect ratio. Another quantification that is believed to assess more accurately the importance of tabular grain thickness is tabularity:

$$T=ECD/t^2=AR/t$$

where

T is tabularity;

AR is aspect ratio;

ECD is equivalent circular diameter in micrometers (mm); and t is grain thickness in micrometers. The high chloride tabular grain population accounting for 50 percent of total grain projected area preferably exhibits a tabularity of greater than 25 and most preferably greater than 100. Since the tabular grain population can be ultrathin, it is apparent that extremely high tabularities, ranging to 1000 and above are within the contemplation of the invention.

The tabular grain population can exhibit an average ECD of any photographically useful magnitude. For photographic utility average ECD's of less than 10 ram are contemplated, although average ECD's in most photographic applications rarely exceed 6 mm. Within ultrathin tabular grain emulsions satisfying the requirements of the invention it is possible to provide intermediate aspect ratios with ECD's of the tabular grain population of 0.10 mm and less. As is generally understood by those skilled in the art, emulsions with selected tabular grain populations having higher ECD's are advantageous for achieving relatively high levels of photographic sensitivity while selected tabular grain populations with lower ECD's are advantageous in achieving low levels of granularity.

So long as the population of tabular grains satisfying the parameters noted above accounts for at least 50 percent of total grain projected area a photographically desirable grain population is available. It is recognized that the advantageous properties of the emulsions of the invention are increased as the proportion of tabular grains having {100} major faces is increased. The preferred emulsions according to the invention are those in which at least 70 percent and optimally at least 90 percent of total grain projected area is accounted for by tabular grains having {100} major faces. It is specifically contemplated to provide emulsions satisfying the grain descriptions above in which the selection of the rank ordered tabular grains extends to sufficient tabular grains to account for 70 percent or even 90 percent of total grain projected area.

So long as tabular grains having the desired characteristics described above account for the requisite proportion of the total grain projected area, the remainder of the total grain projected area can be accounted for by any combination of coprecipitated grains. It is, of course, common practice in the art to blend emulsions to achieve specific photographic objectives. Blended emulsions in which at least one component emulsion satisfies the tabular grain descriptions above are specifically contemplated.

If tabular grains failing to satisfy the tabular grain population requirements do not account for 50 percent of the total grain projected area, the emulsion does not satisfy the requirements of the invention and is, in general, a photographically inferior emulsion.

For most applications (particularly applications that require spectral sensitization, require rapid processing and/or seek to minimize silver coverages) emulsions are photographically inferior in which many or all of the tabular grains are relatively thick—e.g., emulsions containing high proportions of tabular grains with thicknesses in excess of 0.3 mm.

Figure 2:
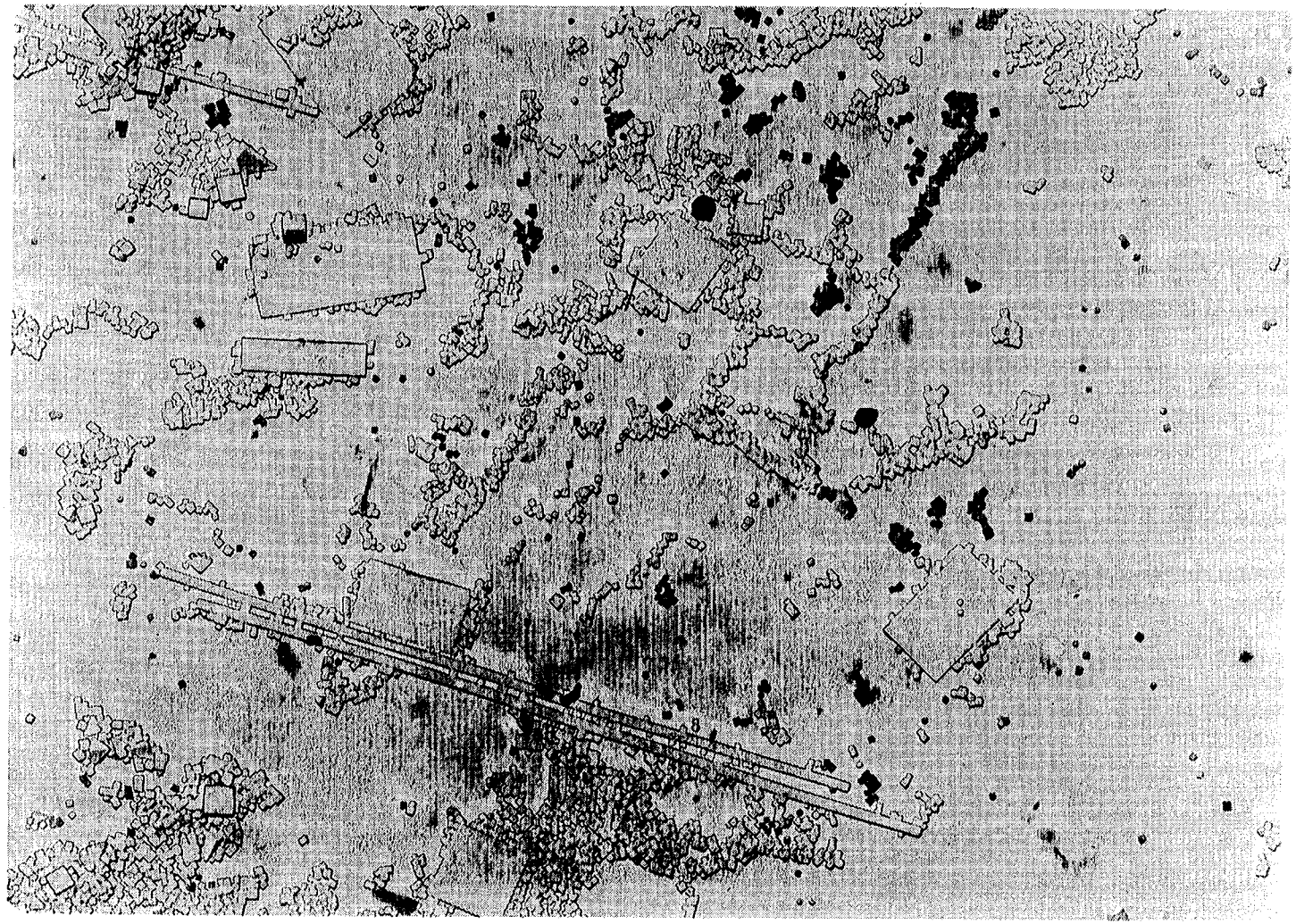

More commonly, inferior emulsions failing to satisfy the requirements of the invention have an excessive proportion of total grain projected area accounted for by cubes, twinned nontabular grains, and rods. Such an emulsion is shown in FIG. 2. Most of the grain projected area is accounted for by cubic grains. Also the rod population is much more pronounced than in FIG. 1. A few tabular grains are present, but they account for only a minor portion of total grain projected area.

The tabular grain emulsion of FIG. 1 satisfying the requirements of the invention and the predominantly cubic grain emulsion of FIG. 2 were prepared under conditions that were identical, except for iodide management during nucleation. The FIG. 2 emulsion is a silver chloride emulsion while the emulsion of FIG. 1 additionally includes a small amount of iodide.

Obtaining emulsions satisfying the requirements of the invention has been achieved by the discovery of a novel precipitation process. In this process grain nucleation occurs in a high chloride environment in the presence of iodide ion under conditions that favor the emergence of {100} crystal faces. As grain formation occurs the inclusion of iodide into the cubic crystal lattice being formed by silver ions and the remaining halide ions is disruptive because of the much larger diameter of iodide ion as compared to chloride ion.

The incorporated iodide ions introduce crystal irregularities that in the course of further grain growth result in tabular grains rather than regular (cubic) grains.

It is believed that at the outset of nucleation the incorporation of iodide ion into the crystal structure results in cubic grain nuclei being formed having one or more screw dislocations in one or more of the cubic crystal faces. The cubic crystal faces that contain at least one screw dislocation thereafter accept silver halide at an accelerated rate as compared to the regular cubic crystal faces (i.e., those lacking a screw dislocation). When only one of the cubic crystal faces contains a screw dislocation, grain growth on only one face is accelerated, and the resulting grain structure on continued growth is a rod. The same result occurs when only two opposite parallel faces of the cubic crystal structure contain screw dislocations. However, when any two contiguous cubic crystal faces contain a screw dislocation, continued growth accelerates growth on both faces and produces a tabular grain structure. It is believed that the tabular grains of the emulsions of this invention are produced by those grain nuclei having two, three or four faces containing screw dislocations.

At the outset of precipitation a reaction vessel is provided containing a dispersing medium and conventional silver and reference electrodes for monitoring halide ion concentrations within the dispersing medium. Halide ion is introduced into the dispersing medium that is at least 50 mole percent chloride-i.e., at least half by number of the halide ions in the dispersing medium are chloride ions. The pCl of the dispersing medium is adjusted to favor the formation of {100} grain faces on nucleation-that is, within the range of from 0.5 to 3.5, preferably within the range of from 1.0 to 3.0 and, optimally, within the range of from 1.5 to 2.5.

The grain nucleation step is initiated when a silver jet is opened to introduce silver ion into the dispersing medium. Iodide ion is preferably introduced into the dispersing medium concurrently with or, optimally, before opening the silver jet. Effective tabular grain formation can occur over a wide range of iodide ion concentrations ranging up to the saturation limit of iodide in silver chloride. The saturation limit of iodide in silver chloride is reported by H. Hirsch, "Photographic Emulsion Grains with Cores: Part I. Evidence for the Presence of Cores", J. of Photog. Science, Vol. 10 (1962), pp. 129–134, to be 13 mole percent. In silver halide grains in which equal molar proportions of chloride and bromide ion are present up to 27 mole percent iodide, based on silver, can be incorporated in the grains. It is preferred to undertake grain nucleation and growth below the iodide saturation limit to avoid the precipitation of a separate silver iodide phase and thereby avoid creating an additional category of unwanted grains. It is generally preferred to maintain the iodide ion concentration in the dispersing medium at the outset of nucleation at less than 10 mole percent. In fact, only minute amounts of iodide at nucleation are required to achieve the desired tabular grain population. Initial iodide ion concentrations of down to 0.001 mole percent are contemplated. However, for convenience in replication of results, it is preferred to maintain initial iodide concentrations of at least 0.01 mole percent and, optimally, at least 0.05 mole percent.

In the preferred form of the invention silver iodochloride grain nuclei are formed during the nucleation step.

Minor amounts of bromide ion can be present in the dispersing medium during nucleation. Any amount of bromide ion can be present in the dispersing medium during nucleation that is compatible with at least 50 mole percent of the halide in the grain nuclei being chloride ions. The grain nuclei preferably contain at least 70 mole percent and optimally at least 90 mole percent chloride ion, based on silver.

Grain nuclei formation occurs instantaneously upon introducing silver ion into the dispersing medium. For manipulative convenience and reproducibility, silver ion introduction during the nucleation step is preferably extended for a convenient period, typically from 5 seconds to less than a minute. So long as the pCl remains within the ranges set forth above no additional chloride ion need be added to the dispersing medium during the nucleation step. It is, however, preferred to introduce both silver and halide salts concurrently during the nucleation step. The advantage of adding halide salts concurrently with silver salt throughout the nucleation step is that this permits assurance that any grain nuclei formed after the outset of silver ion addition are of essentially similar halide content as those grain nuclei initially formed. Iodide ion addition during the nucleation step is particularly preferred. Since the deposition rate of iodide ion far exceeds that of the other halides, iodide will be depleted from the dispersing medium unless replenished.

Any convenient conventional source of silver and halide ions can be employed during the nucleation step. Silver ion is preferably introduced as an aqueous silver salt solution, such as a silver nitrate solution. Halide ion is preferably introduced as alkali or alkaline earth halide, such as lithium, sodium and/or potassium chloride, bromide and/or iodide.

It is possible, but not preferred, to introduce silver chloride or silver iodochloride Lippmann grains into the dispersing medium during the nucleation step. In this instance grain nucleation has already occurred and what is referred to above as the nucleation step is in reality a step for introduction of grain facet irregularities. The disadvantage of delaying the introduction of grain facet irregularities is that this produces thicker tabular grains than would otherwise be obtained.

The dispersing medium contained in the reaction vessel prior to the nucleation step is comprised of water, the dissolved halide ions discussed above and a peptizer. The dispersing medium can exhibit a pH within any convenient conventional range for silver halide precipitation, typically from 2 to 8. It is preferred, but not required, to maintain the pH of the dispersing medium on the acid side of neutrality (i.e., $<7.0$). To minimize fog a preferred pH range for precipitation is from 2.0 to 5.0. Mineral acids, such as nitric acid or hydrochloride acid, and bases, such as alkali hydroxides, can be used to adjust the pH of the dispersing medium. It is also possible to incorporate pH buffers.

The peptizer can take any convenient conventional form known to be useful in the precipitation of photographic silver halide emulsions and particularly tabular grain silver halide emulsions. A summary of conventional peptizers is provided in *Research Disclosure*, Vol. 308, December 1989, Item 308119, Section IX. *Research Disclosure* is published by Kenneth Mason Publications, Ltd., Emsworth, Hampshire P010 7DD, England.

While synthetic polymeric peptizers of the type disclosed by Maskasky I, cited above and here incorporated by reference, can be employed, it is preferred to employ gelatino peptizers (e.g., gelatin and gelatin derivatives). As manufactured and employed in photography gelatino peptizers typically contain significant concentrations of calcium ion, although the use of deionized gelatino peptizers is a known practice. In the latter instance it is preferred to compensate for calcium ion removal by adding divalent or trivalent metal ions, such alkaline earth or earth metal ions, preferably magnesium, calcium, barium or aluminum ions. Specifically preferred peptizers are low methionine gelatino peptizers (i.e., those containing less than 30 micromoles of methionine per gram of peptizer), optimally less than 12 micromoles of methionine per gram of peptizer, these peptizers and their preparation are described by Maskasky II and King et al, cited above, the disclosures of which are here incorporated by reference. However, it should be noted that the grain growth modifiers of the type taught for inclusion in the emulsions of Maskasky I and II (e.g., adenine) are not appropriate for inclusion in the dispersing media of this invention, since these grain growth modifiers promote twinning and the formation of tabular grains having {111} major faces. Generally at least about 10 percent and typically from 20 to 80 percent of the dispersing medium forming the completed emulsion is present in the reaction vessel at the outset of the nucleation step. It is conventional practice to maintain relatively low levels of peptizer, typically from 10 to 20 percent of the peptizer present in the completed emulsion, in the reaction vessel at the start of precipitation.

To increase the proportion of thin tabular grains having {100} faces formed during nucleation it is preferred that the concentration of the peptizer in the dispersing medium be in the range of from 0.5 to 6 percent by weight of the total weight of the dispersing medium at the outset of the nucleation step. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete.

The nucleation step can be performed at any convenient conventional temperature for the precipitation of silver halide emulsions. Temperatures ranging from near ambient—e.g., 30° C. up to about 90° C. are contemplated, with nucleation temperatures in the range of from 35° to 70° C. being preferred.

Since grain nuclei formation occurs almost instantaneously, only a very small proportion of the total silver need be introduced into the reaction vessel during the nucleation step. Typically from about 0.1 to 10 mole percent of total silver is introduced during the nucleation step.

A grain growth step follows the nucleation step in which the grain nuclei are grown until tabular grains having {100} major faces of a desired average ECD are obtained. Whereas the objective of the nucleation step is to form a grain population having the desired incorporated crystal structure irregularities, the objective of the growth step is to deposit additional silver halide onto (grow) the existing grain population while avoiding or minimizing the formation of additional grains.

If additional grains are formed during the growth step, the polydispersity of the emulsion is increased and, unless conditions in the reaction vessel are maintained as described above for the nucleation step, the additional grain population formed in the growth step will not have the desired tabular grain properties described above.

In its simplest form the process of preparing emulsions according to the invention can be performed as a single jet precipitation without interrupting silver ion introduction from start to finish. As is generally recognized by those skilled in the art a spontaneous transition from grain formation to grain growth occurs even with an invariant rate of silver ion introduction, since the increasing size of the grain nuclei increases the rate at which they can accept silver and halide ion from the dispersing medium until a point is reached at which they are accepting silver and halide ions at a sufficiently rapid rate that no new grains can form. Although manipulatively simple, single jet precipitation limits halide content and profiles and generally results in more polydisperse grain populations.

It is usually preferred to prepare photographic emulsions with the most geometrically uniform grain populations attainable, since this allows a higher percentage of the total grain population to be optimally sensitized and otherwise optimally prepared for photographic use. Further, it is usually more convenient to blend relatively monodisperse emulsions to obtain aim sensitometric profiles than to precipitate a single polydisperse emulsion that conforms to an aim profile.

In the preparation of emulsions according to the invention it is preferred to interrupt silver and halide salt introductions at the conclusion of the nucleation step and before proceeding to the growth step that brings the emulsions to their desired final size and shape. The emulsions are held within the temperature ranges described above for nucleation for a period sufficient to allow reduction in grain dispersity. A holding period can range from a minute to several hours, with typical holding periods ranging from 5 minutes to an hour. During the holding period relatively smaller grain nuclei are Ostwald ripened onto surviving, relatively larger grain nuclei, and the overall result is a reduction in grain dispersity.

If desired, the rate of ripening can be increased by the presence of a ripening agent in the emulsion during the holding period. A conventional simple approach to accelerating ripening is to increase the halide ion concentration in the dispersing medium. This creates complexes of silver ions with plural halide ions that accelerate ripening. When this approach is employed, it is preferred to increase the chloride ion concentration in the dispersing medium. That is, it is preferred to lower the pCl of the dispersing medium into a range in which increased silver chloride solubility is observed. Alternatively, ripening can be accelerated and the percentage of total grain projected area accounted for by {100} tabular grains can be increased by employing conventional ripening agents. Preferred ripening agents are sulfur containing ripening agents, such as thioethers and thiocyanates. Typical thiocyanate ripening agents are disclosed by Nietz et al U.S. Pat. No. 2,222,264, Lowe et al U.S. Pat. No. 2,448,534 and Illingsworth U.S. Pat. No. 3,320,069, the disclosures of which are here incorporated by reference.

Typical thioether ripening agents are disclosed by McBride U.S. Pat. No. 3,271,157, Jones U.S. Pat. No. 3,574,628 and Rosencrantz et al U.S. Pat. No. 3,737,313, the disclosures of which are here incorporated by reference. More recently crown thioethers have been suggested for use as ripening agents. Ripening agents containing a primary or secondary amino moiety, such as imidazole, glycine or a substituted derivative, are also effective. Sodium sulfite has also been demonstrated to be effective in increasing the percentage of total grain projected accounted by the {100} tabular grains.

Once the desired population of grain nuclei have been formed, grain growth to obtain the emulsions of the invention can proceed according to any convenient conventional precipitation technique for the precipitation of silver halide grains bounded by {100} grain faces. Whereas iodide and chloride ions are required to be incorporated into the grains during nucleation and are therefore present in the completed grains at the internal nucleation site, any halide or combination of halides known to form a cubic crystal lattice structure can be employed during the growth step. Neither iodide nor chloride ions need be incorporated in the grains during the growth step, since the irregular grain nuclei faces that result in tabular grain growth, once introduced, persist during subsequent grain growth independently of the halide being precipitated, provided the halide or halide combination is one that forms a cubic crystal lattice. This excludes only iodide levels above 13 mole percent (preferably 6 mole percent) in precipitating silver iodochloride, levels of iodide above 40 mole percent (preferably 30 mole percent) in precipitating silver iodobromide, and proportionally intermediate levels of iodide in precipitating silver iodohalides containing bromide and chloride.

When silver bromide or silver iodobromide is being deposited during the growth step, it is preferred to maintain a pBr within the dispersing medium in the range of from 1.0 to 4.2, preferably 1.6 to 3.4. When silver chloride, silver iodochloride, silver bromochloride or silver iodobromochloride is being deposited during the growth step, it is preferred to maintain the pCl within the dispersing medium within the ranges noted above in describing the nucleation step.

It has been discovered quite unexpectedly that up to 20 percent reductions in tabular grain thicknesses can be realized by specific halide introductions during grain growth. Surprisingly, it has been observed that bromide additions during the growth step in the range of from 0.05 to 15 mole percent, preferably from 1 to 10 mole percent, based on silver, produce relatively thinner {100} tabular grains than can be realized under the same conditions of precipitation in the absence of bromide ion. Similarly, it has been observed that iodide additions during the growth step in the range of from 0.001 to $<1$ mole percent, based on silver, produce relatively thinner {100} tabular grains than can be realized under the same conditions of precipitation in the absence of iodide ion.

During the growth step both silver and halide salts are preferably introduced into the dispersing medium. In other words, double jet precipitation is contemplated, with added iodide salt, if any, being introduced with the remaining halide salt or through an independent jet. The rate at which silver and halide salts are introduced is controlled to avoid renucleation-that is, the formation of a new grain population. Addition rate control to avoid renucleation is generally well known in the art, as illustrated by Wilgus German OLS No. 2,107,118, Irie U.S. Pat. No. 3,650,757, Kurz U.S. Pat. No. 3,672,900, Saito U.S. Pat. No. 4,242,445, Teitschied et al European Patent Application 80102242, and Wey "Growth Mechanism of AgBr Crystals in Gelatin Solution", *Photographic Science and Engineering*, Vol. 21, No. 1, January/February 1977, p. 14, et seq.

In the simplest form of the invention the nucleation and growth stages of grain precipitation occur in the same reaction vessel. It is, however, recognized that grain precipitation can be interrupted, particularly after completion of the nucleation stage. Further, two separate reaction vessels can be substituted for the single reaction vessel described above. The nucleation stage of grain preparation can be performed in an upstream reaction vessel (herein also termed a nucleation reaction vessel) and the dispersed grain nuclei can be transferred to a downstream reaction vessel in which the growth stage of grain precipitation occurs (herein also termed a growth reaction vessel). In one arrangement of this type an enclosed nucleation vessel can be employed to receive and mix reactants upstream of the growth reaction vessel, as illustrated by Posse et al U.S. Pat. No. 3,790,386, Forster et al U.S. Pat. No. 3,897,935, Finnicum et al U.S. Pat. No. 4,147,551, and Verhille et al U.S. Pat. No. 4,171,224, here incorporated by reference. In these arrangements the contents of the growth reaction vessel are recirculated to the nucleation reaction vessel.

It is herein contemplated that various parameters important to the control of grain formation and growth, such as pH, pAg, ripening, temperature, and residence time, can be independently controlled in the separate nucleation and growth reaction vessels. To allow grain nucleation to be entirely independent of grain growth occurring in the growth reaction vessel down stream of the nucleation reaction vessel, no portion of the contents of the growth reaction vessel should be recirculated to the nucleation reaction vessel. Preferred arrangements that separate grain nucleation from the contents of the growth reaction vessel are disclosed by Mignot U.S. Pat. No. 4,334,012 (which also discloses the useful feature of ultrafiltration during grain growth), Urabe U.S. Pat. No. 4,879,208 and published European Patent Applications 326,852, 326,853, 355,535 and 370,116, Ichizo published European Patent Application 0 368 275, Urabe et al published European Patent Application 0 374 954, and Onishi et al published Japanese Patent Application (Kokai) 172,817-A (1990).

Although the process of grain nucleation has been described above in terms of utilizing iodide to produce the crystal irregularities required for tabular grain formation, alternative nucleation procedures have been devised, demonstrated in the Examples below, that eliminate any requirement of iodide ion being present during nucleation in order to produce tabular grains. These alternative procedures are, further, compatible with the use of iodide during nucleation. Thus, these procedures can be relied upon entirely during nucleation for tabular grain formation or can be relied upon in combination with iodide ion during nucleation to product tabular grains.

It has been observed that rapid grain nucleations, including so-called dump nuclearions, in which significant levels of dispersing medium supersaturation with halide and silver ions exist at nucleation accelerate introduction of the grain irregularities responsible for tabularity.

Since nucleation can be achieved essentially instantaneously, immediate departures from initial supersaturation to the preferred pCl ranges noted above are entirely consistent with this approach.

It has also been observed that maintaining the level of peptizer in the dispersing medium during grain nucleation at a level of less than 1 percent by weight enhances of tabular grain formation. It is believed that coalescence of grain nuclei pairs can be at least in part responsible for introducing the crystal irregularities that induce tabular grain formation. Limited coalescence can be promoted by withholding peptizer from the dispersing medium or by initially limiting the concentration of peptizer. Mignot U.S. Pat. No. 4,334,012 illustrates grain nucleation in the absence of a peptizer with removal of soluble salt reaction products to avoid coalescence of nuclei. Since limited coalescence of grain nuclei is considered desirable, the active interventions of Mignot to eliminate grain nuclei coalescence can be either eliminated or moderated. It is also contemplated to enhance limited grain coalescence by employing one or more peptizers that exhibit reduced adhesion to grain surfaces. For example, it is generally recognized that low methionine gelatin of the type disclosed by Maskasky II is less tightly absorbed to grain surfaces than gelatin containing higher levels of methionine. Further moderated levels of grain adsorption can be achieved with so-called "synthetic peptizers"—that is, peptizers formed from synthetic polymers. The maximum quantity of peptizer compatible with limited coalescence of grain nuclei is, of course, related to the strength of adsorption to the grain surfaces.

Once grain nucleation has been completed, immediately after silver salt introduction, peptizer levels can be increased to any convenient conventional level for the remainder of the precipitation process.

The emulsions of the invention include silver chloride, silver iodochloride emulsions, silver iodo-bromochloride emulsions and silver iodochlorobromide emulsions. Dopants, in concentrations of up to $10^{-2}$ mole per silver mole and typically less than $10^{-4}$ mole per silver mole, can be present in the grains. Compounds of metals such as copper, thallium, lead, mercury, bismuth, zinc, cadmium , rhenium, and Group VIII metals (e.g., iron, ruthenium, rhodium, palladium, osmium, iridium, and platinum) can be present during grain precipitation, preferably during the growth stage of precipitation. The modification of photographic properties is related to the level and location of the dopant within the grains. When the metal forms a part of a coordination complex, such as a hexacoordination complex or a tetracoordination complex, the ligands can also be included within the grains and the ligands can further influence photographic properties. Coordination ligands, such as halo, aquo, cyano cyanate, thiocyanate, nitrosyl, thionitrosyl, oxo and carbonyl ligands are contemplated and can be relied upon to modify photographic properties.

Dopants and their addition are illustrated by Arnold et al U.S. Pat. No. 1,195,432; Hochstetter U.S. Pat. No. 1,951,933; Trivelli et al U.S. Pat. No. 2,448,060; Overman U.S. Pat. No. 2,628,167; Mueller et al U.S. Pat. No. 2,950,972; McBride U.S. Pat. No. 3,287,136; Sidebotham U.S. Pat. No. 3,488,709; Rosecrants et al U.S. Pat. No. 3,737,313; Spence et al U.S. Pat. No. 3,687,676; Gilman et al U.S. Pat. No. 3,761,267; Shiba et al U.S. Pat. No. 3,790,390; Ohkubo et al U.S. Pat. No. 3,890,154; Iwaosa et al U.S. Pat. No. 3,901,711; Habu et al U.S. Pat. No. 4,173,483; Atwell U.S. Pat. No. 4,269,927; Janusonis et al U.S. Pat. No. 4,835,093; McDugle et al U.S. Pat. Nos. 4,933,272, 4,981,781, and 5,037,732; Keevert et al U.S. Pat. No. 4,945,035; and Evans et al U.S. Pat. No. 5,024,931, the disclosures of which are here incorporated by reference. For background as to alternatives known to the art attention is directed to B. H. Carroll, "Iridium Sensitization: A Literature Review", *Photographic Science and Engineering*, Vol. 24, NO. 6, November/December 1980, pp. 265–257, and Grzeskowiak et al published European Patent Application 0 264 288.

The invention is particularly advantageous in providing high chloride (greater than 50 mole percent chloride) tabular grain emulsions, since conventional high chloride tabular grain emulsions having tabular grains bounded by {111} are inherently unstable and require the presence of a morphological stabilizer to prevent the grains from regressing to nontabular forms. Particularly preferred high chloride emulsions are according to the invention that are those that contain more than 70 mole percent (optimally more than 90 mole percent) chloride.

Although not essential to the practice of the invention, a further procedure that can be employed to maximize the population of tabular grains having {100} major faces is to incorporate an agent capable of restraining the emergence of non-{100} grain crystal faces in the emulsion during its preparation. The restraining agent, when employed, can be active during grain nucleation, during grain growth or throughout precipitation.

Useful restraining agents under the contemplated conditions of precipitation are organic compounds containing a nitrogen atom with a resonance stabilized p electron pair. Resonance stabilization prevents protonation of the nitrogen atom under the relatively acid conditions of precipitation.

Aromatic resonance can be relied upon for stabilization of the p electron pair of the nitrogen atom. The nitrogen atom can either be incorporated in an aromatic ring, such as an azole or azine ring, or the nitrogen atom can be a ring substituent of an aromatic ring.

In one preferred form the restraining agent can satisfy the following formula:

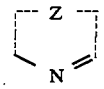

(I)

where

Z represents the atoms necessary to complete a five or six membered aromatic ring structure, preferably formed by carbon and nitrogen ring atoms. Preferred aromatic rings are those that contain one, two or three nitrogen atoms. Specifically contemplated ring structures include 2H-pyrrole, pyrrole, imidazole, pyrazole, 1,2,3-triazole, 1,2,4-triazole, 1,3,5-triazole, pyridine, pyrazine, pyrimidine, and pyridazine.

When the stabilized nitrogen atom is a ring substituent, preferred compounds satisfy the following formula:

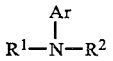

(II)

where

Ar is an aromatic ring structure containing from 5 to 14 carbon atoms and $R^1$ and $R^2$ are independently hydrogen, Ar, or any convenient aliphatic group or together complete a five or six membered ring. Ar is preferably a carbocyclic aromatic ring, such as phenyl or naphthyl. Alternatively any of the nitrogen and carbon containing aromatic rings noted above can be attached to the nitrogen atom of formula II through a ring carbon atom. In this instance, the resulting compound satisfies both formulae I and II. Any of a wide variety of aliphatic groups can be selected. The simplest contemplated aliphatic groups are alkyl groups, preferably those containing from 1 to 10 carbon atoms and most preferably from 1 to 6 carbon atoms. Any functional substituent of the alkyl group known to be compatible with silver halide precipitation can be present. It is also contemplated to employ cyclic aliphatic substituents exhibiting 5 or 6 membered rings, such as cycloalkane, cycloalkene and aliphatic heterocyclic rings, such as those containing oxygen and/or nitrogen hetero atoms. Cyclopentyl, cyclohexyl, pyrrolidinyl, piperidinyl, furanyl and similar heterocyclic rings are specifically contemplated.

The following are representative of compounds contemplated satisfying formulae I and/or II:

R-1

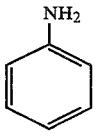

aniline

RA-2

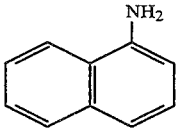

a-naphthylamine

RA-3

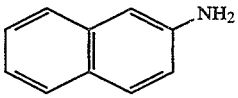

b-naphthylamine

RA-4

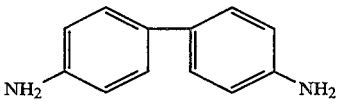

benzidine

-continued

RA-5

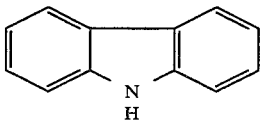

carbazole

RA-6

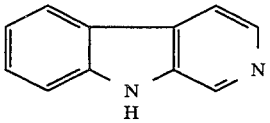

norharman

RA-7

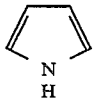

pyrrole

RA-8

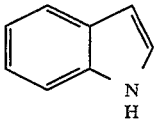

indole

RA-9

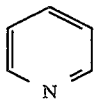

pyridine

RA-10

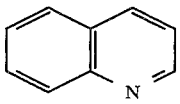

quinoline

RA-11

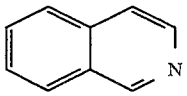

isoquinoline

RA-12

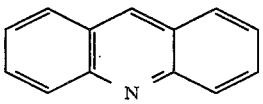

acridine

RA-13

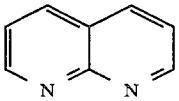

1,8-naphthyridine

-continued

RA-14

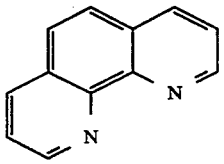

1,10-phenanthroline

RA-15

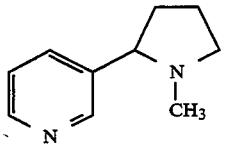

nicotine

RA-16

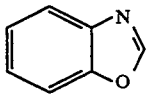

benzoxazole

RA-17

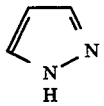

pyrazole

RA-18

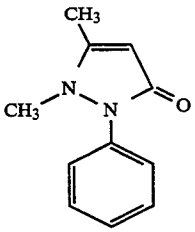

antipyrine

RA-19

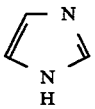

imidazole

RA-20

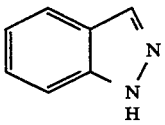

indazole

RA-21

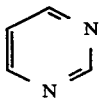

pyrimidine

RA-22

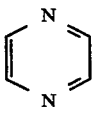

pyrazine

-continued

RA-23

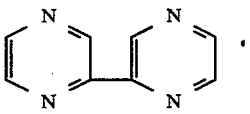

2,2'-bipyrazine

RA-24

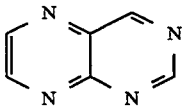

pteridine

RA-25

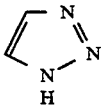

1,2,3-triazole

RA-26

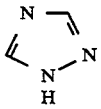

1,2,4-triazole

RA-27

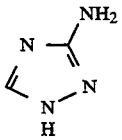

3-amino-1,2,4-triazole

RA-28

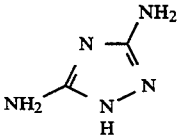

3,5-diamino-1,2,4-triazole

RA-29

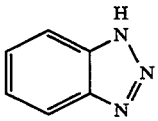

benzotriazole

RA-30

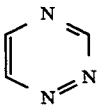

1, 2, 4-triazine

RA-31

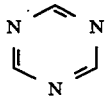

1, 3, 5-triazine

Selection of preferred restraining agents and their useful concentrations can be accomplished by the following selection procedure: The compound being considered for use as a restraining agent is added to a silver chloride emulsion consisting essentially of cubic grains with a means grain edge length of 0.3 mm. The emulsion is 0.2M in sodium acetate, has a pCl of 2.1, and has a pH that is at least one unit greater than the pKa of the compound being considered. The emulsion is held at 75° C. with the restraining agent present for 24 hours. If, upon microscopic examination after 24 hours, the cubic grains have sharper edges of the {100} crystal faces than a control differing only in lacking the compound being considered, the compound introduced is performing the function of a restraining agent. The significance of sharper edges of intersection of the {100} crystal faces lies in the fact that grain edges are the most active sites on the grains in terms of ions reentering the dispersing medium. By maintaining sharp edges the restraining agent is acting to restrain the emergence of non-{100} crystal faces, such as are present, for example, at rounded edges and corners.

In some instances instead of dissolved silver chloride depositing exclusively onto the edges of the cubic grains a new population of grains bounded by {100} crystal faces is formed. Optimum restraining agent activity occurs when the new grain population is a tabular grain population in which the tabular grains are bounded by {100} major crystal faces.

It is specifically contemplated to deposit epitaxially silver salt onto the tabular grains acting as hosts. Conventional epitaxial depositions onto high chloride silver halide grains are illustrated by Maskasky U.S. Pat. No. 4,435,501 (particularly Example 24B); Ogawa et al U.S. Pat. Nos. 4,786,588 and 4,791,053; Hasebe et al U.S. Pat. Nos. 4,820,624 and 4,865,962; Sugimoto and Miyake, "Mechanism of Halide Conversion Process of Colloidal AgCl Microcrystals by $Br^-$ Ions", Parts I and II, *Journal of Colloid and Interface Science*, Vol. 140, No. 2, December 1990, pp. 335–361; Houle et al U.S. Pat. No. 5,035,992; and Japanese published applications (Kokai) 252649-A (priority 02.03.90-JP 051165 Japan) and 288143-A (priority 04.04.90-JP 089380 Japan). The disclosures of the above U.S. patents are here incorporated by reference.

The display elements of this invention are silver halide photographic elements suitable to receive the transfer of an image from an originating element, such as color paper or a motion picture film. Such an image transfer may be accomplished by various methods known in the art. The term counterpart display element used herein refers to the display element which receives an image from a specific originating photographic element, such as the paper used for a print which results from a color negative.

The photographic emulsions used in the display element may include may include, among others, silver chloride, silver bromochloride, silver bromide, silver iodobromochloride, silver iodochloride or silver iodobromide. Silver chloride and silver bromochloride emulsions are preferred. Whatever the emulsion mix, the display photographic element must contain at least about 50 mole % silver chloride, with 70 mole % being preferrred and over 98 mole % being most preferred. The total amount of silver iodide in the photographic element must be less than about 2 mole %, and preferrably less than 1 mole %. The total amount of coated silver may be from about 0.10 to about 3.0 grams per square meter, with less than 2.0 grams per square meter preferred.

In this invention, one or more of the corresponding developing, blixing, bleaching or fixing solutions used to process the originating photographic elements and the display photographic elements of this invention have substantially the same chemical compositions or contain substantially the same chemical components. The term "corresponding" means the solution used in the same processing step for both the originating and display element. For example, the bleach used to bleach the originating element and the bleach used to bleach the display element are corresponding solutions.

Having substantially the same chemical composition refers to the chemical composition of the solution before it becomes seasoned with chemical components which have leached from the film or which have been carried over from other processing solutions. It further refers to solutions containing the same chemical components in the same concentrations with only the minor variations which may result when different batches of solutions are mixed using the same formulation.

When using corresponding solutions with the same chemical composition it is preferable that the vessels containing the corresponding solutions for the originating and display elements are fed from a common source. In one embodiment the originating and the display elements are processed in one or more common solutions, meaning that a particular processing step for both elements is performed in the same tank.

Having the substantially the same chemical components refers to the chemical components contained in the solution before it becomes seasoned with other chemical components which have leached from the film or which have been carried over from other processing solutions. Such corresponding solutions may contain the same chemical components in different concentrations. In this embodiment the same replenishers and regenerators may be utilized for the corresponding solutions by varying only the amount to be added.

Numerous processing embodiments are available pursuant to this invention. These range from developing and desilvering the originating and display photographic elements in common developing and desilvering solutions to developing and desilvering the originating and display elements wherein only one of corresponding solutions has substantially the same chemical composition or same chemical components. While total common processing is desirable from the standpoint of simplicity, given the practical aspects of existing processing equipment and environmental restrictions it is preferred that the processing of the originating and display elements be performed in corresponding solutions having substantially the same chemical components or compositions, but not in common solutions.

More preferred is utilizing developers of differing chemical compositions but desilvering in corresponding solutions having the same chemical components or compositions. Preferably the originating element is developed in less than about 4 minutes and desilvered in less than about 8 minutes.

It is known to those skilled in the art that numerous other auxiliary processing steps are often used including washing, stabilizing, rinsing, reversal processing and neutralization. One or more of these steps may also be performed for originating and display elements in common or in substantially similar solutions.

Any developer which is suitable for use with low iodide, chloride containing elements may be utilized with this invention. Such color developing solutions typically contain a primary aromatic amino color developing agent. These color developing agents are well known and widely used in a variety of color photographic processes. They include aminophenols and p-phenylenediamines. The content of the color developing agent is generally 1 to 30 grams per liter of the color developing solution, with 2 to 20 grams being more preferred and 3 to 10 grams being most preferred.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene. Particularly useful primary aromatic amino color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include:

N-N-diethyl-p-phenylenediaminemonohydrochloride, 4-N,N-diethyl-2-methylphenylenediaminemonohydrochloride, 4-(N-ethyl-N-2-methanesulfonylaminoethyl)-2-methylphenylenediamine sesquisulfate monohydrate, 4-(N-ethyl-N-2-hydroxyethyl)-2-methylphenylenediamine sulfate, and 4-N,N-diethyl-2,2'-methanesulfonylaminoethylphenylenediamine hydrochloride.

In addition to the primary aromatic amino color developing agent, the color developing solutions used with this invention may contain a variety of other agents such as alkalies to control pH, bromides, iodides, benzyl alcohol, anti-oxidants, anti-foggants, solubilizing agents, brightening agents, and so forth.

The photographic color developing compositions may be employed in the form of aqueous alkaline working solutions having a pH of above 7 and more preferably in the range of from about 9 to about 13. To provide the necessary pH, they may contain one or more of the well known and widely used pH buffering agents, such as the alkali metal carbonates or phosphates. Potassium carbonate is especially preferred.

When the originating and display photographic elements are developed in corresponding developers of substantially the same chemical composition or having substantially the same chemical components, the preferred developer is substantially free of bromide and comprises 4-(N-ethyl-N-2-methanesulfonylaminoethyl)-2-methylphenylenediamine sesquisulfate monohydrate as the developing agent. It further contains less than about 0.2 moles of sulfite per mole of the color developing agent.

In addition to the developing agent, the preferred developer contains an N,N-dialkylhydroxylamine.

The N,N-dialkylhydroxylamine can be used in the color developing composition in the form of the free amine, but is more typically employed in the form of a water-soluble acid salt. Typical examples of such salts are sulfates, oxalates, chlorides, phosphates, carbonates, and acetates. Typical examples of N,N-dialkylhydroxylamines include N,N-diethylhydroxylamine, N-ethyl-N-methylhydroxylamine, N-ethyl-N-propylhydroxylamine, N,N-dipropylhydroxylamine, and N-methyl-N-butylhydroxylamine.

When different developers are used for the originating and display elements, the preferred developer for the display element is the same as the prefered developer for common developing described above. The preferred developer for the originating photographic element contains (1) 4-(N-ethyl-N-2-hydroxyethyl)-2-methylphenylenediamine sulfate as the developing agent, (2) hydroxylamine sulphate, (3) at least about 0.2 moles of sulfite per mole of 4-(N-ethyl-N-2-hydroxyethyl)-2-methylphenylenediamine sulfate; and (4) at least about 0.01 moles/liter of bromide.

The originating and display photographic elements of the present invention are desilvered after color development is performed. Desilvering can be performed by one of the following methods (i) a method using a bleaching solution bath and fixing solution bath; (ii) a method using a bleaching solution bath and a blixing solution bath; (iii) a method using a blixing solution and a fixing solution bath; and (iv) a method using a single blixing bath. Blixing may be preferred in order to shorten the process time.

Examples of bleaching agents which may be used in the bleach solutions or blix solutions of the current invention are ferric salts, persulfate, dichromate, bromate, red prussiate, and salts of aminopolycaroxylic acid ferric complexes, with salts of aminopolycaroxylic acid ferric complexes being preferred.

Preferred aminopolycarboxylic acid ferric complexes are listed below:

(1) ethylenediaminetetraacetic acid ferric complex;
(2) diethylenetriaminepentaacetic acid ferric complex;
(3) cyclohexanediaminetetraacetic acid ferric complex;
(4) iminodiacetic acid ferric complex;
(5) methyliminodiacetic acid ferric complex;
(6) 1,3-diaminopropanetetraacetic acid ferric complex;
(7) glycoletherdiaminetetraacetic acid ferric complex;
(8) beta-alanine diacetic acid ferric complex.

These aminopolycarboxylic acid ferric complexes are used in the form of a sodium salt, potassium salt, or ammonium salt. An ammonium salt may be preferred for speed, with alkali salts being preferred for environmental reasons.

The content of the salt of an aminopolycarboxylic acid ferric complex in the bleaching solutions and blixing solutions of this invention is about 0.05 to 1 mol/liter. The pH range of the bleaching solution is 2.5 to 7, and preferably 4.0 to 7.

The bleaching solution or the blixing solution can contain rehalogenating agents such as bromides (e.g., potassium bromide, sodium bromide, and ammonium bromide), chlorides (e.g., potassium chloride, sodium chloride, and ammonium chloride), and iodides (e.g., ammonium iodide).

They may also contain one or more inorganic and organic acids or alkali metal or ammonium salts thereof, and, have a pH buffer such as boric acid, borax, sodium methabrate, acetic acid, sodium acetate, sodium carbonate, potassium carbonate, phosphorous acid, phosphoric acid, sodium phosphate, citric acid, sodium citrate, and tartaric acid, or corrosion inhibitors such as ammonium mitrate and guanidine.

Examples of fixing agents which may be used in the this invention are water-soluble solvents for silver halide such as: a thiosulfate (e.g., sodium thiosulfate and ammonium thiosulfate); a thiocyanate (e.g., sodium thiocyanate and ammonium thiocyanate); a thioether compound (e.g., ethylenebisthioglycolic acid and 3,6-dithia-1,8-octanediole); and a thiourea. These fixing agents can be used singly or in a combination of at least two agents. Thiosulfate is preferably used in the present invention.

The content of the fixing agent per liter is preferably about 0.2 to 2 mol. The pH range of the blixing or fixing solution is preferably 3 to 10 and more preferably 5 to 9.

In order to adjust the pH of the fixing solution, hydrochloric acid, sulfuric acid, nitric acid, acetic acid, bicarbonate, ammonia, potassium hydroxide, sodium hydroxide, sodium carbonate, potassium carbonate,may be added.

The blixing and the fixing solution may also contain a preservative such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite).

The content of these compounds is about 0 to 0.50 mol/liter, and more preferably 0.02 to 0.40 mol/liter as an amount of sulfite ion. Ascorbic acid, a carbonyl bisulfite, acid adduct, or a carbonyl compound may also be used as a preservative.

When the originating and display photographic elements are to be desilvered by blixing in corresponding solutions having substantially the same chemical components the preferred blixing solution contains thiosulfate and ferric ethylenediamine tetraacetic acid, with ammonium as the preferred counter ion. Adequate desilvering of the originating photographic element may be accomplished in 15 to 260 seconds, with 20 to 180 being preferred.

When the corresponding blixing solutions have substantially the same chemical composition the blixing solution should contain less than about 0.75 moles/liter of thiosulphate, with ammonium thiosulphate being preferred, and less than about 0.25 moles/liter of a ferric aminopolycarboxylic acid complex, with ferric ethylenediamine tetraacetic acid being preferred. Adequate desilvering of the originating photographic element should be accomplished in less than 4 minutes. Preferably the originating element should be blixed for 1 to 4 minutes, with 2 to 4 minutes preferred for originating elements containing greater than 5 grams of silver per square meter or comprising a development inhibitor with a sulphur silver binding group.

When the originating and display photographic elements are to be bleached in corresponding solutions having substantially the same chemical components the preferred bleach solution contains ferric 1,3-propylenediamine tetraacetic acid and contains substantially no ammonium ion; that is the unseasoned solution contains no ammonium ion.

Adequate bleaching of the originating photographic element may be accomplished in 20 to 260 seconds, with 30 to 120 being preferred.

When the corresponding bleaching solutions have substantially the same chemical composition the bleaching solution should contain less than about 0.075 moles/liter of a ferric aminopolycarboxylic acid complex, with ferric 1,3-propylenediamine tetraacetic acid being preferred. Preferably the bleaching solution contains substantially no ammonium ion. Preferred bleaching times are 0.5 to 6 minutes, with 2 to 6 being preferred for originating photographic elements containing greater than 5 grams of silver per square meter and comprising a development inhibitor with a sulphur silver binding group.

When the originating and display photographic elements are to be fixed in corresponding solutions having substantially the same chemical components the preferred fixing solution contains sodium thiosulphate and substantially no ammonium ion; that is the unseasoned solution contains no ammonium ion. Adequate fixing of the originating photographic element may be accomplished in 20 to 260 seconds, with 30 to 120 being preferred.

When the corresponding fixing solutions have substantially the same chemical composition the fixing solution should contain less than about 0.25 moles/liter of a thiosulphate. Preferably the fixing solution contains substantially no ammonium ion. Preferred fixing times are 0.5 to 6 minutes, with 2 to 6 being preferred for originating photographic elements containing greater than 5 grams of silver per square meter and comprising a development inhibitor with a sulphur silver binding group.

In one embodiment the corresponding bleaching and fixing solutions used to bleach and fix the originating and display photographic elements have substantially the same chemical composition and the originating photographic element contains less than 5 grams of silver per square meter. In this embodiment the originating element is desilvered in less than 8 minutes.

Specific desilvering methods which may be used with the originating and/or display elements of this invention include the following.

The photographic elements of this invention may be blixed in a blixing solution having a pH between 2.0 and 5.5 and containing hydrogen peroxide or sodium perborate in an amount of 0.05 to 3.0 moles/L. The blixing solution also contains at least one organic acid or salt thereof selected from the group consisting of (1) lower aliphatic carboxylic acids ($R^1$cooH), wherein $R^1$ is a hydrogen atom or an alkyl group having 1 to 3 carbon atoms (in an amount of 0.05 moles to 3.0 moles/L); (2) diacids (HOOC-$R^2$-COOH), wherein $R^2$ is an alkylene or alkenylene group having 1 to 5 carbon atoms (in an amount of 0.05 moles to 3.0 moles/L); or (3) alkylidene diphosponic acids ($C(X)((CH_2)n^2H)(PO_3H_2)_2$; X=H or OH, $n^2$=0 to 5)(in an amount of 0.01 to 1.0 mole/L); or the alkali metal salts of the above. The preferred organic and diphosponic acids include formic acid, acetic acid, propionic acid, citric acid, methylene diphosphonic acid, ethylidene diphosphonic acid, 1-hydroxyethylidene-1,1-diphosphonic acid, and 1-hydroxybutylidene-1,1-diphosphonic acid and the alkali metal salts thereof. The blixing solution may also contain at least one inorganic salt of a transition metal, with a barium salt, osmium salt, tungstate salt, silver salt, gold salt, platinum salt, cerium salt, chromium salt or selenium salt being preferred. These blixing solutions and their use are further described in U.S. Pat. No. 4,277,556 (S. Koboshi et al.), issued Jul. 7, 1981, hereby incorporated by reference.

The photographic elements of this invention may be bleached or blixed with a solution comprising, as the bleaching agent, a ferric complex of an alkyliminodiacetic acid, the alkyl group of which contains from 1 to 6 carbon atoms. Methyliminodiacetic acid is among the preferred ligands. These bleaching and blixing solutions and their use are further described in U.S. Pat. No. 4,294,914 (J. R. Fyson), issued Oct. 13, 1981, and hereby incorporated by reference.

The photographic elements of this invention may be blixed in a solution in which the bleaching agent is an iron(III) complex with beta-alaninediacetic acid ($HOOCCH_2CH_2N(CH_2COOH)_2$)(ADA). The blixing solution is pH adjusted between 4.5 and 7.0 and contains thiosulfate. The blixing solution further contains at least about 50 mole % ADA per mole ferric ion, preferably at least 80 mole % ADA, and more preferably 1 to 120 mole % excess free ADA. These blixing solutions and their use are further described in German Patent Application DE 4,031,757 A1 (G. Tappe et al.), published Apr. 9, 1992, hereby incorporated by reference. The same bleaching agent and closely related bleaching agents may be used in bleaching compositions to process the photographic elements of this invention. For example, a bleach bath may contain a Fe(III) complex, the complexing agent of which represents at least 20 mole % of ADA or glycinedipropionic acid ($HOOCCH_2N(CH_2CH_2COOH)_2$)(GDPA) or closely related complexing agents. Bleach baths of this type are further described in German Patent Application 3,939,755 A1, published Jun. 6, 1991; German Patent Application 3,939,756 A1, published Jun. 6, 1991; German Patent Application 4,029,805 A1, published Mar. 26, 1992; European Patent Application 498,950 A1, published Dec. 2, 1991; and U.S. Pat. No. 4,914,008, issued Apr.3, 1990, all of which are hereby incorporated by reference.

The photographic elements of this invention may be bleached in a bleaching solution consisting essentially of an aqueous solution having a pH of at least 7, which contains a peroxy compound, a buffering agent, and a polyacetic acid which contains at least three carboxyl groups and is selected from the group consisting of aminopolyacetic acids and thiopolyacetic acids. The preferred pH range is from about 8 to about 10. The preferred peroxy compound is hydrogen peroxide. The preferred buffering agents are selected from the group consisting of hydroxides, borates, phosphates, carbonates and acetates. The polyacetic acid is preferrably selected from the group consisting of 2-hydroxy-trimethylenedinitrilo tetraacetic acid, 1,2-propanediaminetetraacetic acid, ethanediylidenetetrathio tetraacetic acid, ethylenedinitrilotetraacetic acid, cyclohexylenedinitrilo tetraacetic acid, nitrilotriacetic acid, and diethylenetriamine pentaacetic acid; and more preferably 2-hydroxytrimethylenedinitrilo tetraacetic acid. These bleaches and their use are further described in U.S. Pat. No. 4,454,224 (G. J. Brien and J. L. Hall), issued Jun. 12, 1984, and hereby incorporated by reference.

The photographic elements of this invention may be blixed in a blixing solution containing an aqueous alkaline solution of a peroxy compound and an ammonium or amine salt of a weak acid selected from the group consisting of carbonic acid, phosphoric acid, sulfurous acid, boric acid, formic acid, acetic acid, propionic acid and succinic acid. A pH range from 8 to 12 is preferred, with a pH from 9 to 11 being more preferred. Preferred peroxy compounds are hydrogen peroxide, an alkali metal perborate or an alkali metal percarbonate. The preferred salt of a weak acid is ammonium carbonate. These blix solutions and their use are further described in U.S. Pat. No. 4,717,649 (J. L. Hall and J. J. Hastreiter, Jr), issued Jan. 5, 1988 and U.S. Pat. No. 4,737,450 (J. L. Hall and J. J. Hastreiter, Jr.), issued Apr. 12, 1988, both of which are hereby incorporated by reference.

The photographic elements of this invention may be bleached or blixed with bleaching or bleach-fixing solutions containing at least one of hydrogen peroxide and a compound capable of releasing hydrogen peroxide, and at least one water-soluble chloride. The water soluble chloride is preferably an alkali metal salt or a quaternary ammonium salt and preferably is present at 0.005 to 0.3 moles per liter. The bleaching or blixing solutions also preferably contain an organic phosphonic acid or a salt thereof, more preferably of the type $R^1N(CH_2PO_3M_2)_2$, wherein M represents a hydrogen atom or a cation imparting water solubility (for example, alkali metal such as sodium and potassium; ammonium, pyridinium, triethanolammonium or triethylammonium ion); and $R^1$ represents an alkyl group having from 1 to 4 carbon atoms, an aryl group, an araalkyl group, an alicyclic group, or a heterocyclic group each of which may be substituted with a hydroxyl group, an alkoxy group a halogen atom, $—PO_3M_2$, $—CH_2PO_3M_2$ or $—N(CH_2PO_3M_2)_2$; or of the type ($R^2R^3C(PO_3M_2)_2$), where $R^2$ represents a hydrogen atom, an alkyl group, an aralkyl group, an alicyclic group, a heterocyclic group or an alkyl group, or $—PO_3M_2$; and $R^3$ represents a hydrogen atom, a hydroxyl group, an alkyl group, or a substituted alkyl group or $—PO_3M_2$. The organic phosphonic acid or salt thereof is preferably present at a concentration from 10 mg/L. The pH of the solutions are in the range of 7 to 13, and more preferably 8 to 11. These bleaching and blixing solutions are further described in EP 90 12 1624 (K. Nakamura), published May 22, 1991, hereby incorporated by reference.

The photographic elements of this invention may be developed and bleached by a method of processing that includes a redox-amplification dye image-forming step and a bleach step using an aqueous solution of hydrogen peroxide or a compound capable of releasing hydrogen peroxide. The preferred pH of the bleach solution is from 1 to 6, more preferrably from 3 to 5.5. The photographic elements may further be fixed in a sulfite fixer with or without a low level of thiosulfate (e.g., 60 g $Na_2SO_3$/L and 2 g $Na_2S_2O_3$/L). This processing method is further described in PCT Application WO 92/01972 (P. D. Marsden and J. R. Fyson), published Feb.6, 1992, hereby incorporated by reference.

The photographic elements of this invention may be bleached in a bleaching solution containing hydrogen peroxide, or a compound which releases hydrogen peroxide, and halide ions and which has a pH in the range of 5 to 11. Chloride ion is the preferred halide and is preferably present at 0.52 to 1 g Cl/L. These bleaching solutions and their use are further described in PCT Application WO 92/07300 (J. R. Fyson and P. D. Marsden), published Apr. 30, 1992, hereby incorporated by reference.

The photographic elements of this invention can also be bleached in ferricyanide bleaches, as described in G. Haist, "Modern Photographic Processing, vol. 1" 1978, Wiley, p. 569, and references therein, hereby incorporated by reference. Bleaches of this type are well known in the art and have been used commercially for decades. Typical ferricyanide bleaches contain 10 to 100 g/L of an alkali metal ferricyanide and 10 to 100 g/L of an alkali metal bromide salt (e.g., NaBr). The preferred pH range of these bleaches is from 5 to 8, more preferably from 6 to about 7. A variety of buffers, such as borax, carbonates or phosphates, may be used.

The photographic elements of this invention may be fixed in an aqueous fixing solution containing a concentration of from 5 to 200 g/L of an alkali metal sulfite as the sole silver halide solvent. The alkali metal sulfite is preferably 10 to 150 g/L of anhydrous sodium sulfite. The fixer bath pH is preferably greater than 6. It is preferred to use a silver chloride forming bleaching step prior to the fixing step. These fixing solutions and their use are further described in U.S. Pat. No. 5,171,658 (J. R. Fyson) issued Dec. 15, 1992 hereby incorporated by reference.

The photographic elements of this invention may be fixed in a fixing solution which has a thiosulfate concentration from about 0.05 to about 3.0 molar and an ammonium concentration of 0.0 to about 1.2 molar, preferably less than 0.9 molar, and more preferably essentially absent. In this embodiment the photographic elements preferably have a silver halide content of less than 7.0 $g/m^2$ based on silver and an iodide content of less than about 0.35 $g/m^2$. Further, they preferably contain an emulsion containing from about 0.2 to 3.0 $g/m^2$, based on silver , of a silver halide emulsion in which greater than 50% of the projected surface area is provided by tabular grains having a tabularity between 50 and 25,000. These fixing solutions and their use are further described in U.S. Pat. No. 5,183,727 (E. R. Schmittou and A. F. Sowinski), issued Feb. 2, 1993, hereby incorporated by reference.

The photographic elements of this invention may be bleached by contacting the them with a persulfate bleach solution in the presence of an accelerating amount of a complex of ferric ion and a 2-pyridinecarboxylic acid or a 2,6-pyridinedicarboxylic acid. The complex of ferric ion and a 2-pyridinecarboxylic acid or a 2,6-pyridinedicarboxylic acid may be contained in the bleach itself, a prebleach or in the photographic element. The persulfate is preferably sodium persulfate. The 2-pyridinecarboxylic acid or 2,6-pyridinedicarboxylic acid is of the formula:

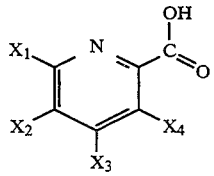

I

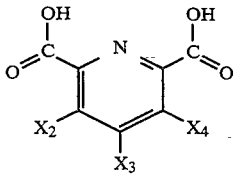

II wherein $X_1$, $X_2$, $X_3$ and $X_4$ are independently H, OH, $CO_2M$, $SO_3M$, or $PO_3M$, and M is H or an alkali metal cation. Most preferably $X_1$, $X_2$, $X_3$ and $X_4$ are H. When contained in the bleaching solution the concentration of the ferric ion is preferably 0.001 to 0.100M and the concentration of the 2-pyridinecarboxylic acid or 2,6-pyridinedicarboxylic acid is 0.001 to 0.500M.

The pH of the bleach solution is preferably 3 to 6. These bleaching solutions and their use are further described in U.S. patent application Ser. No.990,500 (Buchanan et al.), filed Dec. 14, 1992, hereby incorporated by reference.

Peracid bleaches may be especially useful with the originating photographic elements of this invention when the color silver halide photographic element has a speed greater than ISO 180 or contains at least one spectrally sensitized silver halide emulsion with a tabularity greater than 100, and when the photographic element comprises a total amount of incorporated silver and incorporated vehicle of 20 $g/m^2$ film or less. The developed photographic element should be bleached in the presence of a bleach accelerator. Preferably the peracid is a sodium, potassium, or ammonium persulfate bleach and the amount of silver in the photographic element is less than 10 $g/m^2$ of film. These bleaches and photographic elements are further described in U.S. patent application Ser. No.891,601 (English et al.) filed Jun. 1, 1991, hereby incorporated by reference.

The photographic elements of this invention may also be desilvered by bleaching the photographic element with a peracid bleach, and subsequently contacting the photographic element with a fixer solution comprising thiosulfate anion and sodium cation. This is particularly useful in the following embodiments:

(1) when the product of the contact time of the photographic element with the fixer solution and the molar concentration of the thiosulfate anion divided by the proportion of the sodium cation as counterion (Molar-minute fixing time) is less than 1.9 Molar-minutes. More preferably the Molar-minute fixing time is less than 0.825 Molar minutes. The preferred peracid bleach is a persulfate or peroxide, with sodium persulfate being most preferred. Preferably the fixer solution has an ammonium cation concentration of less than 0.8M, and more preferably the fixer solution is substantially free of ammonium cation. It is preferred that the proportion of sodium cation as counterion is greater than 50%; and (2) when the photographic element has a silver content of less than 7.0 $g/m^2$; and the fixer solution has an ammonium ion content of less than 1.4M. The preferred peracid bleach is a persulfate or peroxide, with sodium persulfate being most preferred. Preferably the fixer solution has an ammonium cation concentration of less than 0.9M, and more preferably the fixer solution is substantially free of ammonium cation. It is preferred that the photographic element comprises at least one silver halide emulsion in which greater than 50% of the projected surface area is provided by tabular grains having a tabularity between 50 and 25,000. It is also preferred that the photographic element has a silver content of less than 6.0 $g/m^2$. The above desilvering solutions and their use are further described in U.S. patent application Ser. No. 998,155, A Method of Bleaching and Fixing a Color Photographic Element,(Szajewski and Buchanan), filed Dec. 29, 1992; and U.S. patent application Ser. No. 998,157, U.S. patent application Ser. No.998,156, A Method of Bleaching and Fixing a Low Silver Color Photographic Element,(Szajewski and Buchanan), filed Dec. 29, 1992; all hereby incorporated by reference.

The photographic elements of this invention may also be processed in KODAK Process ECN and ECP, which are described in Kodak H-24.07 "Manual for Processing Eastman Motion Picture Films, Module 7" (ECN) and Kodak H-24.09 "Manual for Processing Eastman Color Films, Module 9" (ECP), available from Eastman Kodak Company, Department 412-L, Rochester, N.Y., hereby incorporated by reference.

It is specifically contemplated to process, that is, develop, stop, bleach, wash, fix, blix or stabilize, the originating and display elements of this invention by immersing the elements in a processing solution and applying the solution to the surface of the photosensitive layers of the elements as a jet-stream while the element is immersed in the solution. When this jet-stream method is employed, the preferred time of contact of a process solution with the photographic element may be greatly shortened, often by as much as 90%. Development by this method is described in U.S. Pat. No. 5,116,721 (S. Yamamoto) issued May 26, 1992, hereby incorporated by reference.

The emulsions used in this invention can be chemically sensitized with active gelatin as illustrated by T. H. James, *The Theory of the Photographic Process*, 4th Ed., Macmillan, 1977, pp. 67–76, or with sulfur, selenium, tellurium, gold, platinum, palladium, iridium, osmium, rhenium or phosphorus sensitizers or combinations of these sensitizers, such as at pAg levels of from 5 to 10, pH levels of from 5 to 8 and temperatures of from 30 to 80° C., as illustrated by *Research Disclosure*, Vol. 120, April, 1974, Item 12008, *Research Disclosure*, Vol. 134, June, 1975, Item 13452, Sheppard et al U.S. Pat. No. 1,623,499,Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Patent 1,396,696; chemical sensitization being optionally conducted in the presence of thiocyanate derivatives as described in Damschroder U.S. Pat. No. 2,642,361; thioether compounds as disclosed in Lowe et al U.S. Pat. No. 2,521,926, Williams et al U.S. Pat. No. 3,021,215 and Bigelow U.S. Pat. No. 4,054,457; and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714; elemental sulfur as described by Miyoshi et al European Patent Application EP 294,149 and Tanaka et al European Patent Application EP 297,804; and thiosulfonates as described by Nishikawa et al European Patent Application EP 293,917. Additionally or alternatively, the emulsions can be reduction-sensitized—e.g., with hydrogen, as illustrated by Janusonis U.S. Pat. No. 3,891,446 and Babcock et al U.S. Pat. No. 3,984,249, by low pAg (e.g., less than 5), high pH (e.g., greater than 8) treatment, or through the use of reducing agents such as stannous chloride, thiourea dioxide, polyamines and amineboranes as illustrated by Allen et al U.S. Pat. No. 2,983,609, Oftedahl et al *Research Disclosure*, Vol. 136, August, 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564.

Chemical sensitization can take place in the presence of spectral sensitizing dyes as described by Philippaerts et al U.S. Pat. No. 3,628,960, Kofron et al U.S. Pat. No. 4,439,520, Dickerson U.S. Pat. No. 4,520,098, Maskasky U.S. Pat. No. 4,435,501, Ihama et al U.S. Pat. No. 4,693,965 and Ogawa U.S. Pat. No. 4,791,053. Chemical sensitization can be directed to specific sites or crystallographic faces on the silver halide grain as described by Haugh et al U.K. Patent Application 2,038,792A and Mifune et al published European Patent Application EP 302,528.

The sensitivity centers resulting from chemical sensitization can be partially or totally occluded by the precipitation of additional layers of silver halide using such means as twin-jet additions or pAg cycling with alternate additions of silver and halide salts as described by Morgan U.S. Pat. No. 3,917,485, Becker U.S. Pat. No. 3,966,476 and *Research Disclosure*, Vol. 181, May, 1979, Item 18155. Also as described by Morgan, cited above, the chemical sensitizers can be added prior to or concurrently with the additional silver halide formation. Chemical sensitization can take place during or after halide conversion as described by Hasebe et al European Patent Application EP 273,404. In many instances epitaxial deposition onto selected tabular grain sites (e.g., edges or corners) can either be used to direct chemical sensitization or to itself perform the functions normally performed by chemical sensitization.

The emulsions can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3,5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclohexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes.

Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

Spectral sensitizing dyes can also affect the emulsions in other ways. For example, spectrally sensitizing dyes can increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

Among useful spectral sensitizing dyes for sensitizing the emulsions described herein are those found in U.K. Patent 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,493,747, '748, 2,526,632, 2,739,964 (Re.24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349, the disclosures of which are here incorporated by reference.

Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898, the disclosures of which are here incorporated by reference.

Spectral sensitizing dyes can be added at any stage during the emulsion preparation. They may be added at the beginning of or during precipitation as described by Wall, *Photographic Emulsions*, American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and *Research Disclosure*, Vol. 181, May, 1979, Item 18155, and Tani et al published European Patent Application EP 301,508. They can be added prior to or during chemical sensitization as described by Kofron et al U.S. Pat. No. 4,439,520, Dickerson U.S. Pat. No. 4,520,098, Maskasky U.S. Pat. No. 4,435,501 and Philippaerts et al cited above. They can be added before or during emulsion washing as described by Asami et al published European Patent Application EP 287,100 and Metoki et al published European Patent Application EP 291,399. The dyes can be mixed in directly before coating as described by Collins et al U.S. Pat. No. 2,912,343. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Application (Kokai) 24185/71. The dyes can be selectively adsorbed to particular crystallographic faces of the emulsion grain as a means of restricting chemical sensitization centers to other faces, as described by Mifune et al published European Patent Application 302,528. The spectral sensitizing dyes may be used in conjunction with poorly adsorbed luminescent dyes, as described by Miyasaka et al published European Patent Applications 270,079, 270,082 and 278,510.

The following illustrate specific spectral sensitizing dye selections:

SS-1

Anhydro-5'-chloro-3'-di-(3-sulfopropyl)naphtho[1,2-d]thiazolothiacyanine hydroxide, sodium salt

SS-2

Anhydro-5'-chloro-3'-di-(3-sulfopropyl)naphtho[1,2-d]oxazolothiacyanine hydroxide, sodium salt

SS-3

Anhydro-4,5-benzo-3'-methyl-4'-phenyl-1-(3-sulfopropyl)naphtho[1,2-d]thiazolothiazolocyanine hydroxide

SS-4

1,1'-Diethylnaphtho[1,2-d]thiazolo-2'-cyanine bromide

SS-5

Anhydro-1,1'-dimethyl-5,5'-di-(trifluoromethyl)-3-(4-sulfobuyl)-3'-(2,2,2-trifluoroethyl)benzimidazolocarbocyanine hydroxide

SS-6

Anhydro-3,3'-(2-methoxyethyl)-5,5'-diphenyl-9-ethyloxacarbocyanine, sodium salt

SS-7

Anhydro-11-ethyl-1,1'-di-(3-sulfopropyl)naphtho[1,2-d]oxazolocarbocyanine hydroxide, sodium salt

SS-8

Anhydro-5,5'-dichloro-9-ethyl-3,3'-di-(3-sulfopropyl-)oxaselenacarbocyanine hydroxide, sodium salt

SS-9

5,6-Dichloro-3',3'-dimethyl-1,1',3-triethylbenzimidazolo-3H-indolocarbocyanine bromide

SS-10

Anhydro-5,6-dichloro-1,1-diethyl-3-(3-sulfopropylbenzimidazolooxacarbocyanine hydroxide

SS-11

Anhydro-5,5'-dichloro-9-ethyl-3,3'-di-(2-sulfoethylcarbamoylmethyl)thiacarbocyanine hydroxide, sodium salt

SS-12

Anhydro-5',6'-dimethoxy-9-ethyl-5-phenyl-3-(3-sulfobutyl)-3'-(3-sulfopropyl)oxathiacarbocyanine hydroxide, sodium salt

SS-13

Anhydro-5,5'-dichloro-9-ethyl-3-(3-phosphonopropyl)-3'-(3-sulfopropyl)thiacarbocyanine hydroxide

SS-14

Anhydro-3,3'-di-(2-carboxyethyl)-5,5'-dichloro-9-ethylthiacarbocyanine bromide

SS-15

Anhydro-5,5'-dichloro-3-(2-carboxyethyl)-3'-(3-sulfopropyl)thiacyanine sodium salt

SS-16

9-(5-Barbituric acid)-3,5-dimethyl-3'-ethyltellurathiacarbocyanine bromide

SS-17

Anhydro-5,6-methylenedioxy-9-ethyl-3-methyl-3'-(3-sulfopropyl)tellurathiacarbocyanine hydroxide

SS-18

3-Ethyl-6,6'-dimethyl-3'-pentyl-9.11-neopentylenethiadicarbocyanine bromide

SS-19

Anhydro-3-ethyl-9,11-neopentylene-3'-(3-sulfopropyl)-thiadicarbocyanine hydroxide

SS-20

Anhydro-3-ethyl-11,13-neopentylene-3'-(3-sulfopropyl-)oxathiatricarbocyanine hydroxide, sodium salt

SS-21

Anhydro-5-chloro-9-ethyl-5'-phenyl-3'-(3-sulfobutyl)-3-(3-sulfopropyl)oxacarbocyanine hydroxide, sodium salt

SS-22

Anhydro-5,5'-diphenyl-3,3'-di-(3-sulfobutyl)-9-ethyloxacarbocyanine hydroxide, sodium salt

SS-23

Anhydro-5,5'-dichloro-3,3'-di-(3-sulfopropyl)-9-ethylthiacarbocyanine hydroxide, triethylammonium salt

SS-24

Anhydro-5,5'-dimethyl-3,3'-di-(3-sulfopropyl)-9-ethylthiacarbocyanine hydroxide, sodium salt

SS-25

Anhydro-5,6-dichloro-1-ethyl-3-(3-sulfobutyl)-1'-(3-sulfopropyl)benzimidazolonaphtho[1,2-d]thiazolocarbocyanine hydroxide, triethylammonium salt

SS-26

Anhydro-11-ethyl-1,1'-di-(3-sulfopropyl)naphth[1,2-d]-oxazolocarbocyanine hydroxide, sodium salt

SS-27

Anhydro-3,9-diethyl-3'-methylsulfonylcarbamoylmethyl-5-phenyloxathiacarbocyanine p-toluenesulfonate

SS-28

Anhydro-6,6'-dichloro-1,1'-diethyl-3,3'-di-(3-sulfopropyl)-5,5'-bis(trifluoromethyl)benzimidazolocarbocyanine hydroxide, sodium salt

SS-29

Anhydro-5'-chloro-5-phenyl -3,3'-di-(3-sulfopropyl)oxathiacyanine hydroxide, sodium salt

SS-30

Anhydro-5,5'-dichloro-3,3'-di-(3-sulfopropyl)thiacyanine hydroxide, sodium salt

SS-31

3-Ethyl-5-[1,4-dihydro-1-(4-sulfobutyl)pyridin-4-ylidene]rhodanine, triethylammonium salt

SS-32

1-Carboxyethyl-5-[2-(3-ethylbenzoxazolin-2-ylidene)ethylidene]-3-phenyl thiohydantoin

SS-33

4-[2-((1,4-Dihydro-1-dodecylpyridin-ylidene)ethylidene]-3-phenyl-2-isoxazolin-5-one

SS-34

5-(3-Ethylbenzoxazolin-2-ylidene)-3-phenylrhodanine

SS-35

1,3-Diethyl-5-{[1-ethyl-3-(3-sulfopropyl)benzimidazolin-2-ylidene]ethylidene} -2-thiobarbituric acid

SS-36

5-[2-(3-Ethylbenzoxazolin-2-ylidene)ethylidene]-1-methyl-2-dimethylamino-4-oxo -3-phenylimidazolinium p-toluenesulfonate

SS-37

5-[2-(5-Carboxy-3-methylbenzoxazolin-2-ylidene)ethylidene]-3-cyano -4-phenyl-1-(4-methylsulfonamido -3-pyrrolin -5-one

SS-38

2-[4-(Hexylsulfonamido)benzoylcyanomethine]-2-{2-{3-(2-methoxyethyl)-5-[(2-methoxyethyl) sulfonamido]-benzoxazolin-2-ylidene} ethylidene}acetonitrile

SS-39

3-Methyl-4-[2-(3-ethyl-5,6-dimethylbenzotellurazolin-2-ylidene)ethylidene]-1-phenyl-2-pyrazolin -5-one

SS-40

3-Heptyl-1-phenyl-5-{4-[3-(3-sulfobutyl)-naphtho[1,2-d]thiazolin]-2-butenylidene}-2-thiohydantoin

SS-41

1,4-Phenylene-bis(2-aminovinyl-3-methyl-2-thiazolinium]dichloride

SS-42

Anhydro-4-{2-[3-(3-sulfopropyl)thiazolin-2-ylidene]ethylidene}-2-{3-[3-(3-sulfopropyl)thiazolin-2-ylidene]-propenyl-5-oxazolium, hydroxide, sodium salt

SS-43

3-Carboxymethyl-5-{3-carboxymethyl-4-oxo-5-methyl-1,3,4-thiadiazolin-2-ylidene)ethylidene]thiazolin-2-ylidene)rhodanine, dipotassium salt

SS-44

1,3-Diethyl-5-[1-methyl-2-(3,5-dimethylbenzotellurazolin-2-ylidene)ethylidene]-2-thiobarbituric acid

SS-45

3-Methyl-4-[2-(3-ethyl-5,6-dimethylbenzotellurazolin-2-ylidene)-1-methylethylidene]-1-phenyl-2-pyrazolin-5-one

SS-46

1,3-Diethyl-5-[1-ethyl-2-(3-ethyl-5,6-dimethoxybenzotellurazolin-2-ylidene)ethylidene]-2-thiobarbituric acid

SS-47

3-Ethyl-5-{[(ethylbenzothiazolin-2-ylidene)-methyl][(1,5-dimethylnaphtho[1,2-d]selenazolin-2-ylidene)methyl]methylene)rhodanine

SS-48

5-{Bis[(3-ethyl-5,6-dimethylbenzothiazolin-2-ylidene)-methyl]methylene}-1,3-diethyl-barbituric acid

SS-49

3-Ethyl-5- {[(3-ethyl-5-methylbenzotellurazolin-2-ylidene)methyl][1-ethylnaphtho[1,2-d]-tellurazolin-2-ylidene)methyl]methylene}rhodanine

SS-50

Anhydro-5,5'-diphenyl-3,3'-di-(3-sulfopropyl)thiacyanine hydroxide, triethylammonium salt

SS-51

Anhydro-5-chloro-5'-phenyl-3,3'-di-(3-sulfopropyl)thia-cyanine hydroxide, triethylammonium salt Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Most of the antifoggants effective in the emulsions used in this invention can also be used in developers and can be classified under a few general headings, as illustrated by C. E. K. Mees, *The Theory of the Photographic Process,* 2nd Ed., Macmillan, 1954, pp. 677–680.

To avoid such instability in emulsion coatings, stabilizers and antifoggants can be employed, such as halide ions (e.g., bromide salts); chloropalladates and chloropalladites as illustrated by Trivelli et al U.S. Pat. No. 2,566,263; water-soluble inorganic salts of magnesium, calcium, cadmium, cobalt, manganese and zinc as illustrated by Jones U.S. Pat. No. 2,839,405 and Sidebotham U.S. Pat. No. 3,488,709; mercury salts as illustrated by Allen et al U.S. Pat. No. 2,728,663; selenols and diselenides as illustrated by Brown et al U.K. Patent 1,336,570 and Pollet et al U.K. Patent 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes as illustrated by Thiers et al U.S. Pat. No. 3,630,744; isothiourea derivatives as illustrated by Herz et al U.S. Pat. No. 3,220,839 and Knott et al U.S. Pat. No. 2,514,650; thiazolidines as illustrated by Scavron U.S. Pat. No. 3,565,625; peptide derivatives as illustrated by Maffet U.S. Pat. No. 3,274,002; pyrimidines and 3-pyrazolidones as illustrated by Welsh U.S. Pat. No. 3,161,515 and Hood et al U.S. Pat. No. 2,751,297; azotriazoles and azotetrazoles as illustrated by Baldassarri et al U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, *Research Disclosure*, Vol. 134, June, 1975, Item 13452, and Vol. 148, August, 1976, Item 14851, and Nepker et al U.K. Patent 1,338,567; mercaptotetrazoles, -triazoles and -diazoles as illustrated by Kendall et al U.S. Pat. No. 2,403,927, Kennard et al U.S. Pat. No. 3,266,897, *Research Disclosure*, Vol. 116, December, 1973, Item 11684, Luckey et al U.S. Pat. No. 3,397,987 and Salesin U.S. Pat. No. 3,708,303; azoles as illustrated by Peterson et al U.S. Pat. No. 2,271,229 and *Research Disclosure*, Item 11684, cited above; purines as illustrated by Sheppard et al U.S. Pat. No. 2,319,090, Birr et al U.S. Pat. No. 2,152,460, *Research Disclosure*, Item 13452, cited above, and Dostes et al French Patent 2,296,204, polymers of 1,3-dihydroxy-(and/or 1,3-carbamoxy)-2-methylenepropane as illustrated by Saleck et al U.S. Pat. No. 3,926,635 and tellurazoles, tellurazolines, tellurazolinium salts and tellurazolium salts as illustrated by Gunther et al U.S. Pat. No. 4,661,438, aromatic oxatellurazinium salts as illustrated by Gunther, U.S. Pat. No. 4,581,330 and Przyklek-Elling et al U.S. Pat. Nos. 4,661,438 and 4,677,202. High-chloride emulsions can be stabilized by the presence, especially during chemical sensitization, of elemental sulfur as described by Miyoshi et al European published Patent Application EP 294,149 and Tanaka et al European published Patent Application EP 297,804 and thiosulfonates as described by Nishikawa et al European published Patent Application EP 293,917.

Among useful stabilizers for gold sensitized emulsions are water-insoluble gold compounds of benzothiazole, benzoxazole, naphthothiazole and certain merocyanine and cyanine dyes, as illustrated by Yutzy et al U.S. Pat. No. 2,597,915, and sulfinamides, as illustrated by Nishio et al U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al U.S. Pat. No. 2,716,062, U.K. Patent 1,466,024 and Habu et al U.S. Pat. No. 3,929,486; quaternary ammonium salts of the type illustrated by Piper U.S. Pat. No. 2,886,437; water-insoluble hydroxides as illustrated by Maffet U.S. Pat. No. 2,953,455; phenols as illustrated by Smith U.S. Pat. Nos. 2,955,037 and '038; ethylene diurea as illustrated by Dersch U.S. Pat. No. 3,582,346; barbituric acid derivatives as illustrated by Wood U.S. Pat. No. 3,617,290; boranes as illustrated by Bigelow U.S. Pat. No. 3,725,078; 3-pyrazolidinones as illustrated by Wood U.K. Patent 1,158,059 and aldoximines, amides, anilides and esters as illustrated by Butler et al U.K. Patent 988,052.

The emulsions can be protected from fog and desensitization caused by trace amounts of metals such as copper, lead, tin, iron and the like by incorporating addenda such as sulfocatechol-type compounds, as illustrated by Kennard et al U.S. Pat. No. 3,236,652; aldoximines as illustrated by Carroll et al U.K. Patent 623,448 and meta- and polyphosphates as illustrated by Draisbach U.S. Pat. No. 2,239,284, and carboxylic acids such as ethylenediamine tetraacetic acid as illustrated by U.K. Patent 691,715.

Among stabilizers useful in layers containing synthetic polymers of the type employed as vehicles and to improve covering power are monohydric and polyhydric phenols as illustrated by Forsgard U.S. Pat. No. 3,043,697; saccharides as illustrated by U.K. Patent 897,497 and Stevens et al U.K. Patent 1,039,471, and quinoline derivatives as illustrated by Dersch et al U.S. Pat. No. 3,446,618.

Among stabilizers useful in protecting the emulsion layers against dichroic fog are addenda such as salts of nitron as illustrated by Barbier et al U.S. Pat. Nos. 3,679,424 and 3,820,998; mercaptocarboxylic acids as illustrated by Willems et al U.S. Pat. No. 3,600,178; and addenda listed by E. J. Birr, *Stabilization of Photographic Silver Halide Emulsions*, Focal Press, London, 1974, pp. 126–218.

Among stabilizers useful in protecting emulsion layers against development fog are addenda such as azabenzimidazoles as illustrated by Bloom et al U.K. Patent 1,356,142 and U.S. Pat. No. 3,575,699, Rogers U.S. Pat. No. 3,473,924 and Carlson et al U.S. Pat. No. 3,649,267; substituted benzimidazoles, benzothiazoles, benzotriazoles and the like as illustrated by Brooker et al U.S. Pat. No. 2,131,038, Land U.S. Pat. No. 2,704,721, Rogers et al U.S. Pat. No. 3,265,498; mercapto-substituted compounds, e.g., mercaptotetrazoles, as illustrated by Dimsdale et al U.S. Pat. No. 2,432,864, Rauch et al U.S. Pat. No. 3,081,170, Weyerts et al U.S. Pat. No. 3,260,597, Grasshoff et al U.S. Pat. No. 3,674,478 and Arond U.S. Pat. No.3,706,557; isothiourea derivatives as illustrated by Herz et al U.S. Pat. No. 3,220,839, and thiodiazole derivatives as illustrated by von Konig U.S. Pat. No. 3,364,028 and von Konig et al U.K. Patent 1,186,441.

Where hardeners of the aldehyde type are employed, the emulsion layers can be protected with antifoggants such as monohydric and polyhydric phenols of the type illustrated by Sheppard et al U.S. Pat. No. 2,165,421; nitro-substituted compounds of the type disclosed by Rees et al U.K. Patent 1,269,268; poly(alkylene oxides) as illustrated by Valbusa U.K. Patent 1,151,914, and mucohalogenic acids in combination with urazoles as illustrated by Allen et al U.S. Pat. Nos. 3,232,761 and 3,232,764, or further in combination with maleic acid hydrazide as illustrated by Rees et al U.S. Pat. No. 3,295,980.

To protect emulsion layers coated on linear polyester supports, addenda can be employed such as parabanic acid, hydantoin acid hydrazides and urazoles as illustrated by Anderson et al U.S. Pat. No. 3,287,135, and piazines containing two symmetrically fused 6-member carbocyclic rings, especially in combination with an aldehyde-type hardening agent, as illustrated in Rees et al U.S. Pat. No. 3,396,023.

Kink desensitization of the emulsions can be reduced by the incorporation of thallous nitrate as illustrated by Overman U.S. Pat. No. 2,628,167; compounds, polymeric latices and dispersions of the type disclosed by Jones et al U.S. Pat. Nos. 2,759,821 and '822; azole and mercaptotetrazole hydrophilic colloid dispersions of the type disclosed by *Research Disclosure*, Vol. 116, December, 1973, Item 11684; plasticized gelatin compositions of the type disclosed by Milton et al U.S. Pat. No. 3,033,680; water-soluble interpolymers of the type disclosed by Rees et al U.S. Pat. No. 3,536,491; polymeric latices prepared by emulsion polymerization in the presence of poly(alkylene oxide) as disclosed by Pearson et al U.S. Pat. No. 3,772,032, and gelatin graft copolymers of the type disclosed by Rakoczy U.S. Pat. No. 3,837,861.

Where the color photographic element of this invention is to be processed at elevated bath or drying temperatures pressure desensitization and/or increased fog can be controlled by selected combinations of addenda, vehicles, hardeners and/or processing conditions as illustrated by Abbott et al U.S. Pat. No. 3,295,976, Barnes et al U.S. Pat. No. 3,545,971, Salesin U.S. Pat. No. 3,708,303, Yamamoto et al U.S. Pat. No. 3,615,619, Brown et al U.S. Pat. No. 3,623,873, Taber U.S. Pat. No. 3,671,258, Abele U.S. Pat. No. 3,791,830, *Research Disclosure*, Vol. 99, July, 1972, Item 9930, Florens et al U.S. Pat. No. 3,843,364, Priem et al U.S. Pat. No. 3,867,152, Adachi et al U.S. Pat. No. 3,967,965 and Mikawa et al U.S. Pat. Nos. 3,947,274 and 3,954,474.

In addition to increasing the pH or decreasing the pAg of an emulsion and adding gelatin, which are known to retard latent-image fading, latent-image stabilizers can be incorporated, such as amino acids, as illustrated by Ezekiel U.K. Patents 1,335,923, 1,378,354, 1,387,654 and 1,391,672, Ezekiel et al U.K. Patent 1,394,371, Jefferson U.S. Pat. No. 3,843,372, Jefferson et al U.K. Patent 1,412,294 and Thurston U.K. Patent 1,343,904; carbonyl-bisulfite addition products in combination with hydroxybenzene or aromatic amine developing agents as illustrated by Seiter et al U.S. Pat. No. 3,424,583; cycloalkyl-1,3-diones as illustrated by Beckett et al U.S. Pat. No. 3,447,926; enzymes of the catalase type as illustrated by Matejec et al U.S. Pat. No. 3,600,182; halogen-substituted hardeners in combination with certain cyanine dyes as illustrated by Kumai et al U.S. Pat. No. 3,881,933; hydrazides as illustrated by Honig et al U.S. Pat. No. 3,386,831; alkenyl benzothiazolium salts as illustrated by Arai et al U.S. Pat. No. 3,954,478; hydroxy-substituted benzylidene derivatives as illustrated by Thurston U.K. Patent 1,308,777 and Ezekiel et al U.K. Patents 1,347,544 and 1,353,527; mercapto-substituted compounds of the type disclosed by Sutherns U.S. Pat. No. 3,519,427; metal-organic complexes of the type disclosed by Matejec et al U.S. Pat. No. 3,639,128; penicillin derivatives as illustrated by Ezekiel U.K. Patent 1,389,089; propynylthio derivatives of benzimidazoles, pyrimidines, etc., as illustrated by yon Konig et al U.S. Pat. No. 3,910,791; combinations of iridium and rhodium compounds as disclosed by Yamasue et al U.S. Pat. No. 3,901,713; sydnones or sydnone imines as illustrated by Noda et al U.S. Pat. No. 3,881,939; thiazolidine derivatives as illustrated by Ezekiel U.K. Patent 1,458,197 and thioether-substituted imidazoles as illustrated by *Research Disclosure*, Vol. 136, August, 1975, Item 13651.

Apart from the features that have been specifically discussed previously for the tabular grain emulsion preparation procedures and the tabular grains that they produce, their further use in the color photographic elements of this invention can take any convenient conventional form. Substitution in color photographic elements for conventional emulsions of the same or similar silver halide composition is generally contemplated, with substitution for silver halide emulsions of differing halide composition, particularly other tabular grain emulsions, being also feasible. The low levels of native blue sensitivity of the high chloride {100} tabular grain emulsions allows the emulsions to be employed in any desired layer order arrangement in multicolor photographic elements, including any of the layer order arrangements disclosed by Kofron et al U.S. Pat. No. 4,439,520, the disclosure of which is here incorporated by reference, both for layer order arrangements and for other conventional features of photographic elements containing tabular grain emulsions. Conventional features are further illustrated by the following incorporated by reference disclosures:

| | |
|---|---|
| ICBR-1 | Research Disclosure, Vol. 308, December 1989, Item 308,119; |
| ICBR-2 | Research Disclosure, Vol. 225, January 1983, Item 22,534; |
| ICBR-3 | Wey et al U.S. Pat. No. 4,414,306, issued Nov. 8, 1983; |
| ICBR-4 | Solberg et al U.S. Pat. No. 4,433,048, issued Feb. 21, 1984; |
| ICBR-5 | Wilgus et al U.S. Pat. No. 4,434,226, issued Feb. 28, 1984; |
| ICBR-6 | Maskasky U.S. Pat. No. 4,435,501, issued Mar. 6, 1984; |
| ICBR-7 | Maskasky U.S. Pat. No. 4,643,966, issued Feb. 17, 1987; |
| ICBR-8 | Daubendiek et al U.S. Pat. No. 4,672,027, issued Jan. 9, 1987; |
| ICBR-9 | Daubendiek et al U.S. Pat. No. 4,693,964, issued Sept. 15, 1987; |
| ICBR-10 | Maskasky U.S. Pat. No. 4,713,320, issued Dec. 15, 1987; |
| ICBR-11 | Saitou et al U.S. Pat. No. 4,797,354, issued Jan. 10, 1989; |
| ICBR-12 | Ikeda et al U.S. Pat. No. 4,806,461, issued Feb. 21, 1989; |
| ICBR-13 | Makino et al U.S. Pat. No. 4,853,322, issued Aug. 1, 1989; and |
| ICBR-14 | Daubendiek et al U.S. Pat. No. 4,914,014, issued Apr. 3, 1990. |

Following is a description of the terms "dye image-forming compound" and "photographically useful group-releasing compound", sometimes referred to simply as "PUG-releasing compound", as used herein.

A dye image-forming compound is typically a coupler compound, a dye redox releaser compound, a dye developer compound, an oxichromic developer compound, or a bleachable dye or dye precursor compound. Dye redox releaser, dye developer, and oxichromic developer compounds useful in color photographic elements that can be employed in image transfer processes are described in *The Theory of the Photographic Process,* 4th edition, T. H. James, editor, Macmillan, N.Y., 1977, Chapter 12, Section V, and in Section XXIII of *Research Disclosure*, December 1989, Item 308119, published by Kenneth Mason Publications, Ltd., Dudley Annex, 12a North Street, Emsworth, Hampshire, PO1O 7DQ, United Kingdom. Dye compounds useful in color photographic elements employed in dye bleach processes are described in Chapter 12, Section IV, of *The Theory of the Photographic Process,* 4th edition.

Preferred dye image-forming compounds are coupler compounds, which react with oxidized color developing agents to form colored products, or dyes. A coupler compound contains a coupler moiety COUP, which is combined with the oxidized developer species in the coupling reaction to form the dye structure. A coupler compound can additionally contain a group, called a coupling-off group, that is attached to the coupler moiety by a bond that is cleaved upon reaction of the coupler compound with oxidized color developing agent.

Coupling-off groups can be halogen, such as chloro, bromo, fluoro, and iodo, or organic radicals that are attached to the coupler moieties by atoms such as oxygen, sulfur, nitrogen, phosphorus, and the like.

A PUG-releasing compound is a compound that contains a photographically useful group and is capable of reacting with an oxidized developing agent to release said group. Such a PUG-releasing compound comprises a carrier moiety and a leaving group, which are linked by a bond that is cleaved upon reaction with oxidized developing agent. The leaving group contains the PUG, which can be present either as a preformed species, or as a blocked or precursor species that undergoes further reaction after cleavage of the leaving group from the carrier to produce the PUG. The reaction of an oxidized developing agent with a PUG-releasing compound can produce either colored or colorless products.

Carrier moieties (CAR) include hydroquinones, catechols, aminophenols, sulfonamidophenols, sulfonamidonaphthols, hydrazides, and the like that undergo cross-oxidation by oxidized developing agents. A preferred carrier moiety in a PUG-releasing compound is a coupler moiety COUP, which can combine with an oxidized color developer in the cleavage reaction to form a colored species, or dye. When the carrier moiety is a COUP, the leaving group is referred to as a coupling-off group. As described previously for leaving groups in general, the coupling-off group contains the PUG, either as a preformed species or as a blocked or precursor species. The coupler moiety can be ballasted or unballasted. It can be monomeric, or it can be part of a dimeric, oligomeric or polymeric coupler, in which case more than one group containing PUG can be contained in the coupler, or it can form part of a bis compound in which the PUG forms part of a link between two coupler moieties.

The PUG can be any group that is typically made available in a photographic element in an imagewise fashion. The PUG can be a photographic reagent or a photographic dye. A photographic reagent, which upon release further reacts with components in the photographic element as described herein, is a moiety such as a development inhibitor, a development accelerator, a bleach inhibitor, a bleach accelerator, an electron transfer agent, a coupler (for example, a competing coupler, a dye-forming coupler, or a development inhibitor releasing coupler, a dye precursor, a dye, a developing agent (for example, a competing developing agent, a dye-forming developing agent, or a silver halide developing agent), a silver complexing agent, a fixing agent, an image toner, a stabilizer, a hardener, a tanning agent, a fogging agent, an ultraviolet radiation absorber, an antifoggant, a nucleator, a chemical or spectral sensitizer, or a desensitizer.

The PUG can be present in the coupling-off group as a preformed species or it can be present in a blocked form or as a precursor. The PUG can be, for example, a preformed development inhibitor, or the development inhibiting function can be blocked by being the point of attachment to the carbonyl group bonded to PUG in the coupling-off group. Other examples are a preformed dye, a dye that is blocked to shift its absorption, and a leuco dye.

A PUG-releasing compound can be described by the formula CAR-$(TIME)_n$-PUG, wherein (TIME) is a linking or timing group, n is 0, 1, or 2, and CAR is a carrier moiety from which is released imagewise a PUG (when n is 0) or a PUG precursor $(TIME)_1$-PUG or $(TIME)_2$-PUG (when n is 1 or 2) upon reacting with oxidized developing agent. Subsequent reaction of $(TIME)_1$-PUG or $(TIME)_2$-PUG produces PUG.

Linking groups (TIME), when present, are groups such as esters, carbamates, and the like that undergo base-catalyzed cleavage, including intramolecular nucleophilic displacement, thereby releasing PUG. Where n is 2, the (TIME) groups can be the same or different. Suitable linking groups, which are also known as timing groups, are shown in U.S. Pat. Nos. 5,151,343; 5,051,345; 5,006,448; 4,409,323; 4,248,962; 4,847,185; 4,857,440; 4,857,447; 4,861,701; 5,021,322; 5,026,628, and 5,021,555, all incorporated herein by reference. Especially useful linking groups are p-hydroxphenylmethylene moieties, as illustrated in the previously mentioned U.S. Pat. Nos. 4,409,323; 5,151,343 and 5,006,448, and o-hydroxyphenyl substituted carbamate groups, disclosed in U.S. Pat. Nos. 5,151,343 and 5,021,555, which undergo intramolecular cyclization in releasing PUG.

When TIME is joined to a COUP, it can be bonded at any of the positions from which groups are released from couplers by reaction with oxidized color developing agent. Preferably, TIME is attached at the coupling position of the coupler moiety so that, upon reaction of the coupler with oxidized color developing agent, TIME, with attached groups, will be released from COUP.

TIME can also be in a non-coupling position of the coupler moiety from which it can be displaced as a result of reaction of the coupler with oxidized color developing agent. In the case where TIME is in a non-coupling position of COUP, other groups can be in the coupling position, including conventional coupling off groups. Also, the same or different inhibitor moieties from those described in this invention can be used. Alternatively, COUP can have TIME and PUG in each of a coupling position and a non-coupling position.

Accordingly, compounds useful in this invention can release more than one mole of PUG per mole of coupler.

TIME can be any organic group which will serve to connect CAR to the PUG moiety and which, after cleavage from CAR, will in turn be cleaved from the PUG moiety. This cleavage is preferably by an intramolecular nucleophilic displacement reaction of the type described in, for example, U.S. Pat. No. 4,248,962, or by electron transfer along a conjugated chain as described in, for example, U.S. Pat. No. 4,409,323.

As used herein, the term "intramolecular nucleophilic displacement reaction" refers to a reaction in which a nucleophilic center of a compound reacts directly, or indirectly through an intervening molecule, at another site on the compound, which is an electrophilic center, to effect displacement of a group or atom attached to the electrophilic center. Such compounds have both a nucleophilic group and an electrophilic group spatially related by the configuration of the molecule to promote reactive proximity. Preferably, the nucleophilic group and the electrophilic group are located in the compound so that a cyclic organic ring, or a transient cyclic organic ring, can be easily formed by an intramolecular reaction involving the nucleophilic center and the electrophilic center.

Useful timing groups are represented by the structure:

$$\text{Nu—LINK—E}$$

wherein:

Nu is a nucleophilic group attached to a position on CAR from which it will be displaced upon reaction of CAR with oxidized developing agent;

E is an electrophilic group attached to an inhibitor moiety as described and is displaceable therefrom by Nu after Nu is displaced from CAR; and LINK is a linking group for spatially relating Nu and E, upon displacement of Nu from CAR, to undergo an intramolecular nucleophilic displacement reaction with the formation of a 3- to 7-membered ring and thereby release the PUG moiety.

A nucleophilic group (Nu) is defined herein as a group of atoms one of which is electron rich. Such an atom is referred to as a nucleophilic center. An electrophilic group (E) is defined herein as a group of atoms, one of which is electron deficient. Such an atom is referred to as an electrophilic center.

Thus, in PUG-releasing compounds as described herein, the timing group can contain a nucleophilic group and an electrophilic group, which groups are spatially related with respect to one another by a linking group so that, upon release from CAR, the nucleophilic center and the electrophilic center will react to effect displacement of the PUG moiety from the timing group. The nucleophilic center should be prevented from reacting with the electrophilic center until release from the CAR moiety, and the electrophilic center should be resistant to external attack, such as hydrolysis. Premature reaction can be prevented by attaching the CAR moiety to the timing group at the nucleophilic center or an atom in conjunction with a nucleophilic center, so that cleavage of the timing group and the PUG moiety from CAR unblocks the nucleophilic center and permits it to react with the electrophilic center, or by positioning the nucleophilic group and the electrophilic group so that they are prevented from coming into reactive proximity until release. The timing group can contain additional substituents, such as additional photographically useful groups (PUGs), or precursors thereof, which may remain attached-to the timing group or be released.

It will be appreciated that, in the timing group, for an intramolecular reaction to occur between the nucleophilic group and the electrophilic group, the groups should be spatially related after cleavage from CAR so that they can react with one another. Preferably, the nucleophilic group and the electrophilic group are spatially related within the timing group so that the intramolecular nucleophilic displacement reaction involves the formation of a 3- to 7-membered ring, most preferably a 5- or 6-membered ring.

It will be further appreciated that for an intramolecular reaction to occur in the aqueous alkaline environment encountered during photographic processing, the thermodynamics should be such and the groups be so selected that an overall free energy decrease results upon ring closure, forming the bond between the nucleophilic group and the electrophilic group, and breaking the bond between the electrophilic group and the PUG. Not all possible combinations of nucleophilic group, linking group, and electrophilic group will yield a thermodynamic relationship favorable to breaking of the bond between the electrophilic group and the PUG moiety. However, it is within the skill of the art to select appropriate combinations taking the above energy relationships into account.

Representative Nu groups contain electron rich oxygen, sulfur and nitrogen atoms. Representative E groups contain electron deficient carbonyl, thiocarbonyl, phosphonyl and thiophosphonyl moieties. Other useful Nu and E groups will be apparent to those skilled in the art.

The linking group can be an acyclic group such as alkylene, for example, methylene, ethylene or propylene, or a cyclic group such as an aromatic group, such as phenylene or naphthylene, or a heterocyclic group, such as furan, thophene, pyridine, quinoline or benzoxazine. Preferably, LINK is alkylene or arylene. The groups Nu and E are attached to LINK to provide, upon release of Nu from CAR, a favorable spatial relationship for nucleophilic attack of the nucleophilic center in Nu on the electrophilic center in E. When LINK is a cyclic group, Nu and E can be attached to the same or adjacent rings. Aromatic groups in which Nu and E are attached to adjacent ring positions are particularly preferred LINK groups.

TIME can be unsubstituted or substituted. The substituents can be those which will modify the rate of reaction, diffusion, or displacement, such as halogen, including fluoro, chloro, bromo, or iodo, nitro, alkyl of 1 to 20 carbon atoms, acyl, such as carboxy, carboxyalkyl, alkoxycarbonyl, alkoxycarbonamido, sulfoalkyl, alkanesulfonamido, and alkylsulfonyl, solubilizing groups, ballast groups and the like, or they can be substituents which are separately useful in the photographic element, such as a stabilizer, an antifoggant, a dye (such as a filter dye or a solubilized masking dye) and the like. For example, solubilizing groups will increase the rate of diffusion; ballast groups will decrease the rate of diffusion; electron withdrawing groups will decrease the rate of displacement of the PUG.

As used herein, the term "electron transfer down a conjugated chain" is understood to refer to transfer of an electron along a chain of atoms in which alternate single bonds and double bonds occur. A conjugated chain is understood to have the same meaning as commonly used in organic chemistry. This further includes TIME groups capable of undergoing fragmentation reactions where the number of double bonds is zero. Electron transfer down a conjugated chain is described in, for example, U.S. Pat. No. 4,409,323.

As previously described, more than one sequential TIME moiety can be usefully employed. Useful TIME moieties can have a finite half-life or an extremely short half-life. The half-life is controlled by the specific structure of the TIME moiety, and may be chosen so as to best optimize the photographic function intended. TIME moiety half-lives of from less than 0.001 second to over 10 minutes are known in the art. TIME moieties having a half-life of over 0.1 second are often preferred for use in PUG-releasing compounds that yield development inhibitor moieties, although use of TIME moieties with shorter half-lives to produce development inhibitor moieties is known in the art. The TIME moiety may either spontaneously liberate a PUG after being released from CAR, or may liberate PUG only after a further reaction with another species present in a process solution, or may liberate PUG during contact of the photographic element with a process solution.

Following is a listing of patents and publications that describe representative coupler compounds that contain COUP groups useful in the invention:

Couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999, "Farbkuppler-eine Literaturubersicht," published in Agfa Mitteilungen, Band III, pp. 156–175 (1961), and Section VII D of *Research Disclosure*, Item 308119, December 1989. Preferably such couplers are phenols and naphthols.

Couplers which form magenta dyes upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573, "Farbkuppler-eine Literaturubersicht," published in Agfa Mitteilungen, Band III, pp. 126–156 (1961), and Section VII D of *Research Disclosure*, Item 308119, December 1989. Preferably such couplers are pyrazolones or pyrazolotriazoles.

Couplers which form yellow dyes upon reaction with oxidized and color developing agent are described in such representative patents and publications as: U.S. Pat. Nos. 2,875,057; 2,407,210; 3,265,506; 2,298,443; 3,048,194; 3,447,928, "Farbkuppler-eine Literaturubersicht," published in Agfa Mitteilungen, Band III, pp. 112–126 (1961), and Section VII D of *Research Disclosure*, Item 308119, December 1989. Preferably such couplers are acylacetamides, such as benzoylacetamides and pivaloylacetamides.

Couplers which form colorless products upon reaction with oxidized color developing agent are described in such representative patents as: U.K. Patent No. 861,138; U.S. Pat. Nos. 3,632,345; 3,928,041; 3,958,993 and 3,961,959. Preferably, such couplers are cyclic carbonyl-containing compounds which react with oxidized color developing agents but do not form dyes.

PUG groups that are useful in the present invention include, for example:

1. PUG's which form development inhibitors upon release

PUG's which form development inhibitors upon release are described in such representative patents as U.S. Pat. Nos. 3,227,554; 3,384,657; 3,615,506; 3,617,291; 3,733.201 and U.K. Pat. No. 1,450,479. Useful development inhibitors are iodide and heterocyclic compounds such as mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, oxadiazoles, benzotriazoles, benzodiazoles, oxazoles, thiazoles, diazoles, triazoles, thiadiazoles, oxathiazoles, thiatriazoles, tetrazoles, benzimidazoles, indazoles, isoindazoles, mercaptooxazoles, mercaptothiadiazoles, mercaptothiazoles, mercaptotriazoles, mercaptooxadiazoles, mercaptodiazoles, mercaptooxathiazoles, tellurotetrazoles, or benzisodiazoles. Structures of typical development inhibitor moieties are:

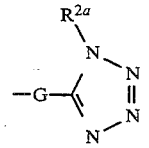

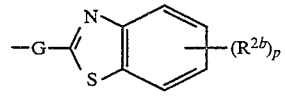

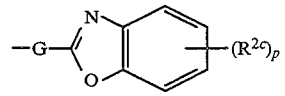

-continued

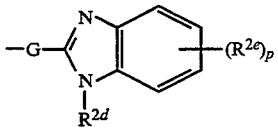

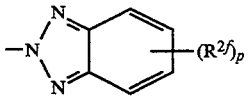

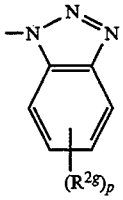

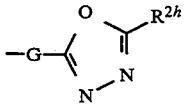

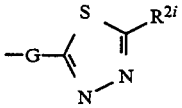

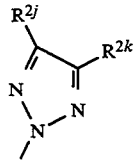

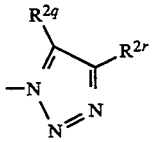

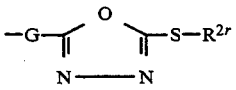

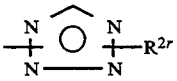

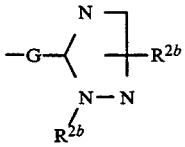

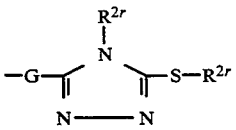

-continued

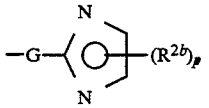

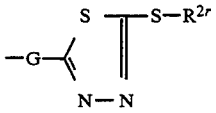

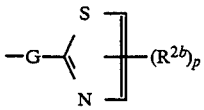

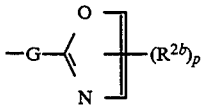

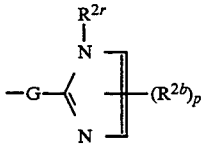

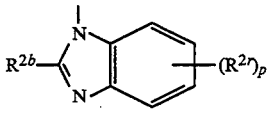

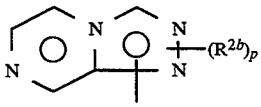

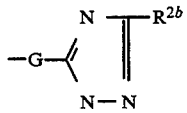

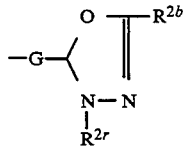

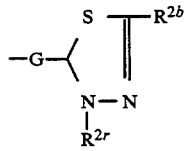

wherein:

G is S, Se, or Te, S being preferred; and wherein $R^{2a}$, $R^{2d}$, $R^{2h}$, $R^{2i}$, $R^{2j}$, $R^{2k}$, $R^{2q}$ and $R^{2r}$ are individually hydrogen, substituted or unsubstituted alkyl, straight chained or branched, saturated or unsaturated, of 1 to 8 carbon atoms such as methyl, ethyl, propyl, butyl, 1-ethylpentyl, 2-ethoxyethyl, t-butyl or i-propyl; alkoxy or alkylthio, such as methoxy, ethoxy, propoxy, butoxy, octyloxy, methylthio, ethylthio, propylthio, butylthio, or octylthiol; alkyl esters such as $CO_2CH_3$, $CO_2C_2H_5$, $CO_2C_3H_7$, $CO_2C_4H_9$, $CH_2CO_2CH_3$, $CH_2CO_2C_2H_5$, $CH_2CO_2C_3H_7$, $CH_2CO_2C_4H_9$, $CH_2CH_2CO_2CH_3$, $CH_2CH_2CO_2C_2H_5$, $CH_2CH_2CO_2C_3H_7$, and $CH_2CH_2CO_2C_4H_9$; aryl or heterocyclic esters such as $CO_2R^{2s}$, $CH_2CO_2R^{2s}$, and $CH_2CH_2CO_2R^{2s}$ wherein $R^{2s}$ is substituted or unsubstituted aryl, or a substituted or unsubstituted heterocyclic group; substituted or unsubstituted benzyl, such as methoxy-, chloro-, nitro-, hydroxy-, carboalkoxy-, carboaryloxy-, keto-, sulfonyl-, sulfenyl-, sulfinyl-, carbonamido-, sulfonamido-, carbamoyl-, or sulfamoyl-substituted benzyl; substituted or unsubstituted aryl, such as phenyl, naphthyl, or chloro-, methoxy-, hydroxy-, nitro-, hydroxy-, carboalkoxy-, carboaryloxy-, keto-, sulfonyl-, sulfenyl-, sulfinyl-, carbonamido-, sulfonamido-, carbamoyl-, or sulfamoyl-substituted phenyl. These substituents may be repeated more than once as substituents. $R^{2a}$, $R^{2d}$, $R^{2h}$, $R^{2i}$, $R^{2j}$, $R^{2k}$, $R^{2q}$ and $R^{2r}$ may also be a substituted or unsubstituted heterocyclic group selected from groups such as pyridine, pyrrole, furan, thiophene, pyrazole, thiazole, imidazole, 1,2,4-triazole, oxazole, thiadiazole, indole, benzthiophene, benzimidazole, benzoxazole and the like wherein the substitutents are as selected from those mentioned previously. $R^{2b}$, $R^{2c}$, $R^{2e}$, $R^{2f}$, and $R^{2g}$, are as described for $R^{2a}$, $R^{2d}$, $R^{2h}$, $R^{2i}$, $R^{2j}$, $R^{2k}$, $R^{2q}$ and $R^{2r}$; or, are individually one or more halogens such as chloro, fluoro or bromo and p is 0, 1, 2, 3 or 4.

2. PUGs which are dyes, or form dyes upon release

Suitable dyes and dye precursors include azo, azomethine, azophenol, azonaphthol, azoaniline, azopyrazolone, indoaniline, indophenol, anthraquinone, triarylmethane, alizarin, nitro, quinoline, indigoid and phthalocyanine dyes or precursors of such dyes such as leuco dyes, tetrazolium salts or shifted dyes. These dyes can be metal complexed or metal complexable. Representative patents describing such dyes are U.S. Pat. Nos. 3,880,658; 3,931,144; 3,932,380; 3,932,381; 3,942,987, and 4,840,884. Preferred dyes and dye precursors are azo, azomethine, azophenol, azonaphthol, azoaniline, and indoaniline dyes and dye precursors. Structures of typical dyes and dye precursors are:

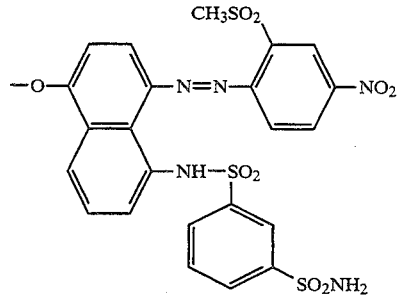

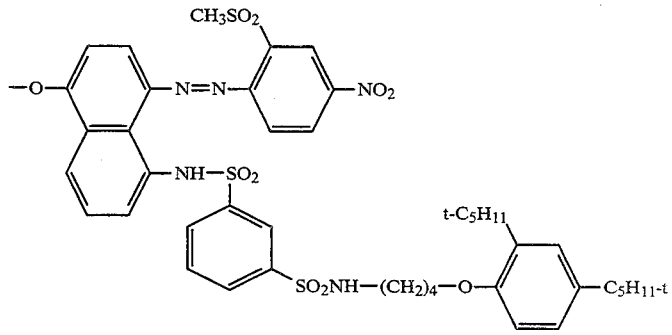

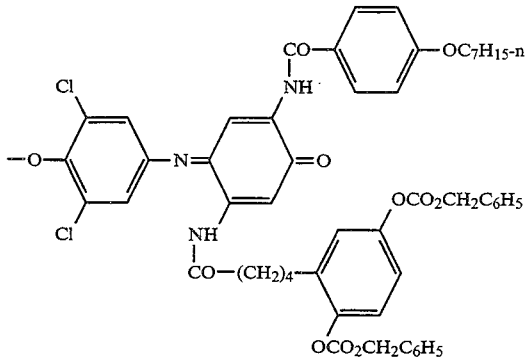

-continued

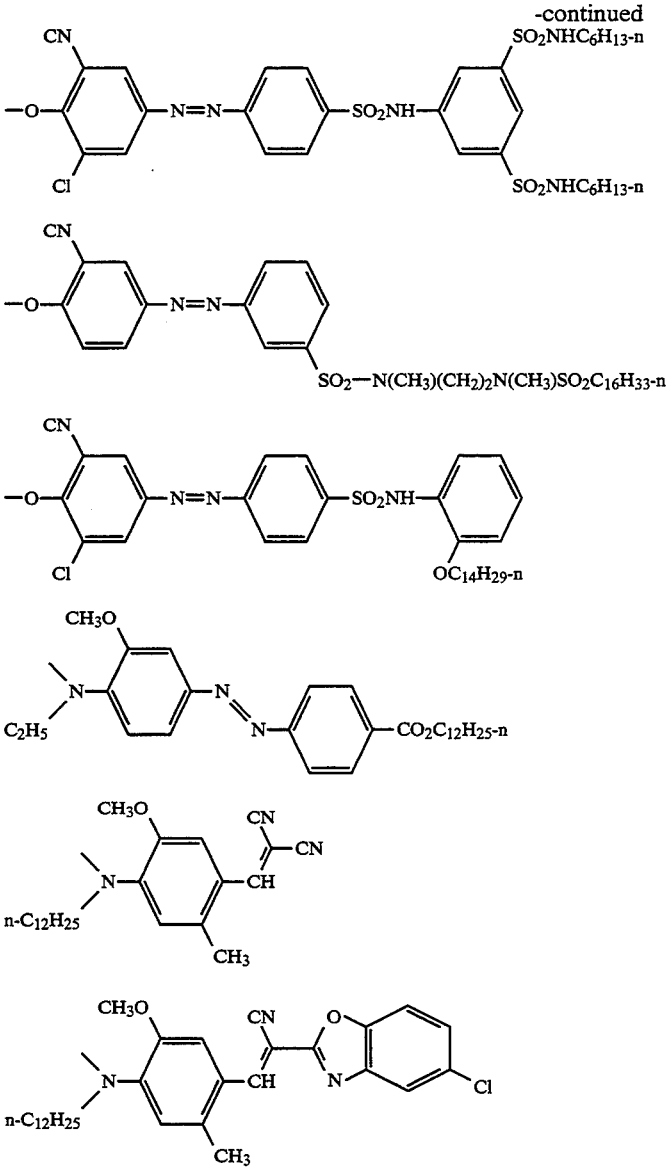

Suitable azo, azamethine and methine dyes are represented by the formulae in U.S. Pat. No. 4,840884, col. 8, lines 1–70.

Dyes can be chosen from those described, for example, in J. Fabian and H. Hartmann, *Light Absorption of Organic Colorants*, published by Springer-Verlag Co., but are not limited thereto.

Typical dyes are azo dyes having a radical represented by the following formula:

$$-X-Y-N=N-Z$$

wherein X is a hetero atom such as an oxygen atom, a nitrogen atom and a sulfur atom, Y is an atomic group containing at least one unsaturated bond having a conjugated relation with the azo group, and linked to X through an atom constituting the unsaturated bond, Z is an atomic group containing at least one unsaturated bond capable of conjugating with the azo group, and the number of carbon atoms contained in Y and Z is 10 or more.

Furthermore, Y and Z are each preferably an aromatic group or an unsaturated heterocyclic group. As the aromatic group, a substituted or unsubstituted phenyl or naphthyl group is preferred. As the unsaturated heterocyclic group, a 4- to 7-membered heterocyclic group containing at least one hetero atom selected from a nitrogen atom, a sulfur atom and an oxygen atom is preferred, and it may be part of a benzene-condensed ring system. The heterocyclic group means groups having a ring structure such as pyrrole, thiophene, furan, imidazole, 1,2,4-triazole, oxazole, thiadiazole, pyridine, indole, benzthiophene, benzimidazole, or benzoxazole.

Y may be substituted with other groups as well as X and the azo groups. Examples of such other groups include an aliphatic or alicyclic hydrocarbon group, an aryl group, an acyl group, an alkoxycarbonyl group, an aryloxycarbonyl group, an acylamino group, an alkylthio, an arylthio group, a heterocyclic group, a sulfonyl group, a halogen atom, a nitro group, a nitroso group, a cyano group, —COOM (M=H, an alkali metal atom or $NH_4$), a hydroxyl group, a sulfonamido group, an alkoxy group, an aryloxy group, and an acyloxy group. In addition, a carbamoyl group, an amino group, a ureido group, a sulfamoyl group, a carbamoylsulfonyl group and a hydrazino group are included. These groups may be further substituted with a group such as those disclosed above repeatedly, for example once or twice.

In the case where Z is a substituted aryl group or a substituted unsaturated heterocyclic group, groups listed as substituents for Y can be used in the same manner for Z.

When Y and Z contain an aliphatic or alicyclic hydrocarbon moiety as a substituent, any substituted or unsubstituted, saturated, unsaturated or straight or branched groups having, in the case of an aliphatic hydrocarbon moiety, from 1 to 32, preferably from 1 to 20 carbon atoms, and, in the case of an alicyclic hydrocarbon moiety having from 5 to 32, preferably from 5 to 20 carbon atoms, can be used. When substitution is carried out repeatedly, the uppermost number of carbon atoms of the thus obtained substituent is preferably 32.

When Y and Z contain an aryl moiety as a substituent, the number of carbon atoms of the moiety is generally from 6 to 10, and preferably it is a substituted or unsubstituted phenyl group. In the present invention, groups in the formulas shown hereinabove and hereinafter are defined as follows:

An acyl group, a carbamoyl group, an amino group, a ureido group, a sulfamoyl group, a carbamoylsulfonyl group, an urethane group, a sulfonamido group, a hydrazino group, and the like represents unsubstituted groups thereof and substituted groups thereof which are substituted with an aliphatic hydrocarbon group, an alicyclic hydrocarbon group or an aryl group to form mono-, di-, or tri-substituted groups; an acylamino group, a sulfonyl group, a sulfonamido group, an acyloxy group and the like each is aliphatic alicyclic, and aromatic group.

Typical examples of this group represented by formula for azo dyes shown above are contained in, for example, U.S. Pat. Nos. 4,424,156 and 4,857,447, column 6, lines 35–70.

3. PUG's which are couplers

Couplers released can be nondiffusible color-forming couplers, non-color forming couplers or diffusible competing couplers. Representative patents and publications describing competing couplers are: "On the Chemistry of White Couplers," by W. Puschel, Agfa-Gevaert AG Mitteilungen and der Forschungs-Laboratorium der Agfa-Gevaert AG, Springer Verlag, 1954, pp. 352–367; U.S. Pat. Nos. 2,998,314; 2,808,329; 2,689,793; 2,742,832; German Patent No. 1,168,769 and British Patent No. 907,274. Structures of useful competing couplers are:

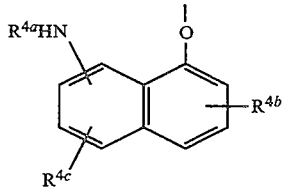

where $R^{4a}$ is hydrogen or alkylcarbonyl, such as acetyl, and $R^{4b}$ and $R^{4c}$ are individually hydrogen or a solubilizing group, such as sulfo, aminosulfonyl, and carboxy

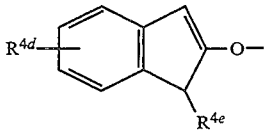

where $R^{4d}$ is as defined above and $R^{4e}$ is halogen, aryloxy, arylthio, or a development inhibitor, such as a mercaptotetrazole, such as phenylmercaptotetrazole or ethylmercaptotetrazole.

4. PUG's which form developing agents

Developing agents released can be color developing agents, black-and-white developing agents or cross-oxidizing developing agents. They include aminophenols, phenylenediamines, hydroquinones and pyrazolidones. Representative patents are: U.S. Pat. Nos. 2,193,015; 2,108,243; 2,592,364; 3,656,950; 3,658,525; 2,751,297; 2,289,367; 2,772,282; 2,743,279; 2,753,256 and 2,304,953.

Structures of suitable developing agents are:

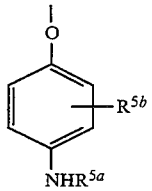

where $R^{5a}$ is hydrogen or alkyl of 1 to 4 carbon atoms and $R^{5b}$ is hydrogen or one or more halogen such as chloro or bromo; or alkyl of 1 to 4 carbon atoms such as methyl, ethyl or butyl groups.

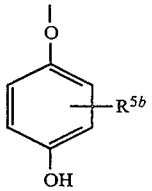

where $R^{5b}$ is as defined above.

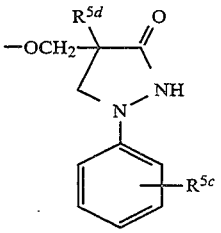

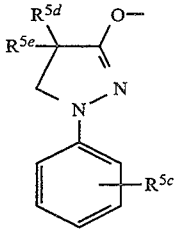

-continued

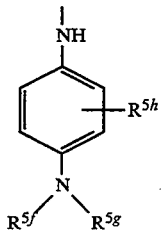

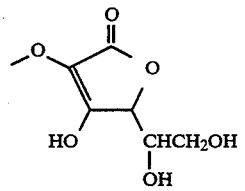

where $R^{5c}$ is hydrogen or alkyl of 1 to 4 carbon atoms and $R^{5d}$, $R^{5e}$, $R^{5f}$, $R^{5g}$, and $R^{5h}$ are individually hydrogen, alkyl of 1 to 4 carbon atoms such as methyl or ethyl; hydroxyalkyl of 1 to 4 carbon atoms such as hydroxymethyl or hydroxyethyl or sulfoalkyl containing 1 to 4 carbon atoms.

5. PUG's which are bleach inhibitors

Representative patents are U.S. Pat. Nos.3,705,801; 3,715,208; and German OLS No. 2,405,279. Structures of typical bleach inhibitors are:

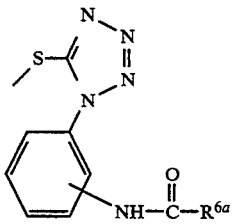

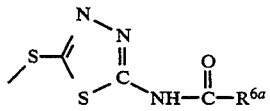

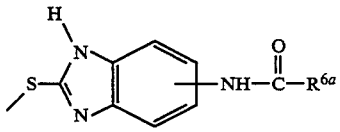

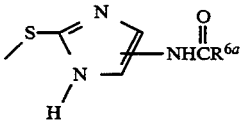

where $R^{6a}$ is alkyl or aryl of 6 to 20 carbon atoms.

6. PUG's which are bleach accelerators

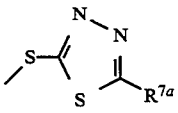

-continued

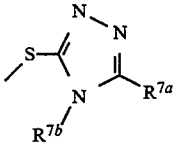

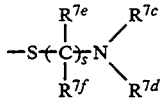

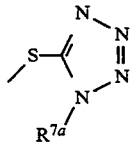

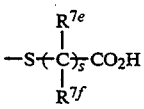

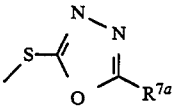

wherein $R^{7a}$ is hydrogen, alkyl, such as methyl, ethyl, and butyl, alkoxy, such as ethoxy and butoxy, or alkylthio, such as ethylthio and butylthio, for example containing 1 to 6 carbon atoms, and which may be unsubstituted or substituted; $R^{7b}$ is hydrogen, substituted or unsubstituted alkyl, or substituted or unsubstituted aryl, such as phenyl; $R^{7c}$, $R^{7d}$, $R^{7e}$ and $R^{7f}$ are individually hydrogen, substituted or unsubstituted alkyl, or substituted or unsubstituted aryl, such as straight chained or branched alkyl containing 1 to 6 carbon atoms, for example methyl, ethyl and butyl; s is 1 to 6; $R^{7c}$ and $R^{7d}$, or $R^{7e}$ and $R^{7f}$ together may form a 5-, 6-, or 7-membered ring.

It is often preferred for $R^{7a}$ and $R^{7b}$ to be solubilizing functions by the structure:

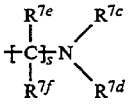

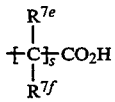

where $R^{7c}$, $R^{7d}$, $R^{7e}$, $R^{7f}$, and s are as defined above.

Other PUGs representative of bleach accelerators, can be found in for example U.S. Pat. Nos. 4,705,021; 4,912,024; 4,959,299; 4,705,021; 5,063,145, columns 21–22, lines 1–70; and EP Patent No. 0,193,389.

7. PUGs which are electron transfer agents (ETAs)

ETAs useful in the present invention are 1-aryl-3-pyrazolidinone derivatives which, once released, become active electron transfer agents capable of accelerating development under processing conditions used to obtain the desired dye image.

The electron transfer agent pyrazolidinone moieties which have been found to be useful in providing development acceleration function are derived from compounds generally of the type described in U.S. Pat. Nos. 4,209,580;, 4,463,081; 4,471,045; and 4,481,287 and in published Japanese patent application No. 62-123,172. Such compounds comprise 3-pyrazolidinone structures having an unsubstituted or substituted aryl group in the 1-position. Also useful are the combinations disclosed in U.S. Pat. No. 4,859,578. Preferably these compounds have one or more alkyl groups in the 4- or 5-positions of the pyrazolidinone ring.

Electron transfer agents suitable for use in this invention are represented by the following two formulas:

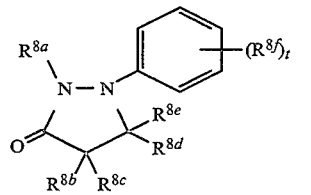

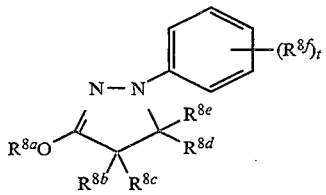

wherein:

$R^{8a}$ is hydrogen;

$R^{8b}$ and $R^{8c}$ each independently represents hydrogen, substituted or unsubstituted alkyl having from 1 to about 8 carbon atoms (such as hydroxyalkyl), carbamoyl, or substituted or unsubstituted aryl having from 6 to about 10 carbon atoms;

$R^{8d}$ and $R^{8e}$ each independently represents hydrogen, substituted or unsubstituted alkyl having from 1 to about 8 carbon atoms or substituted or unsubstituted aryl having from 6 to about 10 carbon atoms;

$R^{8f}$, which may be present in the ortho, meta or para positions of the benzene ring, represents halogen, substituted or unsubstituted alkyl having from 1 to about 8 carbon atoms, or substituted or unsubstituted alkoxy having from 1 to about 8 carbon atoms, or sulfonamido, and when m is greater than 1, the $R^{8f}$ substituents can be the same or different or can be taken together to form a carbocyclic or a heterocyclic ring, for example a benzene or an alkylenedioxy ring; and t is 0 or 1 to 3.

When $R^{8b}$ and $R^{8c}$ groups are alkyl, it is preferred that they comprise from 1 to 3 carbon atoms. When $R^{8b}$ and $R^{8c}$ represent aryl, they are preferably phenyl.

$R^{8d}$ and $R^{8e}$ are preferably hydrogen.

When $R^{8f}$ represents sulfonamido, it may be, for example, methanesulfonamido, ethanesulfonamido or toluenesulfonamido.

8. PUGs which are development inhibiting redox releasers (DIRRs)

DIRRs useful in the present invention include hydroquinone, catechol, pyrogallol, 1,4-naphthohydroquinone, 1,2-naphthoquinone, sulfonamidophenol, sulfonamidonaphthol and hydrazide derivatives which, once released, become active inhibitor redox releasing agents that are then capable of releasing a development inhibitor upon reaction with a nucleophile such as hydroxide ion under processing conditions used to obtain the desired dye image. Such redox releasers are represented by formula (II) in U.S. Pat. No. 4,985,336; col. 3, lines 10 to 25 and formulas (III) and (IV) col. 14, line 54 to col. 17, line 11. Other redox releasers can be found in European Patent Application No. 0,285,176. Typical redox releasers include the following:

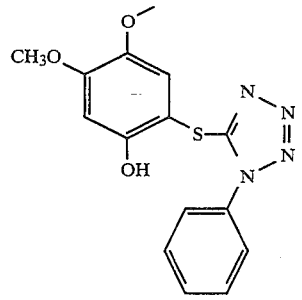

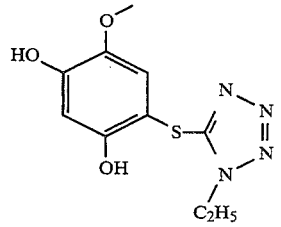

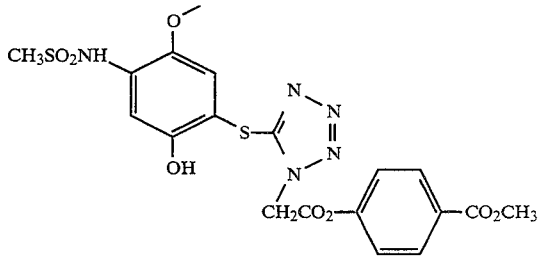

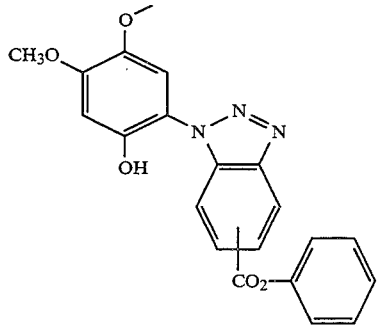

-continued

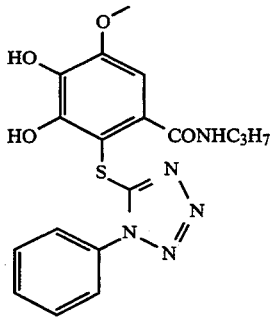

Couplers containing other suitable redox releasers can be found in for example, U.S. Pat. No. 4,985,336; cols. 17 to 62.

The following formula represents a 5-, 6-, or 7-membered nitrogen-containing unsaturated heterocyclic group which has 2 to 6 carbon atoms, which is connected to the carrier moiety through the nitrogen atom and which has a sulfonamido group and a development inhibitor group or a precursor thereof, on the ring carbon atoms. Z represents an atomic group necessary to form a 5-, 6-, or 7-membered nitrogen-containing unsaturated heterocyclic ring containing 2 to 6 carbon atoms together with the nitrogen atom; DI represents a development inhibitor group; and R represents a substituent; and DI is connected to a carbon atom of the heterocyclic ring represented by Z through a hetero atom included therein, and the sulfonamido group is connected to a carbon atom of the heterocyclic ring represented by Z, provided that the nitrogen atom through which the heterocyclic group is connected to the carrier moiety and the nitrogen atom in the sulfonamido group are positioned so as to satisfy the Kendall-Pelz rule as described, for example, in *The Theory Of The Photographic Process,* 4th edition, pp. 298–325.

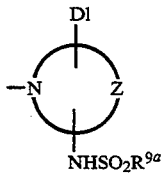

The group represented by the above formula is a group capable of being oxidized by the oxidation product of a developing agent. More specifically, the sulfonamido group thereon is oxidized to a sulfonylimino group from which a development inhibitor is cleaved.

Specific examples of the just described development inhibiting redox releasers are as follows:

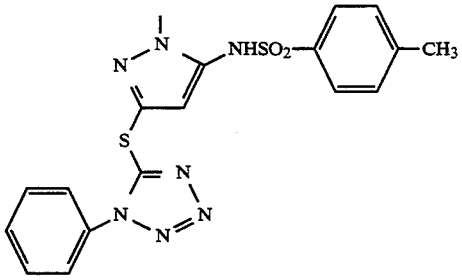

-continued

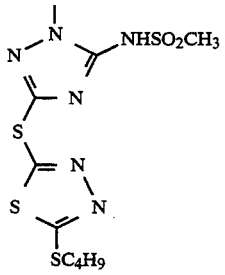

Other examples of development inhibiting redox releasers can be found in the couplers represented in for example European Patent Application 0,362,870; page 13, line 25 to page 29, line 20.

In a preferred embodiment, the PUG-releasing compound is a development inhibitor-releasing (DIR) compound.

These DIR compounds may be incorporated in the same layer as the emulsions of this invention, in reactive association with this layer or in a different layer of the photographic material, all as known in the art.

These DIR compounds may be among those classified as "diffusable," meaning that they enable release of a highly transportable inhibitor moiety, or they may be classified as "non-diffusible", meaning that they enable release of a less transportable inhibitor moiety. The DIR compounds may comprise a timing or linking group as known in the art.

The inhibitor moiety of the DIR compound may be unchanged as the result of exposure to photographic processing solution. However, the inhibitor moiety may change in structure and effect in the manner disclosed in U.K. Patent No. 2,099,167; European Patent Application 167,168; Japanese Kokai 205150/83; or U.S. Pat. No. 4,782,012 as the result of photographic processing.

When the DIR compounds are dye-forming couplers, they may be incorporated in reactive association with complementary color sensitized silver halide emulsions, as for example a cyan dye-forming DIR coupler with a red sensitized emulsion or in a mixed mode, for example, a yellow dye-forming DIR coupler with a green sensitized emulsion, all known in the art.

The DIR compounds may also be incorporated in reactive association with bleach accelerator-releasing couplers, as disclosed in U.S. Pat. Nos. 4,912,024 and 5,135,839, and with the bleach accelerator-releasing compounds disclosed in U.S. Pat. Nos. 4,865,956 and 4,923,784, all incorporated herein by reference.

Specific DIR compounds useful in the practice of this invention are disclosed in the above cited references, in commercial use, and in the examples demonstrating the practice of this invention contained herein.

The dye image-forming compounds and PUG-releasing compounds can be incorporated in photographic elements of the present invention by means and processes known in the photographic art. A photographic element in which the dye image-forming and PUG-releasing compounds are incorporated can be a monocolor element comprising a support and a single silver halide emulsion layer, or it can be a multicolor, multilayer element comprising a support and multiple silver halide emulsion layers. The above described compounds can be incorporated in at least one of the silver halide emulsion layers and/or in at least one other layer, such as an adjacent layer, where they are in reactive association with the silver halide emulsion layer and are thereby able to react with the oxidized developing agent produced by development of silver halide in the emulsion layer. Additionally, the silver halide emulsion layers and other layers of the photographic element can contain addenda conventionally contained in such layers.

A typical multicolor, multilayer photographic element can comprise a support having thereon a red-sensitized silver halide emulsion unit having associated therewith a cyan dye image-forming compound, a green-sensitized silver halide emulsion unit having associated therewith a magenta dye image-forming compound, and a blue-sensitized silver halide emulsion unit having associated therewith a yellow dye image-forming compound. Each silver halide emulsion unit can be composed of one or more layers, and the various units and layers can be arranged in different locations with respect to one another, as known in the prior art and as illustrated by layer order formats hereinafter described.

In an element of the invention, a layer or unit affected by PUG can be controlled by incorporating in appropriate locations in the element a layer that confines the action of PUG to the desired layer or unit. Thus, at least one of the layers of the photographic element can be, for example, a scavenger layer, a mordant layer, or a barrier layer. Examples of such layers are described in, for example, U.S. Pat. Nos. 4,055,429; 4,317,892; 4,504,569; 4,865,946; and 5,006,451. The element can also contain additional layers such as antihalation layers, filter layers and the like. The element typically will have a total thickness, excluding the support, of from 5 to 30 m. Thinner formulations of 5 to about 25 m are generally preferred since these are known to provide improved contact with the process solutions. For the same reason, more swellable film structures are likewise preferred. Further, this invention may be particularly useful with a magnetic recording layer such as those described in *Research Disclosure*, Item 34390, November 1992, p. 869.

In the following discussion of suitable materials for use in the elements of this invention, reference will be made to the previously mentioned *Research Disclosure*, December 1989, Item 308119, the disclosures of which are incorporated herein by reference.

Suitable dispersing media for the emulsion layers and other layers of elements of this invention are described in Section IX of *Research Disclosure*, December 1989, Item 308119, and publications therein.

In addition to the compounds described herein, the elements of this invention can include additional dye image-forming compounds, as described in Sections VII A–E and H, and additional PUG-releasing compounds, as described in Sections VII F and G of *Research Disclosure*, December 1989, Item 308119, and the publications cited therein.

The elements of this invention can contain brighteners (Section V), antifoggants and stabilizers (Section VI), antistain agents and image dye stabilizers (Section VII I and J), light absorbing and scattering materials (Section VIII), hardeners (Section X), coating aids (Section XI), plasticizers and lubricants (Section XII), antistatic agents (Section XIII), matting agents (Section XVI), and development modifiers (Section XXI), all in *Research Disclosure*, December 1989, Item 308119.

The elements of the invention can be coated on a variety of supports, as described in Section XVII of *Research Disclosure*, December 1989, Item 308119, and references cited therein.

The elements of this invention can be exposed to actinic radiation, typically in the visible region of the spectrum as described in greater detail hereinafter, to form a latent image and then processed to form a visible dye image, as described in Sections XVIII and XIX of *Research Disclosure*, December 1989, Item 308119.

In the following tables are shown compounds useful in the practice of the present invention.

Table 1 contains the formulas of typical dye image-forming coupler compounds.

Table 2 contains the formulas of typical PUG-releasing compounds that release development inhibitor groups or precursors thereof. In Table 3 are shown the formulas of representative examples of other kinds of PUG-releasing compounds.

Table 4 provides the formulas of miscellaneous exemplary photographic compounds that can be used in elements of the invention.

TABLE 1

Typical Dye Image-Forming Coupler Compounds

C-1

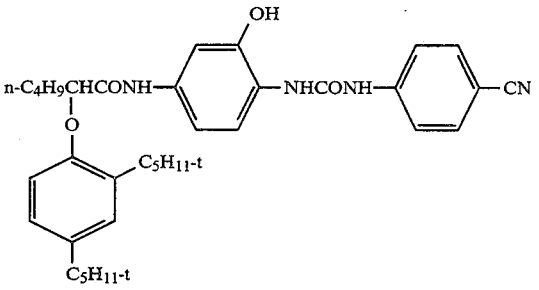

TABLE 1-continued
| Typical Dye Image-Forming Coupler Compounds | |
|---|---|
| 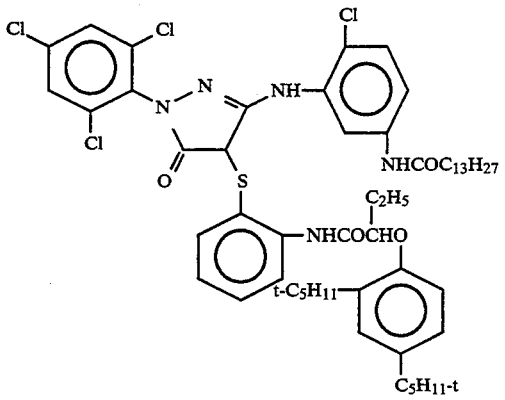 | C-2 |
| 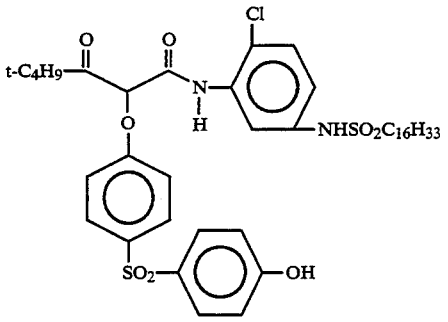 | C-3 |
| 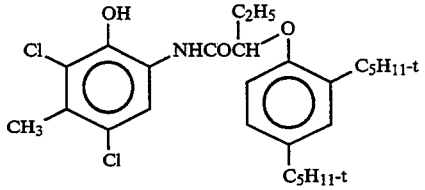 | C-4 |
| 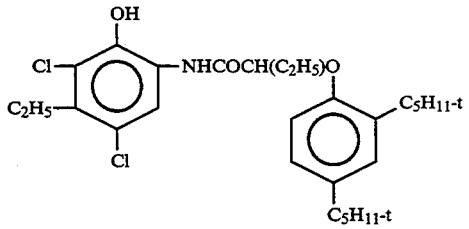 | C-5 |
| 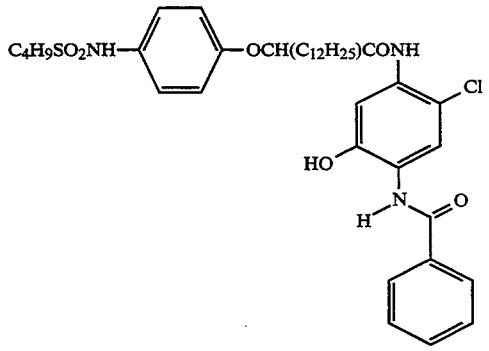 | C-6 |

TABLE 1-continued
Typical Dye Image-Forming Coupler Compounds
C-7
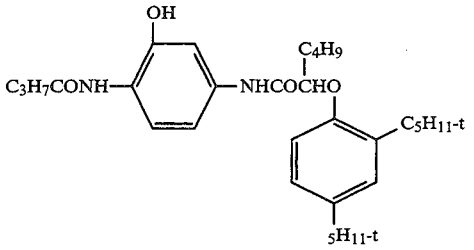
C-8
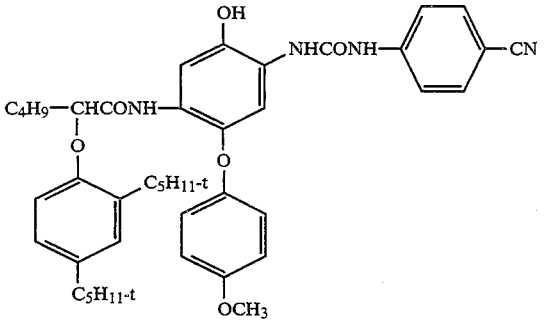
C-9
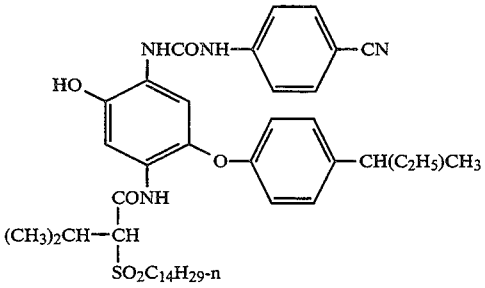
C-10
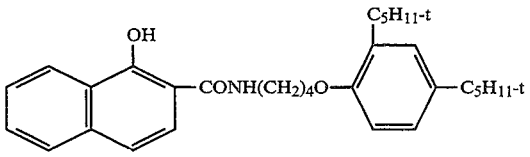
C-11
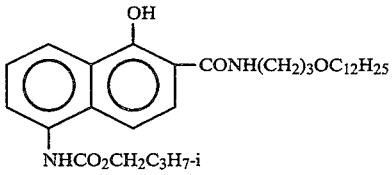
C-12
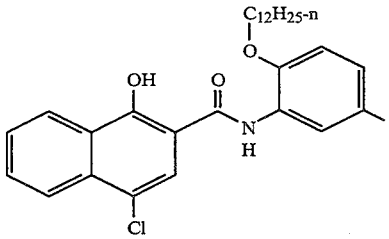

TABLE 1-continued
Typical Dye Image-Forming Coupler Compounds
C-13
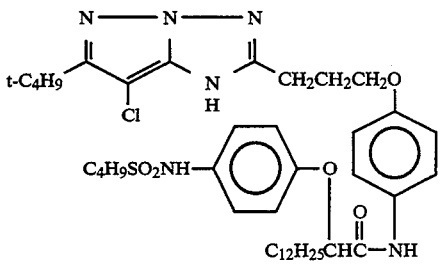
C-14
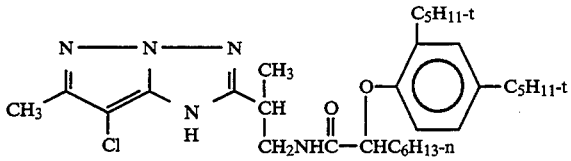
C-15
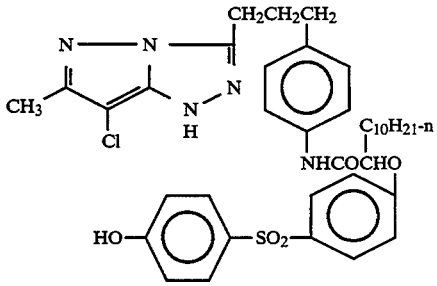
C-16
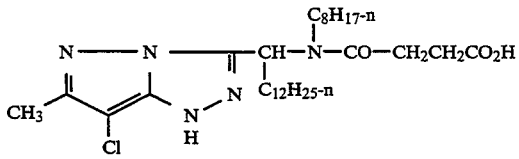
C-17
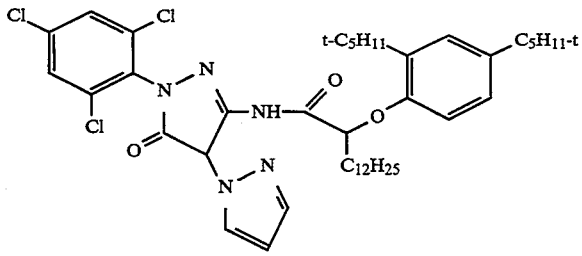
C-18
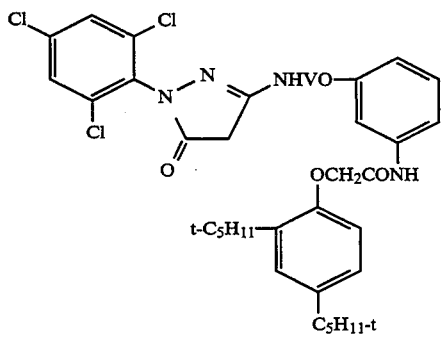

TABLE 1-continued
Typical Dye Image-Forming Coupler Compounds
C-19
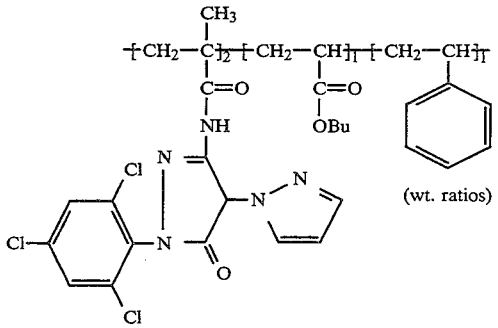
C-20
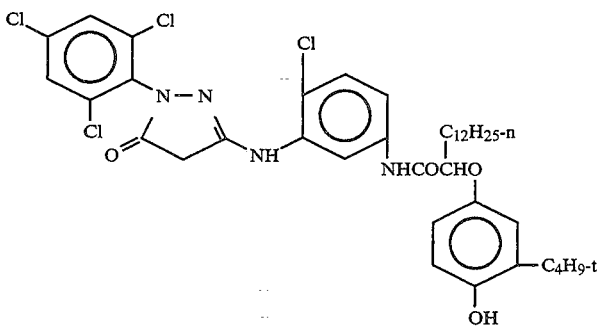
C-21
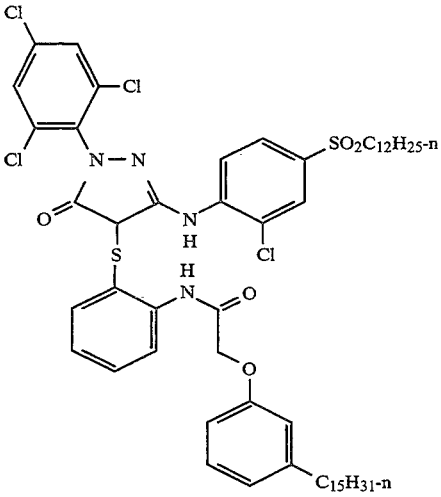
C-22
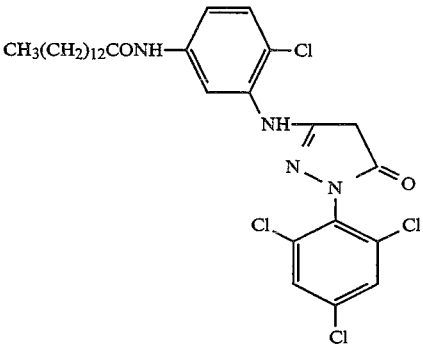

TABLE 1-continued
| Typical Dye Image-Forming Coupler Compounds | |
|---|---|
| 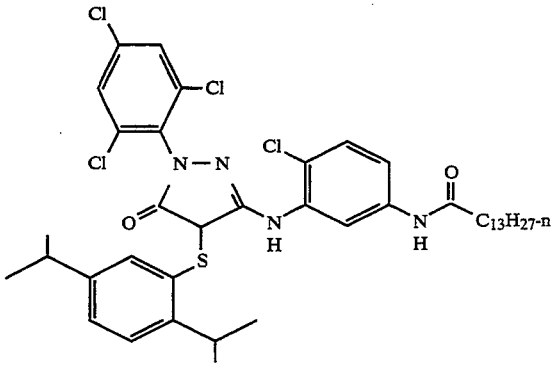 | C-23 |
| 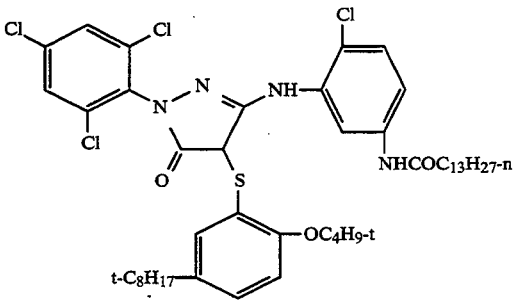 | C-24 |
| 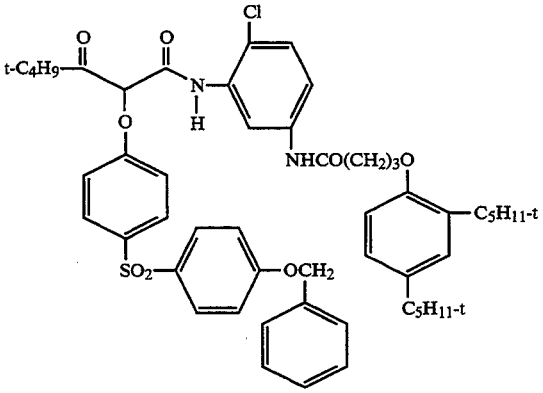 | C-25 |
| 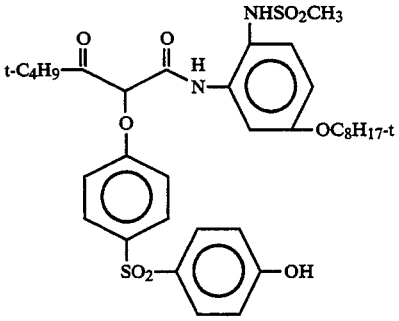 | C-26 |
| 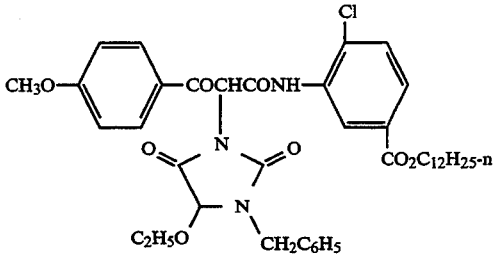 | C-27 |

TABLE 1-continued
| Typical Dye Image-Forming Coupler Compounds | |
|---|---|
| 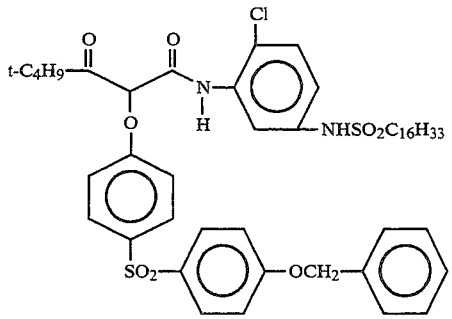 | C-28 |
| 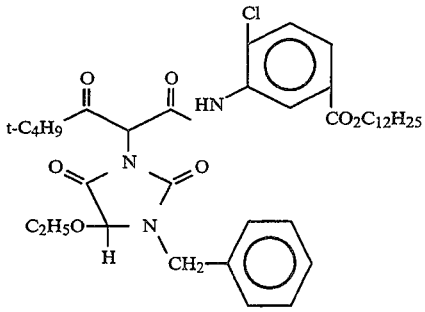 | C-29 |
| 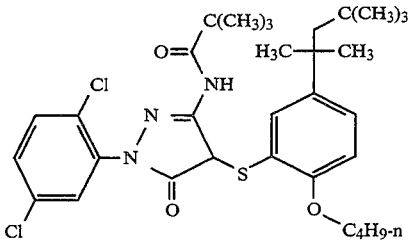 | C-30 |
| 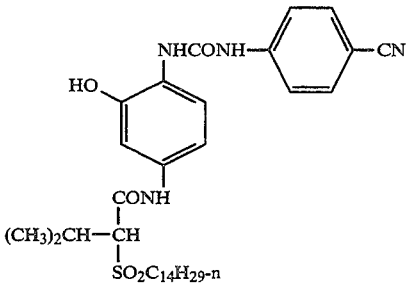 | C-31 |
| 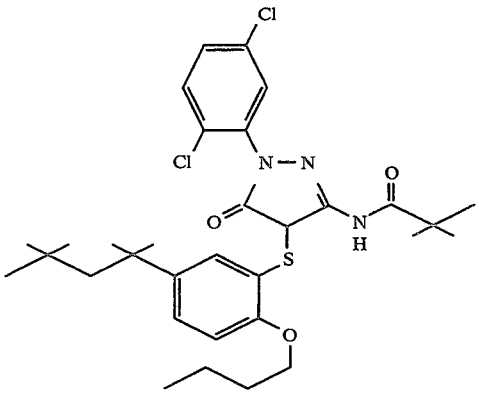 | C-32 |

TABLE 1-continued
Typical Dye Image-Forming Coupler Compounds
C-33
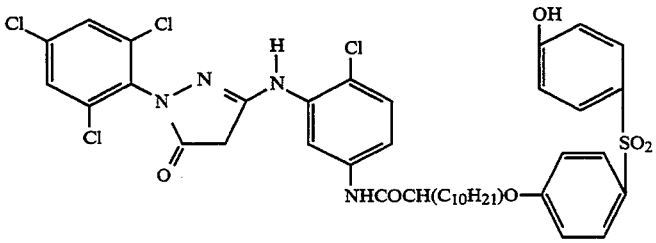
C-34
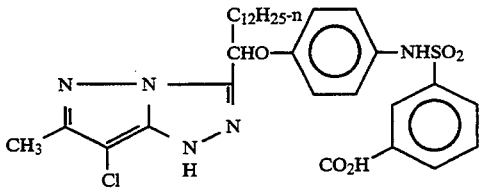
C-35
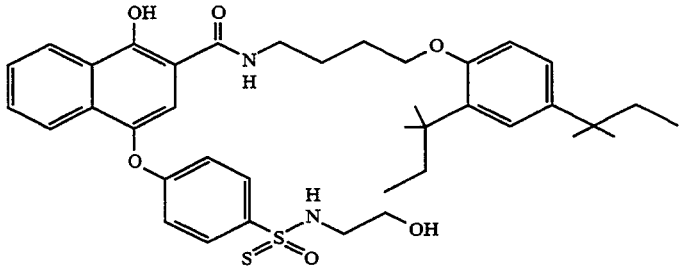
C-36
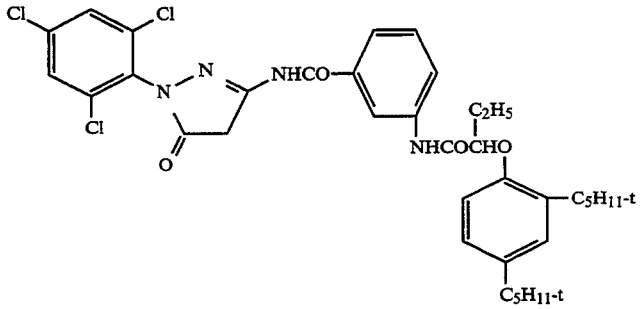
TABLE 2
Typical PUG-Releasing Compounds That Release Development Inhibitor Groups or Precursors Thereof
D-1
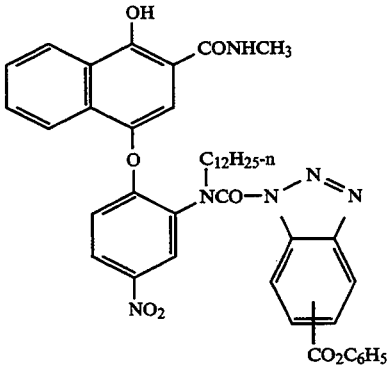

TABLE 2-continued
Typical PUG-Releasing Compounds That Release
Development Inhibitor Groups or Precursors Thereof
D-2
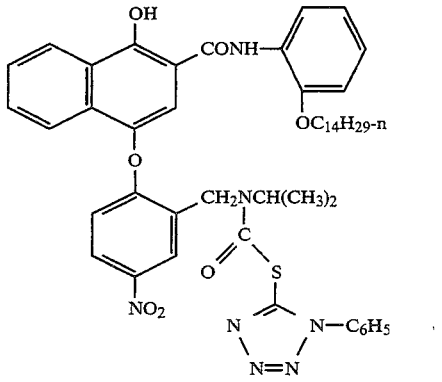
D-3
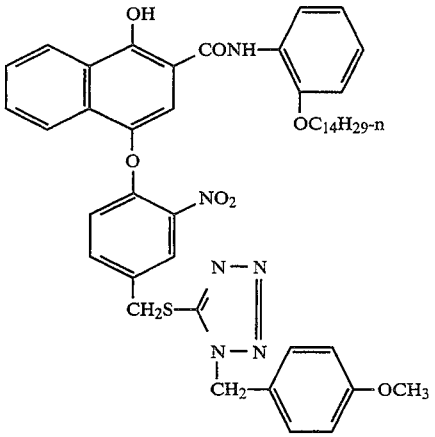
D-4
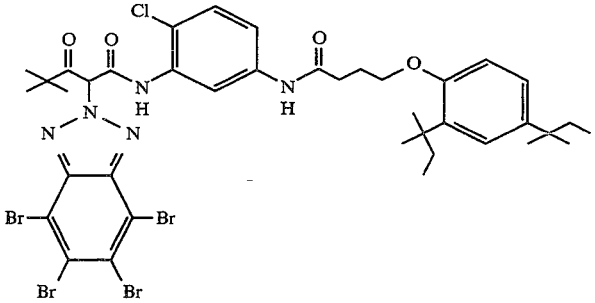
D-5
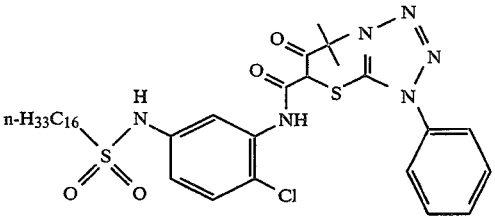

TABLE 2-continued
Typical PUG-Releasing Compounds That Release
Development Inhibitor Groups or Precursors Thereof
D-6
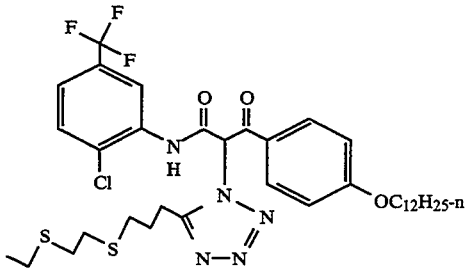
D-7
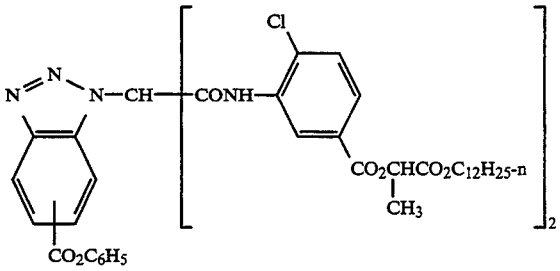
D-8
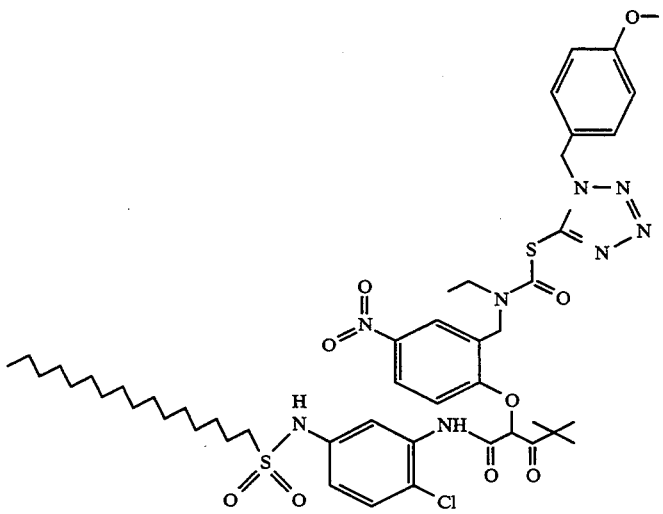
D-9
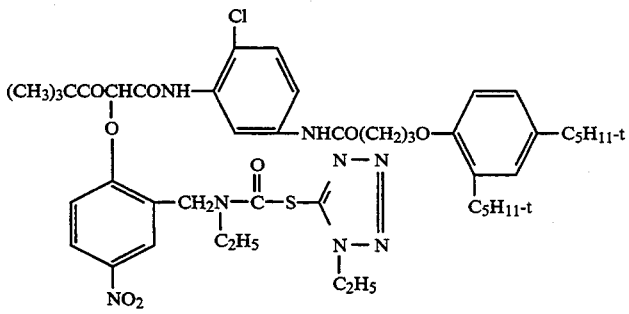

TABLE 2-continued
Typical PUG-Releasing Compounds That Release
Development Inhibitor Groups or Precursors Thereof
D-10
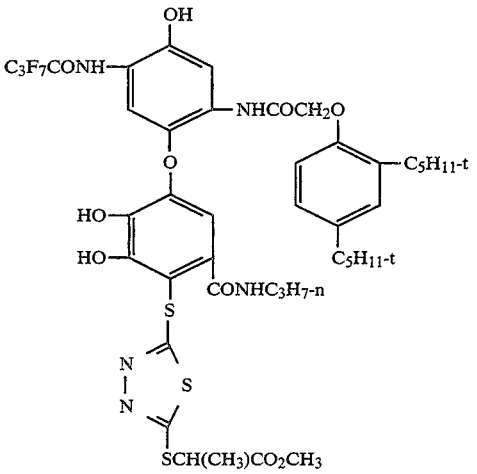
D-12
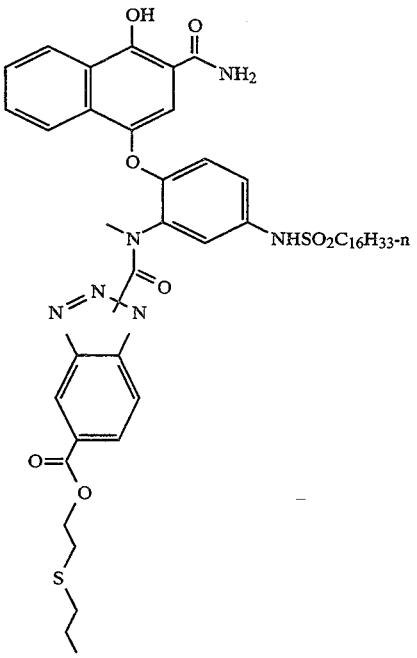

TABLE 2-continued
| Typical PUG-Releasing Compounds That Release Development Inhibitor Groups or Precursors Thereof | |
|---|---|
| 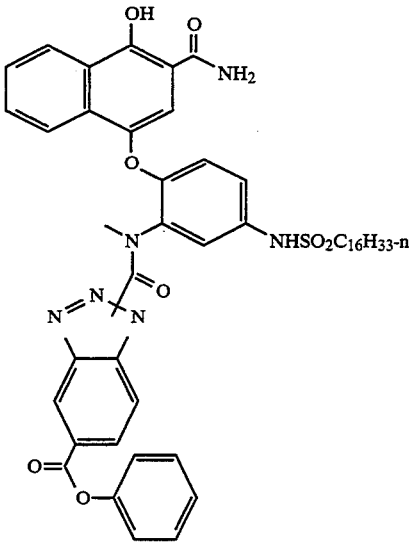 | D-13 |
| 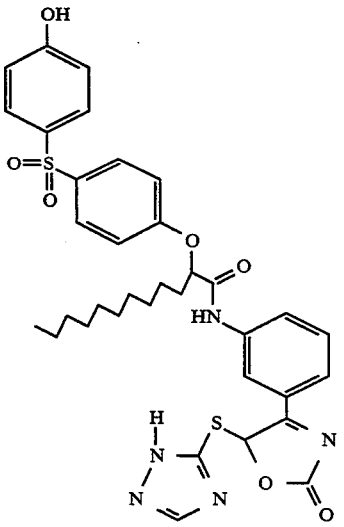 | D-14 |
| 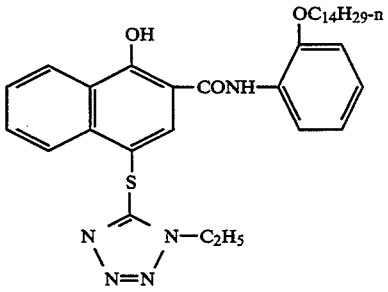 | D-15 |
| 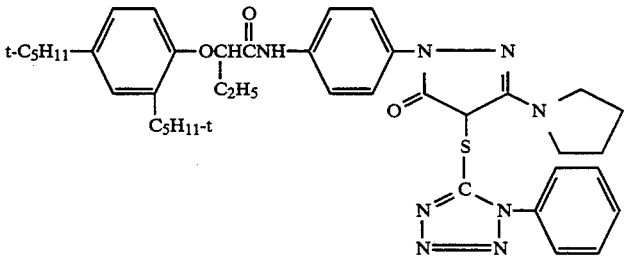 | D-16 |

TABLE 2-continued
Typical PUG-Releasing Compounds That Release
Development Inhibitor Groups or Precursors Thereof
D-17
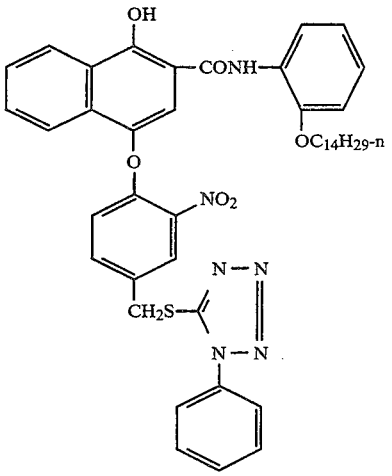
D-18
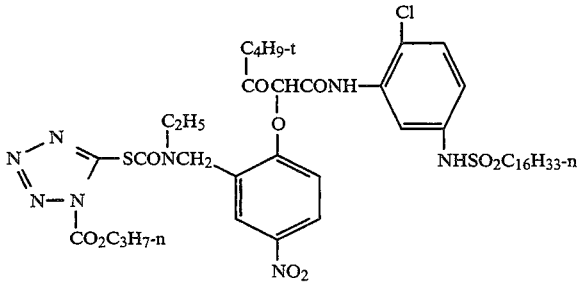
D-19
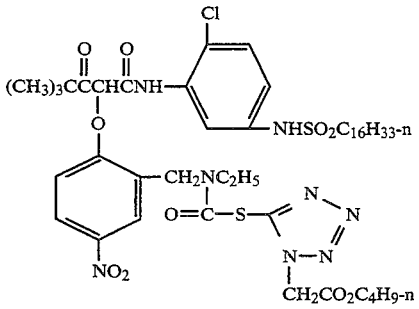
D-20
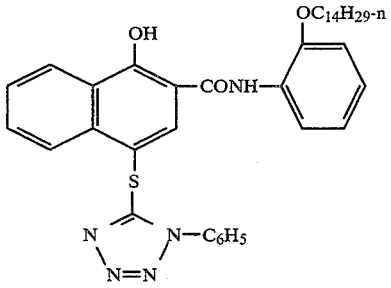

TABLE 2-continued
Typical PUG-Releasing Compounds That Release Development Inhibitor Groups or Precursors Thereof
D-21
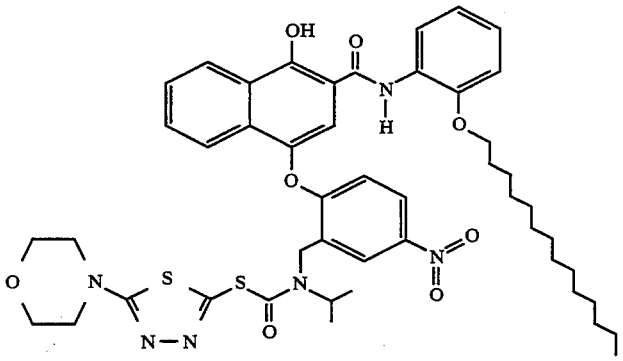
D-22
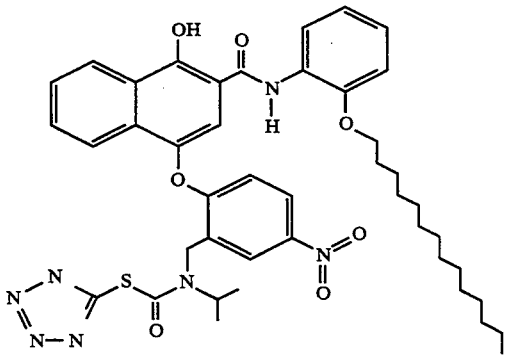
D-23
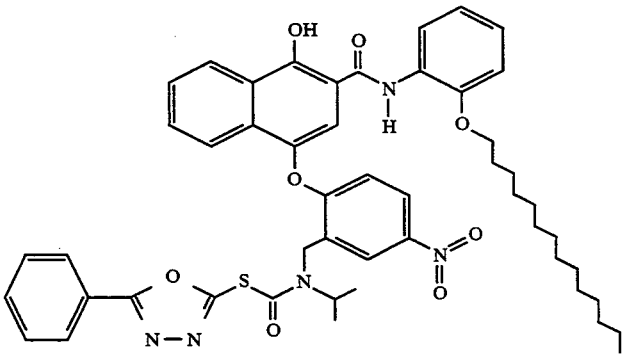
D-24
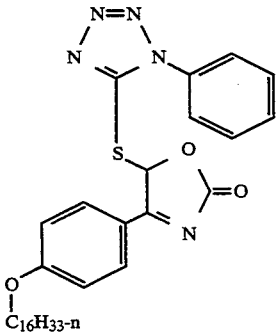

TABLE 2-continued
Typical PUG-Releasing Compounds That Release Development Inhibitor Groups or Precursors Thereof
D-25
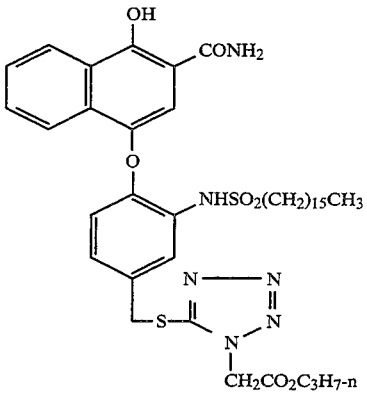
D-26
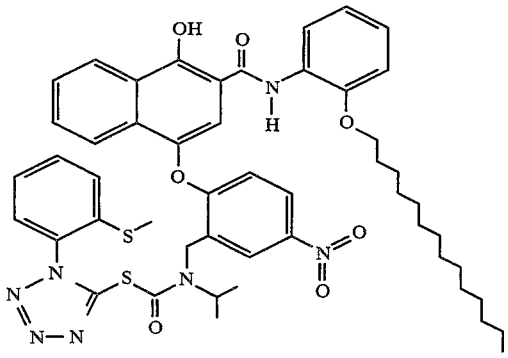
D-27
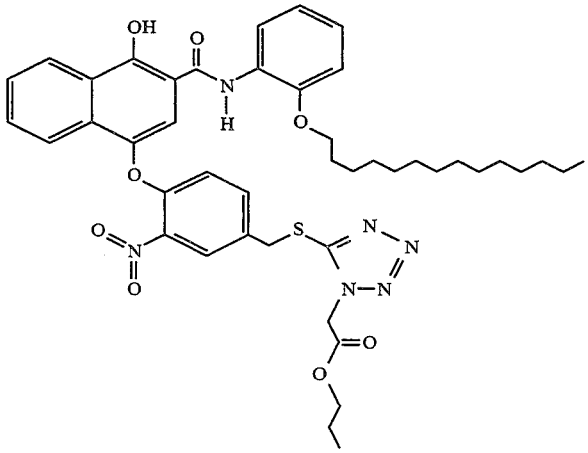
D-30
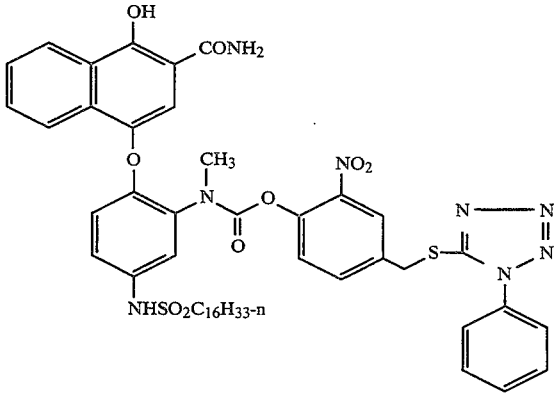

TABLE 2-continued
Typical PUG-Releasing Compounds That Release Development Inhibitor Groups or Precursors Thereof
D-31
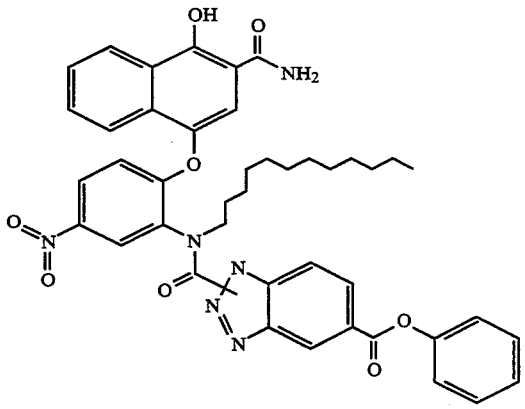
D-32
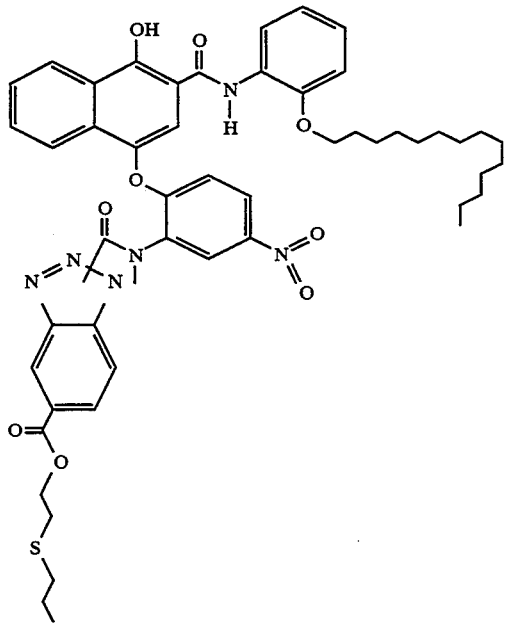
D-33
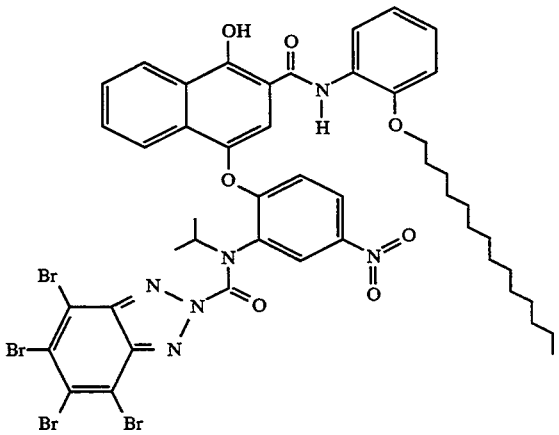

TABLE 2-continued
Typical PUG-Releasing Compounds That Release Development Inhibitor Groups or Precursors Thereof
C-45
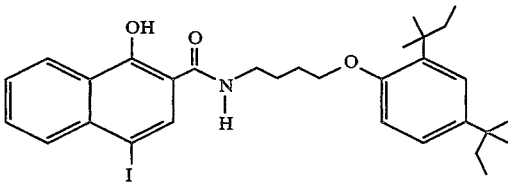
TABLE 3
Typical PUG-Releasing Compounds That Release Groups Other Than Development Inhibitors
| Compound | PUG |
|---|---|
| 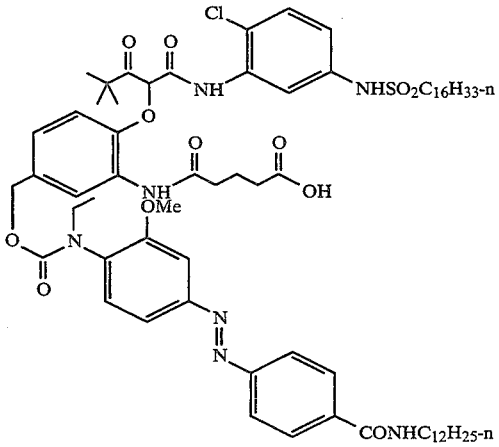 C-37 | Dye |
| 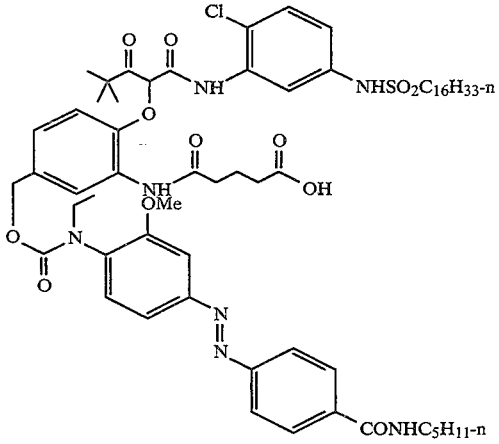 C-38 | Dye |

TABLE 3-continued
Typical PUG-Releasing Compounds That Release Groups Other Than Development Inhibitors
| Compound | PUG |
|---|---|
| 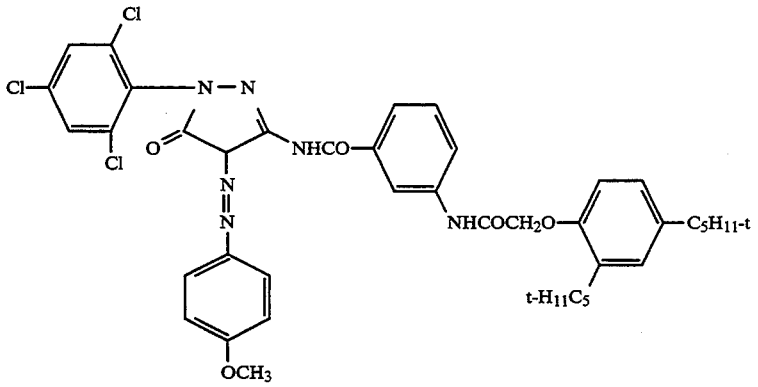 C-39 | Dye |
| 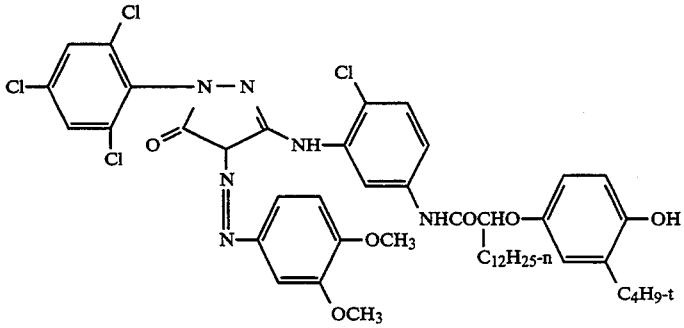 C-40 | Dye |
| 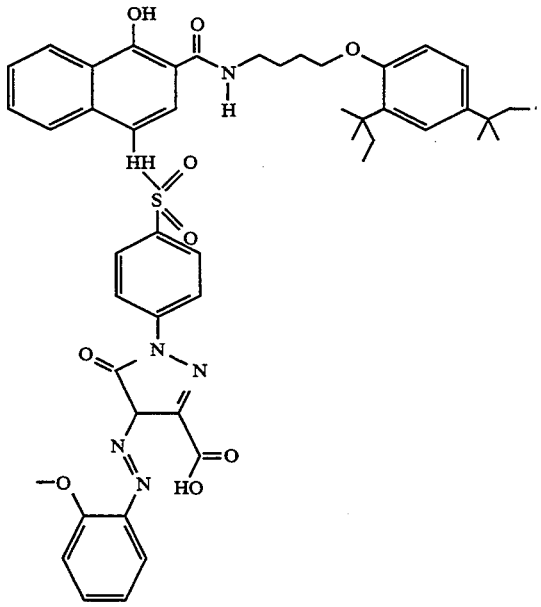 C-41 | Dye |

TABLE 3-continued
Typical PUG-Releasing Compounds That Release Groups Other Than Development Inhibitors
| Compound | PUG |
|---|---|
| 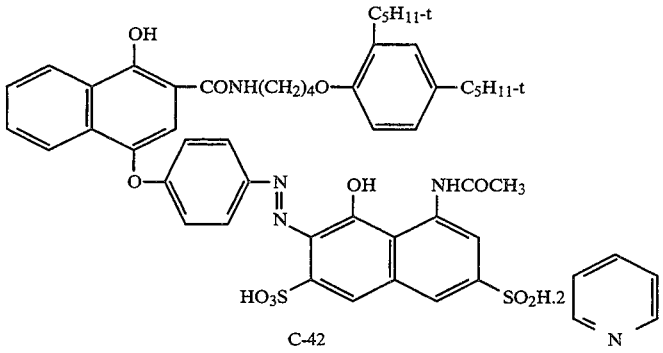 C-42 | Dye |
| 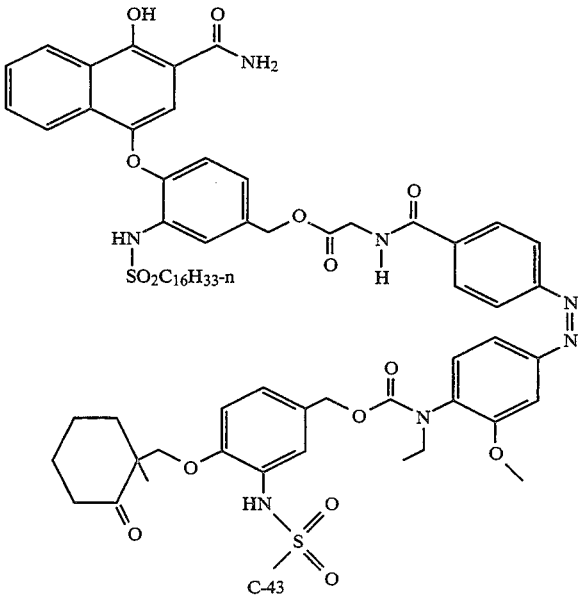 C-43 | Shifted Dye |
| 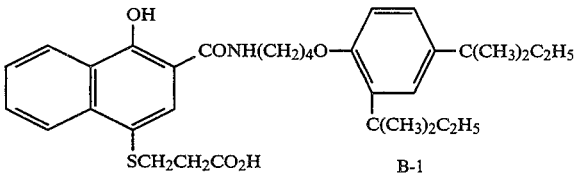 B-1 | Bleach Accelerator |
| 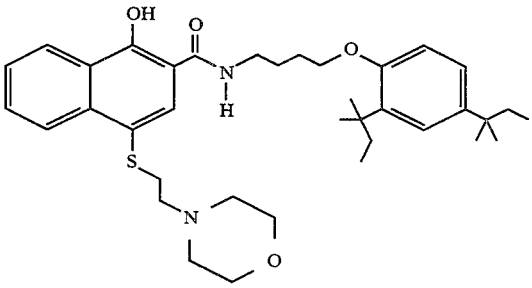 B-6 | Bleach Accelerator |

TABLE 3-continued
Typical PUG-Releasing Compounds That Release Groups Other Than Development Inhibitors
| Compound | PUG |
|---|---|
| 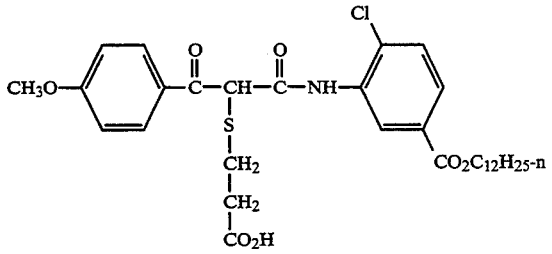 B-32 | Bleach Accelerator |
| 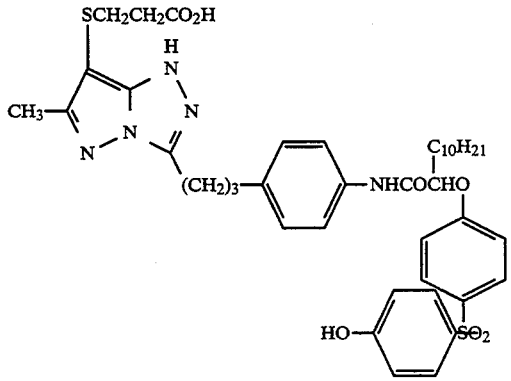 B-36 | Bleach Accelerator |
| 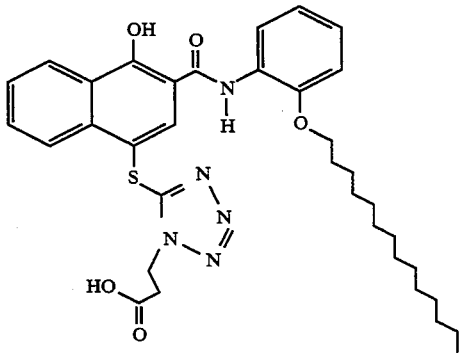 D-28 | Bleach Acclerator |
| 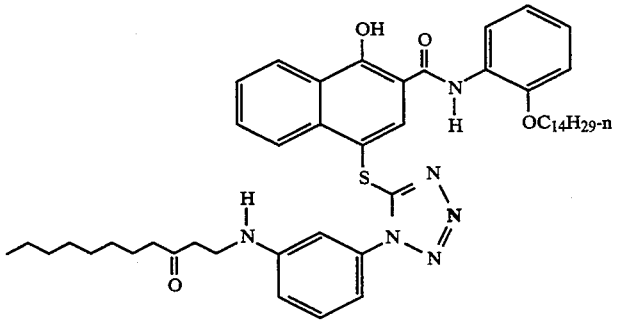 D-29 | Bleach Inhibitor |

TABLE 3-continued
Typical PUG-Releasing Compounds That Release Groups Other Than Development Inhibitors
| Compound | PUG |
|---|---|
| 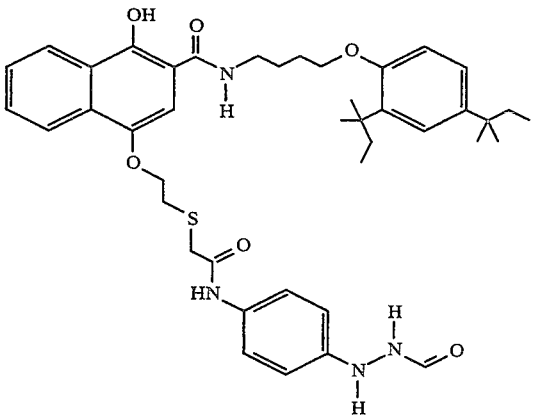 C-49 | Development Accelerator |
| 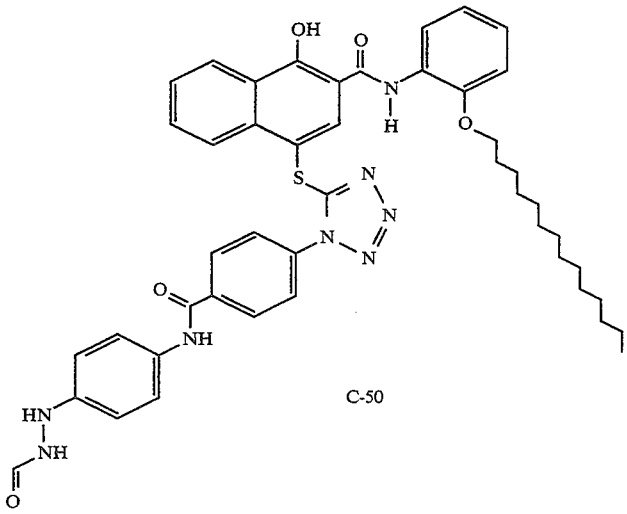 C-50 | Development Accelerator |
| 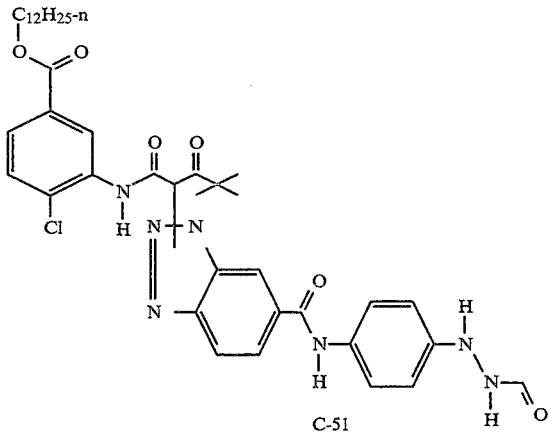 C-51 | Development Accelerator |

TABLE 3-continued
| Typical PUG-Releasing Compounds That Release Groups Other Than Development Inhibitors | |
|---|---|
| Compound | PUG |
| 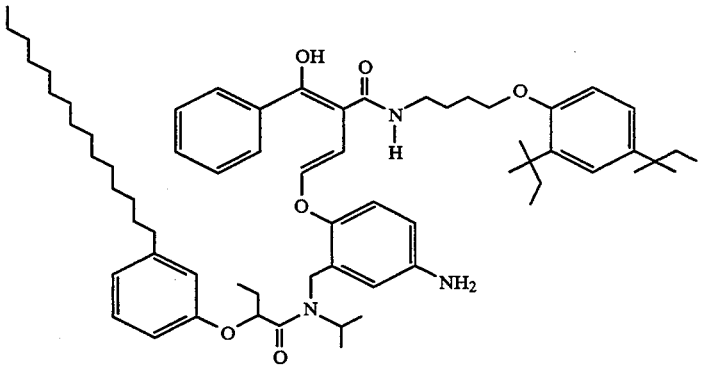 C-46 | Competing Coupler |
| 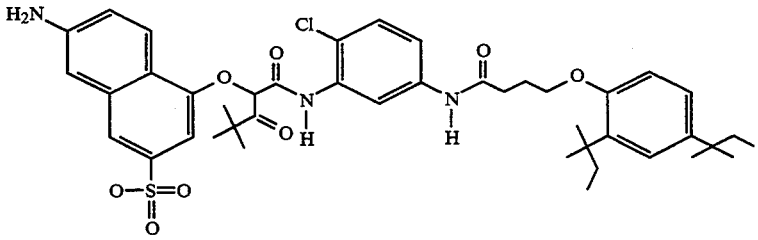 C-47 | Competing Coupler |
| 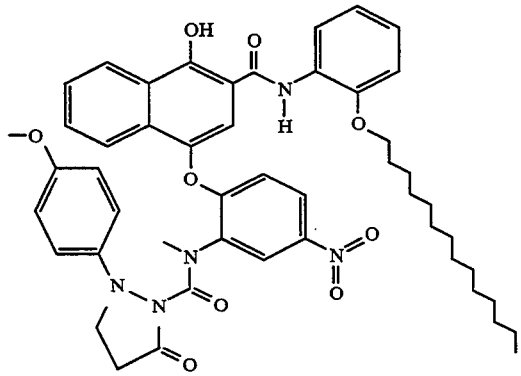 C-52 | Electron Transfer Agent |
TABLE 4
| Miscellaneous Exemplary Photographic Compounds | |
|---|---|
| 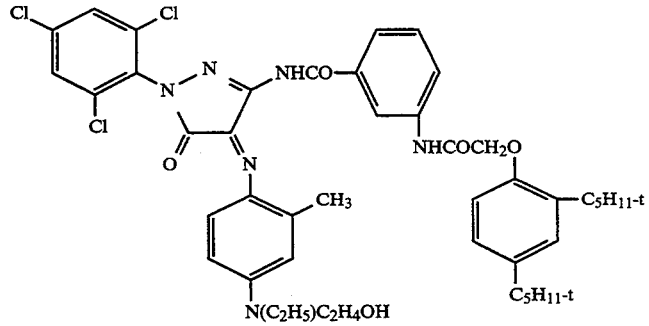 | DYE-1 |

TABLE 4-continued
Miscellaneous Exemplary Photographic Compounds
DYE-2
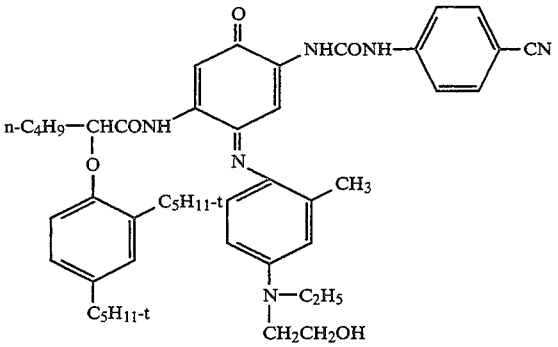
DYE-3
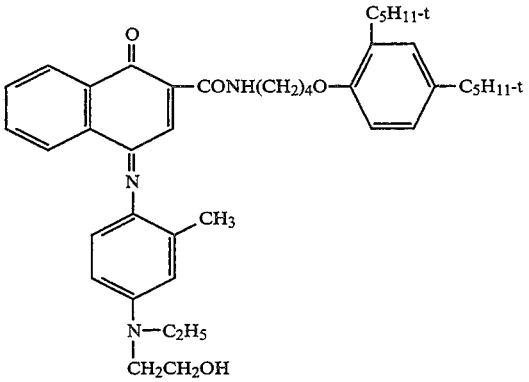
DYE-4
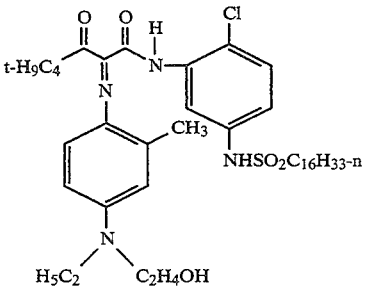
DYE-6
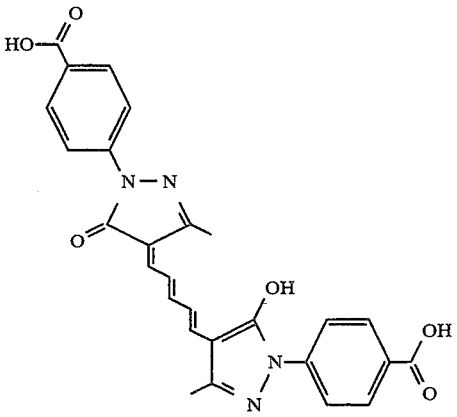

TABLE 4-continued
| Miscellaneous Exemplary Photographic Compounds | |
|---|---|
| 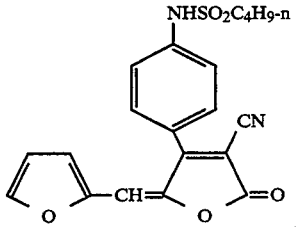 | DYE-7 |
| 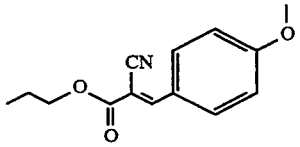 | DYE-8 |
| 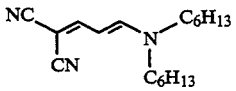 | DYE-9 |
| 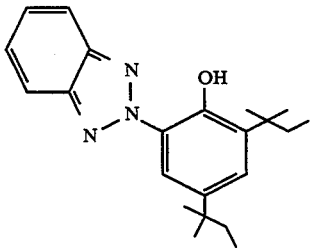 | DYE-10 |
| 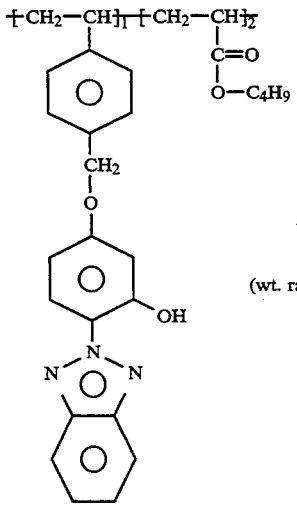 (wt. ratios) | DYE-11 |
| 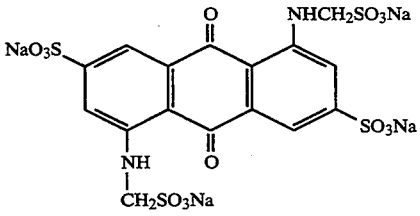 | SOL-1 |
| 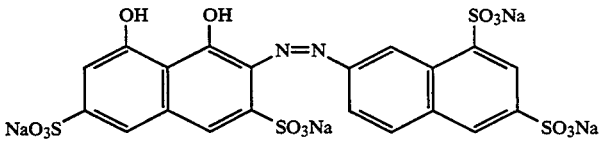 | SOL-2 |

TABLE 4-continued

| Miscellaneous Exemplary Photographic Compounds | |
|---|---|
| Mixture of Isomeric Didodecylhydroquinones | S-1 |
| 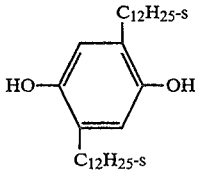 | S-2 |
| 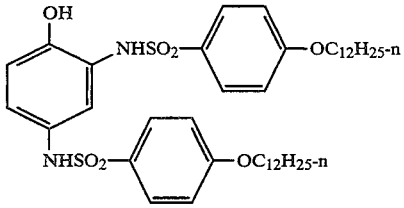 | S-3 |
| 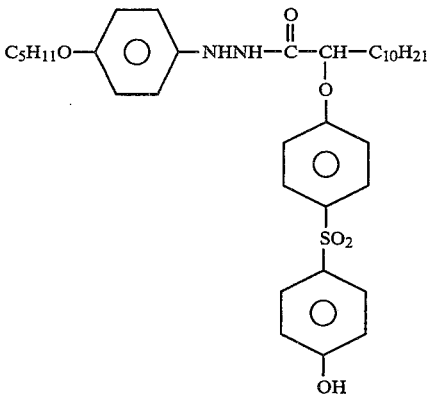 | S-4 |
| 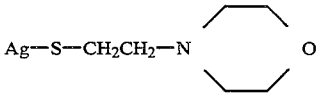 | BA-1 |
| $Ag—S—CH_2CH_2CO_2H$ | BA-2 |

Of course, the color photographic elements of this invention can contain any of the optional additional layers and components known to be useful in color photographic elements in general, such as, for example, subbing layers, overcoat layers, surfactants and plasticizers, some of which are discussed in detail hereinbefore. They can be coated onto appropriate supports using any suitable technique, including, for example, those described in *Research Disclosure*, December 1989, Item 308117, Section XV Coating and Drying Procedures, published by Industrial Opportunities Ltd., Homewell Havant, Hampshire, PO9 1EF, U.K., the disclosure of which is incorporated herein by reference.

The photographic elements containing radiation sensitive {100} tabular grain emulsion layers according to this invention can be imagewise-exposed with various forms of energy which encompass the ultraviolet and visible (e.g., actinic) and infrared regions of the electromagnetic spectrum, as well as electron-beam and beta radiation, gamma ray, X-ray, alpha particle, neutron radiation and other forms of corpuscular and wave-like radiant energy in either noncoherent (random phase) forms or coherent (in phase) forms as produced by lasers. Exposures can be monochromatic, orthochromatic or panchromatic. Imagewise exposures at ambient, elevated or reduced temperatures and/or pressures, including high-or low-intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. james, *The Theory of the Photographic Process*, 4th Ed., Macmillan, 1977, Chapters 4, 6, 17, 18 and 23.

The following examples are intended to illustrate, without limiting, this invention.

EXAMPLES

The invention can be better appreciated by reference to the following examples. Throughout the examples the acronym APMT is employed to designate 1-(3-acetamidophenyl)-5-mercaptotetrazole. The term "low methionine gelatin" is employed, except as otherwise indicated, to designate gelatin that has been treated with an oxidizing agent to reduce its methionine content to less than 30 micromoles per gram. The acronym DW is employed to indicate distilled water. The acronym mppm is employed to indicate molar parts per million.

Emulsion Preparation Example 1

This example demonstrates the preparation of an ultrathin tabular grain silver iodochloride emulsion satisfying the requirements of this invention.

A 2030 mL solution containing 1.75% by weight low methionine gelatin, 0.011M sodium chloride and $1.48\times10^{-4}$M potassium iodide was provided in a stirred reaction vessel. The contents of the reaction vessel were maintained at 40° C. and the pCl was 1.95.

While this solution was vigorously stirred, 30 mL of 1.0M silver nitrate solution and 30 mL of a 0.99M sodium chloride and 0.01M potassium iodide solution were added simultaneously at a rate of 30 mL/min each. This achieved grain nucleation to form crystals with an initial iodide concentration of 2 mole percent, based on total silver.

The mixture was then held 10 minutes with the temperature remaining at 40° C. Following the hold, a 1.0M silver nitrate solution and a 1.0M NaCl solution were then added simultaneously at 2 mL/min for 40 minutes with the pCl being maintained at 1.95.

The resulting emulsion was a tabular grain silver iodochloride emulsion containing 0.5 mole percent iodide, based on silver. Fifty percent of total grain projected area was provided by tabular grains having {100} major faces having an average ECD of 0.84 mm and an average thickness of 0.037 mm, selected on the basis of an aspect ratio rank ordering of all {100} tabular grains having a thickness of less than 0.3 mm and a major face edge length ratio of less than 10. The selected tabular grain population had an average aspect ratio (ECD/t) of 23 and an average tabularity ($ECD/t^2$) of 657. The ratio of major face edge lengths of the selected tabular grains was 1.4. Seventy two percent of total grain projected area was made up of tabular grains having {100} major faces and aspect ratios of at least 7.5. These tabular grains had a mean ECD of 0.75 mm, a mean thickness of 0.045 mm, a mean aspect ratio of 18.6 and a mean tabularity of 488.

A representative sample of the grains of the emulsion is shown in FIG. 1.

Emulsion Preparation Example 2 (Comparative)

This emulsion demonstrates the importance of iodide in the precipitation of the initial grain population (nucleation).

This emulsion was precipitated identically to that of Example 1, except no iodide was intentionally added.

The resulting emulsion consisted primarily of cubes and very low aspect ratio rectangular grains ranging in size from about 0.1 to 0.5 mm in edge length. A small number of large rods and high aspect ratio {100} tabular grains were present, but did not constitute a useful quantity of the grain population.

A representative sample of the grains of this emulsion is shown in FIG. 2.

Emulsion Preparation Example 3

This example demonstrates an emulsion according to the invention in which 90% of the total grain projected area is comprised of tabular grains with {100} major faces and aspect ratios of greater than 7.5.

A 2030 mL solution containing 3.52% by weight low methionine gelatin, 0.0056M sodium chloride and $1.48\times10^{-4}$M potassium iodide was provided in a stirred reaction vessel. The contents of the reaction vessel were maintained at 40° C. and the pCl was 2.25.

While this solution was vigorously stirred, 30 mL of 2.0M silver nitrate solution and 30 mL of a 1.99M sodium chloride and 0.01M potassium iodide solution were added simultaneously at a rate of 60 mL/min each. This achieved grain nucleation to form crystals with an initial iodide concentration of 1 mole percent, based on total silver.

The mixture was then held 10 minutes with the temperature remaining at 40° C. Following the hold, a 0.5M silver nitrate solution and a 0.5M NaCl solution were then added simultaneously at 8 mL/min for 40 minutes with the pCl being maintained at 2.25. The 0.5M $AgNO_3$ solution and the 0.5M NaCl solution were then added simultaneously with a ramped linearly increasing flow from 8 mL per minute to 16 mL per minute over 130 minutes with the pCl maintained at 2.25.

The resulting emulsion was a tabular grain silver iodochloride emulsion containing 0.06 mole percent iodide, based on silver. Fifty percent of total grain projected area was provided by tabular grains having {100} major faces having an average ECD of 1.86 mm and an average thickness of 0.082 mm, selected on the basis of an aspect ratio rank ordering of all {100} tabular grains having a thickness of less than 0.3 mm and a major face edge length ratio of less than 10. The selected tabular grain population had an average aspect ratio (ECD/t) of 24 and an average tabularity ($ECD/t^2$) of 314. The ratio of major face edge lengths of the selected tabular grains was 1.2. Ninety three percent of total grain projected area was made up of tabular grains having {100} major faces and aspect ratios of at least 7.5. These tabular grains had a mean ECD of 1.47 mm, a mean thickness of 0.086 mm, a mean aspect ratio of 17.5 and a mean tabularity of 222.

Emulsion Praparation Example 4

This example demonstrates an emulsion prepared similarly as the emulsion of Example 3, but an initial 0.08 mole percent iodide and a final 0.04% iodide.

A 2030 mL solution containing 3.52% by weight low methionine gelatin, 0.0056M sodium chloride and $3.00\times10^{-5}$M potassium iodide was provided in a stirred reaction vessel. The contents of the reaction vessel were maintained at 40° C. and the pCl was 2.25.

While this solution was vigorously stirred, 30 mL of 5.0M silver nitrate solution and 30 mL of a 4.998M sodium chloride and 0.002M potassium iodide solution were added simultaneously at a rate of 60 mL/min each. This achieved grain nucleation to form crystals with an initial iodide concentration of 0.08 mole percent, based on total silver.

The mixture was then held 10 minutes with the temperature remaining at 40° C. Following the hold, a 0.5M silver nitrate solution and a 0.5M sodium chloride solution were then added simultaneously at 8 mL/min for 40 minutes with the pCl being maintained at 2.95.

The resulting emulsion was a tabular grain silver iodochloride emulsion containing 0.04 mole percent iodide, based on silver. Fifty percent of the total grain projected area was provided by tabular grains having {100} major faces having an average ECD of 0.67 mm and an average thickness of 0.035 mm, selected on the basis of an aspect ratio rank ordering of all {100} tabular grains having a thickness of less than 0.3 mm and a major face edge length ratio of less than 10. The selected tabular grain population had an average aspect ratio (ECD/t) of 20 and an average tabularity (ECD/$t^2$) of 651. The ratio of major face edge lengths of the selected tabular grains was 1.9. Fifty two percent of total grain projected area was made up of tabular grains having {100} major faces and aspect ratios of at least 7.5.

These tabular grains had a mean ECD of 0.63 mm, a mean thickness of 0.036 mm, a mean aspect ratio of 18.5 and a mean tabularity of 595.

Emulsion Preparation Example 5

This example demonstrates an emulsion in which the initial grain population contained 6.0 mole percent iodide and the final emulsion contained 1.6% iodide.

A 2030 mL solution containing 3.52% by weight low methionine gelatin, 0.0056M sodium chloride and $3.00\times10^{-5}$M potassium iodide was provided in a stirred reaction vessel. The contents of the reaction vessel were maintained at 40° C. and the pCl was 2.25.

While this solution was vigorously stirred, 30 mL of 1.0M silver nitrate solution and 30 mL of a 0.97M sodium chloride and 0.03M potassium iodide solution were added simultaneously at a rate of 60 mL/min each. This achieved grain nucleation to form crystals with an initial iodide concentration of 6.0 mole percent, based on total silver.

The mixture was then held 10 minutes with the temperature remaining at 40° C. Following the hold, a 1.00M silver nitrate solution and a 1.00M sodium chloride solution were then added simultaneously at 2 mL/min for 40 minutes with the pCl being maintained at 2.25.

The resulting emulsion was a tabular grain silver iodochloride emulsion containing 1.6 mole percent iodide, based on silver. Fifty percent of total grain projected area was provided by tabular grains having {100} major faces having an average ECD of 0.57 mm and an average thickness of 0.036 mm, selected on the basis of an aspect ratio rank ordering of all {100} tabular grains having a thickness of less than 0.3 mm and a major face edge length ratio of less than 10. The selected tabular grain population had an average aspect ratio (ECD/t) of 16.2 and an average tabularity (ECD/$t^2$) of 494. The ratio of major face edge lengths of the selected tabular grains was 1.9. Sixty two percent of total grain projected area was made up of tabular grains having {100} major faces and aspect ratios of at least 7.5. These tabular grains had a mean ECD of 0.55 mm, a mean thickness of 0.041 mm, a mean aspect ratio of 14.5 and a mean tabularity of 421.

Emulsion Preparation Example 6

This example demonstrates an ultrathin high aspect ratio {100} tabular grain emulsion in which 2 mole percent iodide is present in the initial population and additional iodide is added during growth to make the final iodide level 5 mole percent.

A 2030 mL solution containing 1.75% by weight low methionine gelatin, 0.0056M sodium chloride and $1.48\times10^{-4}$M potassium iodide was provided in a stirred reaction vessel. The contents of the reaction vessel were maintained at 40° C. and the pCl was 2.2.

While this solution was vigorously stirred, 30 mL of 1.0M silver nitrate solution and 30 mL of a 0.99M sodium chloride and 0.01M potassium iodide solution were added simultaneously at a rate of 90 mL/min each. This achieved grain nucleation to form crystals with an initial iodide concentration of 2 mole percent, based on total silver.

The mixture was then held 10 minutes with the temperature remaining at 40° C. Following the hold, a 1.00M silver nitrate solution and a 1.00M sodium chloride solution were then added simultaneously at 8 mL/min while a $3.75\times10^{-3}$M potassium iodide was simultaneously added at 14.6 mL/min for 10 minutes with the pCl being maintained at 2.35.

The resulting emulsion was a tabular grain silver iodochloride emulsion containing 5 mole percent iodide, based on silver. Fifty percent of total grain projected area was provided by tabular grains having {100} major faces having an average ECD of 0.58 mm and an average thickness of 0.030 mm, selected on the basis of an aspect ratio rank ordering of all {100} tabular grains having a thickness of less than 0.3 mm and a major face edge length ratio less than 10. The selected tabular grain population had an average aspect ratio (ECD/t) of 20.6 and an average tabularity (ECD/$t^2$) of 803. The ratio of major face edge lengths of the selected tabular grains was 2. Eighty seven percent of total grain projected area was made up of tabular grains having {100} major faces and aspect ratios of at least 7.5. These tabular grains had a mean ECD of 0.54 mm, a mean thickness of 0.033 mm, a mean aspect ratio of 17.9 and a mean tabularity of 803.

Emulsion Preparation Example 7

This example demonstrates a high aspect ratio (100) tabular emulsion where 1 mole percent iodide is present in the initial grain population and 50 mole percent bromide is added during growth to make the final emulsion 0.3 mole percent iodide, 36 mole percent bromide and 63.7 mole percent chloride.

A 2030 mL solution containing 3.52% by weight low methionine gelatin, 0.0056M sodium chloride and $1.48\times10^{-4}$M potassium iodide was provided in a stirred reaction vessel. The contents of the reaction vessel were maintained at 40° C. and the pCl was 2.25.

While this solution was vigorously stirred, 30 mL of 1.0M silver nitrate solution and 30 mL of a 0.99M sodium chloride and 0.01M potassium iodide solution were added simultaneously at a rate of 60 mL/min each. This achieved grain nucleation.

The mixture was then held 10 minutes with the temperature remaining at 40° C. Following the hold, a 0.5M silver nitrate solution and a 0.25M sodium chloride and 0.25M sodium bromide solution were then added simultaneously at 8 mL/min for 40 minutes with the pCl being maintained at 2.60 to form crystals with an initial iodide concentration of 2 mole percent, based on total silver.

The resulting emulsion was a tabular grain silver iodobromochloride emulsion containing 0.27 mole percent iodide and 36 mole percent bromide, based on silver, the remaining halide being chloride. Fifty percent of total grain projected area was provided by tabular grains having {100} major faces having an average ECD of 0.4 mm and an average thickness of 0.032 mm, selected on the basis of an aspect ratio rank ordering of all {100} tabular grains having a thickness of less than 0.3 mm and a major face edge length ratio of less than 10. The selected tabular grain population had an average aspect ratio (ECD/t) of 12.8 and an average tabularity (ECD/$t^2$) of 432. The ratio of major face edge lengths of the selected tabular grains was 1.9. Seventy one percent of total grain projected area was made up of tabular grains having {100} major faces and aspect ratios of at least 7.5. These tabular grains had a mean ECD of 0.38 mm, a mean thickness of 0.034 mm, a mean aspect ratio of 11.3 and a mean tabularity of 363.

Emulsion preparation Example 8

This example demonstrates the preparation of an emulsion satisfying the requirements of the invention employing phthalated gelatin as a peptizer.

To a stirred reaction vessel containing a 310 mL solution that is 1.0 percent by weight phthalated gelatin, 0.0063M sodium chloride and $3.1\times10^{-4}$M KI at 40° C., 6.0 mL of a 0.1M silver nitrate aqueous solution and 6.0 mL of a 0.11M sodium chloride solution were each added concurrently at a rate of 6 mL/min.

The mixture was then held 10 minutes with the temperature remaining at 40° C. Following the hold, the silver and salt solutions were added simultaneously with a linearly accelerated flow from 3.0 mL/min to 9.0 mL/min over 15 minutes with the pCl of the mixture being maintained at 2.7.

The resulting emulsion was a high aspect ratio tabular grain silver iodochloride emulsion. Fifty percent of total grain projected area was provided by tabular grains having {100} major faces having an average ECD of 0.37 mm and an average thickness of 0.037 mm, selected on the basis of an aspect ratio rank ordering of all {100} tabular grains having a thickness of less than 0.3 mm and a major face edge length ratio of less than 10. The selected tabular grain population had an average aspect ratio (ECD/t) of 10 and an average tabularity (ECD/$t^2$) of 330. Seventy percent of total grain projected area was made up of tabular grains having {100} major faces and aspect ratios of at least 7.5. These tabular grains had a mean ECD of 0.3 mm, a mean thickness of 0.04 mm, and a mean tabularity of 210.

Electron diffraction examination of the square and rectangular surfaces of the tabular grains confirmed major face {100} crystallographic orientation.

Emulsion Preparation Example 9

This example demonstrates the preparation of an emulsion satisfying the requirements of the invention employing an unmodified bone gelatin as a peptizer.

To a stirred reaction vessel containing a 2910 mL solution that is 0.69 percent by weight bone gelatin, 0.0056M sodium chloride, $1.86\times10^{-4}$M KI and at 55° C. and pH 6.5, 60 mL of a 4.0M silver nitrate solution and 60.0 mL of a 4.0M silver chloride solution were each added concurrently at a rate of 120 mL/min.

The mixture was then held for 5 minutes during which a 5000 mL solution that is 16.6 g/L of low methionine gelatin was added and the pH was adjusted to 6.5 and the pCl to 2.25. Following the hold, the silver and salt solutions were added simultaneously with a linearly accelerated flow from 10 mL/min to 25.8 mL/min over 63 minutes with the pCl of the mixture being maintained at 2.25.

The resulting emulsion was a high aspect ratio tabular grain silver iodochloride emulsion containing 0.01 mole % iodide. About 65% of the total projected grain area was provided by tabular grains having an average diameter of 1.5 mm and an average thickness of 0.18 mm.

Emulsion Preparation Example 10

High-Aspect-Ratio High-Chloride {100} Tabular Grain Emulsion

Example 10A

A stirred reaction vessel containing 400 mL of a solution which was 0.5% in bone gelatin, 6mM in 3-amino-1H-1,2,4-triazole, 0.040M in NaCl , and 0.20M in sodium acetate was adjusted to pH 6.1 at 55° C. To this solution at 55° C. were added simultaneously 5.0 mL of 4 M $AgNO_3$ and 5.0 mL of 4M NaCl at a rate of 5 mL/min each.

The temperature of the mixture was then increased to 75° C. at a constant rate requiring 12 min and then held at this temperature for 5 min. The pH was adjusted to 6.2 and held to within ±0.1 of this value, and the flow of the $AgNO_3$ solution was resumed at 5 mL/min until 0.8 mole of Ag had been added. The flow of the NaCl solution was also resumed at a rate needed to maintain a constant pAg of 6.64.

The resulting AgCl emulsion consisted of tabular grains having {100} major faces which made up 65% of the projected area of the total grain population. This tabular grain population had a mean equivalent circular diameter of 1.95 mm and a mean thickness of 0.165 mm. The average aspect ratio and tabularity were 11.8 and 71.7, respectively.

Example 10B

This emulsion was prepared similar to that of Example 10A except that the precipitation was stopped when 0.4 mole of Ag had been added.

The resulting emulsion consisted of tabular grain having {100} major faces which made up 65% of the projected area of the total grain population. This tabular grain population had a mean equivalent circular diameter of 1.28 mm and a mean thickness of 0.130 mm. The average aspect ratio and tabularity were 9.8 and 75.7, respectively.

Emulsion Preparation Example 11 pH=6.1 Nucleation, pH @ 3.6 Growth

This example was prepared similar to that of Example 10B except that the pH of the reaction vessel was adjusted to 3.6 for the last 95% of the $AgNO_3$ addition.

The resulting emulsion consisted of {100} tabular grains making up 60% of the projected area of the total grain population. This tabular grain population had a mean equivalent circular diameter of 1.39 mm, and a mean thickness of 0.180 mm. The average aspect ratio and tabularity were 7.7 and 43.0, respectively.

Emulsion Preparation Example 12

High-Aspect-Ratio AgBrCl (10% Br) {100} Tabular-Grain Emulsion

This emulsion was prepared similar to that of Example 10B except that the salt solution was 3.6M in NaCl and 0.4M in NaBr.

The resulting AgBrCl (10% Br) emulsion consisted of {100} tabular grain making up 52% of the projected area of the total grain population. This tabular grain population had a mean equivalent circular diameter of 1.28 mm, and a mean thickness of 0.115. The average aspect ratio and tabularity were 11.1 and 96.7, respectively.

Emulsion Preparation Example 13

3,5-Diamino-1,2,4-Triazole as {100} Tabular Grain Nucleating Agent

This emulsion was prepared similar to that of Example 10A, except that 3,5-diamino-l,2,4-triazole (2.4 mmole) was used as the {100} tabular grin nucleating agent.

The resulting AgCl emulsion consisted of tabular grains having {100} major faces which made up 45% of the projected area of the total grain population. This tabular grain population had a mean equivalent circular diameter of 1.54 mm and a mean thickness of 0.20 mm. The average aspect ratio and tabularity were 7.7 and 38.5, respectively.

Emulsion Preparation Example 14

Imidazole as {100} Tabular Grain Nucleating Agent

This emulsion was prepared similar to that of Example 10A except that imidazole (9.6 mmole) was used as the {100} tabular grain nucleating agent.

The resulting AgCl emulsion consisted of tabular grains having {100} major faces which made up 40% of the projected area of the total grain population. This tabular grain population had a mean equivalent circular diameter of 2.20 mm and a mean thickness of 0.23 mm. The average aspect ratio and tabularity were 9.6 an 41.6, respectively.

Emulsion Preparation example 15

AgCl{100} Tabular Grain Emulsion Made Without Aromatic Amine Restraining Agent

To a stirred reaction vessel containing 400 mL of a solution which was 0.25 wt. % in bone gelatin low in methionine content (<4 mmoles per gram gelatin), 0.008M in NaCl , and at pH 6.2 and 85° C. were added simultaneously a 4M $AgNO_3$ solution at 5.0 ml/min and a 4M NaCl solution at a rate needed to maintain a constant pCl of 2.09. When 0.20 mole of $AgNO_3$ had been added, the additions were stopped for 20 sec. during which time 15 mls of a 13.3% low methionine gelatin solution was added and the pH adjusted to 6.2. The additions were resumed until a total of 0.4 mole of $AgNO_3$ had been added. The pH was held constant at 6.2±0.1 during the precipitation.

The resulting AgCl emulsion consisted of tabular grains having {100} major faces which made up 40% of the projected area of the total gain population. This tabular grain population had a mean equivalent circular diameter of 2.18 mm and a mean thickness of 0.199 mm. The average aspect ratio and tabularity were 11.0 and 55.0, respectively.

Photographic Element Example 16

Originating elements (all <100> AgCl Tabular)

A color photographic recording material (Photographic Sample ML-702) for color development was prepared by applying the following layers in the given sequence to a transparent support of cellulose triacetate. The quantities of silver halide are given in g of silver per $m^2$. The quantities of other materials are given in g per $m^2$.

The organic compounds were used as emulsions containing coupler solvents, surfactants and stabilizers or used as solutions both as commonly practiced in the art. The coupler solvents employed in this photographic sample included: tricresylphosphate; di-n-butyl phthalate; N,N-di-n-ethyl lauramide; N,N-di-n-butyl lauramide; 2,4-di-t-amylphenol; N-butyl-N-phenyl acetamide; and 1,4-cyclohexylenedimethylene bis-(2-ethoxyhexanoate). Mixtures of compounds were employed as individual dispersions or as co-dispersions as commonly practiced in the art. The sample additionally comprised sodium hexametaphosphate, disodium 3,5-disulfocatechol, aurous sulfide, propargyl-aminobenzoxazole and so forth. The silver halide emulsions were stabilized with 2 grams of 4-hydroxy-6-methyl-1,3,3a,7-tetraazaindene per mole of silver.

Layer 1 {Antihalation Layer}: DYE-1 at 0.011 g; DYE-3 at 0.011 g; C-39 at 0.065 g; ,DYE-6 at 0.108 g; DYE-9 at 0.075g; gray colloidal silver at 0.215 g; SOL-C1 at 0.005; SOL-M1 at 0.005 g; with 2.41 g gelatin.

Layer 2 {Interlayer}: 0.108 g of S-1; B-1 at 0.022 g; with 1.08 g of gelatin.

Layer 3 {Lowest Sensitivity Red-Sensitive Layer}: Red sensitive silver chloride <100>-faced tabular emulsion, average equivalent circular diameter 1.2 microns, average thickness 0.12 microns at 0.538 g; C-1 at 0.538 g; D-15 at 0.011g; C-42 at 0.054 g; D-3 at 0.054 g; C-41 at 0.032 g; S-2 at 0.005 g; with gelatin at 1.72 g.

Layer 4 {Medium Sensitivity Red-Sensitive Layer}: Red sensitive silver chloride <100>-faced tabular emulsion, average equivalent circular diameter 1.5 microns, average grain thickness 0.14 microns at 0.592 g; C-1 at 0.075 g; D-15 at 0.011 g; C-42 at 0.032 g; D-17 at 0.032 g; C-41 at 0.022 g; S-2 at 0.005 g; with gelatin at 1.72 g.

Layer 5 {Highest Sensitivity Red-Sensitive Layer}: Red sensitive silver chloride <100>-faced tabular emulsion, average equivalent circular diameter 2.2 microns, average grain thickness 0.12 microns at 0.592 g; C-1 at 0.075 g; D-15 at 0.011 g; C-42 at 0.022 g; D-17 at 0.032 g; C-41 at 0.011 g; S-2 at 0.005 g; with gelatin at 1.72 g.

Layer 6 {Interlayer}: S-1 at 0.054 g; D-25 at 0.032 g; with 1.08 g of gelatin.

Layer 7 {Lowest Sensitivity Green-Sensitive Layer}: Green sensitive silver chloride <100>-faced tabular emulsion, average equivalent circular diameter 1.2 microns, average grain thickness 0.12 microns at 0.484 g; C-2 at 0.355 g; D-17 at 0.022 g; C-40 at 0.043 g; D-8 at 0.022 g; S-2 at 0.011 g; with gelatin at 1.13 g.

Layer 8 {Medium Sensitivity Green-Sensitive Layer}: Green sensitive silver chloride <100>-faced tabular emulsion, average equivalent circular diameter 1.5 microns, average grain thickness 0.14 microns at 0.592 g; C-2 at 0.086 g; D-17 at 0.022 g; C-40 at 0.038 g; S-2 at 0.011 g; with gelatin at 1.4 g.

Layer 9 {Highest Sensitivity Green-Sensitive Layer}: Green sensitive silver chloride <100>-faced tabular emulsion, average equivalent circular diameter 2.2 microns, average grain thickness 0.12 microns at 0.592 g; C-2 at 0.075 g; D-16 at 0.022 g; C-40 at 0.038 g; D-7 at 0.022 g; S-2 at 0.011 g; with gelatin at 1.35 g.

Layer 10 {Interlayer}: S-1 at 0.054 g; DYE-7 at 0.108 g; with 0.97 g of gelatin.

Layer 11 {Lowest Sensitivity Blue-Sensitive Layer}: Blue sensitive silver chloride <100>-faced tabular emulsion with average equivalent circular diameter of 1.2 microns and average grain thickness of 0.12 microns at 0.172 g; and a blue sensitive silver chloride <100>-faced tabular emulsion with average equivalent circular diameter of 1.5 microns and average grain thickness of 0.14 microns at 0.172 g; ; C-3 at 1.08 g; D-18 at 0.065 g; D-19 at 0.065 g; B-1 at 0.005 g; S-2 at 0.011 g; with gelatin at 1.34 g.

Layer 12 {Highest Sensitivity Blue-Sensitive Layer}: Blue sensitive silver chloride <100>-faced tabular emulsion with average equivalent circular diameter of 2.2 microns and average grain thickness of 0.12 microns at 0.43 g; C-3 at 0.108 g; D-18 at 0.043 g; B-1 at 0.005 g; S-2 at 0.011 g; with gelatin at 1.13 g.

Layer 13 {Protective Layer-1}: DYE-8 at 0.054 g; DYE-9 at 0.108 g; DYE-10 at 0.054 g; unsensitized silver bromide Lippman emulsion at 0.108 g; N,N,N,-trimethyl-N-(2-perfluoro-octylsulfonamido-ethyl) ammonium iodide; sodium tri-isopropylnaphthalene sulfonate; SOL-C1 at 0.043 g; and gelatin at 1.08 g.

Layer 14 {Protective Layer-2}: silicone lubricant at 0.026 g; tetraethylammonium perfluoro-octane sulfonate; t-octylphenoxyethoxyethylsulfonic acid sodium salt; anti-matte polymethylmethacrylate beads at 0.0538 g; and gelatin at 0.91 g.

This film was hardened at coating with 2% by weight to total gelatin of hardener bisvinylsulfonylmethane. Surfactants, coating aids, scavengers, soluble absorber dyes and stabilizers were added to the various layers of this sample as is commonly practiced in the art. The total dry thickness of the light sensitive layers was about 12.1 microns while the total dry thickness of all the applied layers was about 20.5 micron.

Photographic Sample ML-704 was like photographic sample ML-702 except that coupler C-3 was omitted from layers 11 and 12 and replaced with an equal quantity of coupler C-29 in both layers and coupler C-2 was omitted from layers 7, 8 and 9 and replaced by coupler C-18 in layer 7, 0.71 g; in layer 8, 0.172 g; and in layer 9, 0.151 g.

Photographic Element Example 17

Originating Elements All <100> AgCl Tabular in ML-101 through ML-108 and all AgIBr in ML-201 through ML-208.

A color photographic recording material (Photographic Sample ML-101) for color development was prepared by applying the following layers in the given sequence to a transparent support of cellulose triacetate. The quantities of silver halide are given in g of silver per $m^2$. The quantities of other materials are given in g per $m^2$.

The organic compounds were employed as used as emulsions containing coupler solvents, surfactants and stabilizers or as solutions, both as commonly employed in the art. The coupler solvents employed in this photographic sample included: tricresylphosphate; di-n-butyl phthalate; N,N-di-n-ethyl lauramide; N,N-di-n-butyl lauramide; 2,4-di-t-amylphenol; N-butyl-N-phenyl acetamide; and 1,4-cyclohexylenedimethylene bis-(2-ethoxyhexanoate). Mixtures of compounds were employed as individual dispersions or as co-dispersions as commonly practiced in the art. The sample additionally comprised sodium hexametaphosphate, disodium 3,5-disulfocatechol, aurous sulfide, propargyl-aminobenzoxaxole and so forth. The silver halide emulsions were optionally stabilized with 4-hydroxy-6-methyl-l,3,3a,7-tetraazaindene.

Layer 1 {Antihalation Layer}: DYE-1 at 0.043 g; DYE-2 at 0.021 g; C-39 at 0.065 g; DYE-6 at 0.215 g; with 2.15 g gelatin.

Layer 2 {Lowest Sensitivity Red-Sensitive Layer}: Red sensitive silver chloride cubic emulsion, average edge length 0.28 microns at 0.215 g; Red sensitive silver chloride <100>-faced tabular emulsion, average equivalent circular diameter 1.2 microns, average grain thickness 0.14 microns at 0.592 g; C-1 at 0.70 g; D-3 at 0.075; with gelatin at 2.04 g.

Layer 3 {Highest Sensitivity Red-Sensitive Layer}: Red sensitive silver chloride <100)-faced tabular emulsion, average equivalent circular diameter 1.4 microns, average grain thickness 0.14 microns at 0.538 g; C-1 at 0.129 g; D-15 at 0.032 g; with gelatin at 2.15 g.

Layer 4 {Interlayer}: 1.29 g of gelatin.

Layer 5 {Lowest Sensitivity Green-Sensitive Layer}: Green sensitive silver silver chloride cubic emulsion, average edge length 0.28 microns at 0.215 g; green sensitive silver chloride <100>-faced tabular emulsion, average equivalent circular diameter 1.2 microns, average grain thickness 0.14 microns at 0.592 g; C-2 at 0.323 g; D-17 at 0.022 g; with gelatin at 1.72 g.

Layer 6 {Highest Sensitivity Green-Sensitive Layer}: Green sensitive silver chloride <100>-faced tabular emulsion, average equivalent circular diameter 1.4 microns, average grain thickness 0.14 microns at 0.538 g; C-2 at 0.086 g; D-16 at 0.011 g, with gelatin at 1.72 g.

Layer 7 {Interlayer}: 1.29 g of gelatin.

Layer 8 {Lowest Sensitivity Blue-Sensitive Layer}: Blue sensitive silver chloride cubic emulsion, average edge length 0.28 microns at 0.215 g; Blue sensitive silver chloride <100>-faced tabular emulsion, average equivalent circular diameter 1.2 microns, average grain thickness 0.12 microns at 0.215 g; C-3 at 1.08 g; D-18 at 0.065 g; with gelatin at 1.72 g.

Layer 9 {Highest Sensitivity Blue-Sensitive Layer}: Blue sensitive silver chloride <100> faced tabular emulsion, average equivalent circular diameter 1.4 microns, average grain thickness 0.14 microns at 0.323 g; C-3 at 0.129 g; D-18 at 0.043 g; with gelatin at 1.72 g.

Layer 10 {Protective Layer}: DYE-8 at 0.108 g; unsensitized silver bromide Lippman emulsion at 0.108 g; silicone lubricant at 0.026 g; tetraethylammonium perfluoro-octane sulfonate;

t-octylphenoxyethoxyethylsulfonic acid sodium salt; anti-matte polymethylmethacrylate beads at 0.0538 g; and gelatin at 1.61 g.

This film was hardened at coating with 2% by weight to total gelatin of bisvinylsulfonylmethane. Surfactants, coating aids, scavengers, soluble absorber dyes and stabilizers were added to the various layers of this sample as is commonly practiced in the art. The total dry thickness of the light sensitive layers was about 13.7 microns and the total dry thickness of all the applied layers was about 19.5 microns.

Photographic Sample ML-102 was like photographic sample ML-101 except that compound B-1 was added to layer 2 at 0.043 g.

Photographic Sample ML-103 was like photographic sample ML-102 except that compound C-42 was added to layer 2 at 0.065 g and layer 3 at 0.043 g; and compound C-40 was added to layer 5 at 0.065 g and layer 6 at 0.043 g.

Photographic Sample ML-104 was like photographic sample ML-101 except that compounds D-3, D-15, D-16, D-17 and D-18 were omitted and the following compounds added instead: to layer 2 add 0.075 g of D-4; to layer 3 add 0.032 g of D-1; to layer 5 add 0.032 g of D-1; to layer 6 add 0.011 g of D-1; to layer 8 add 0.065 g of D-7; and to layer 9 add 0.043 g of D-7.

Photographic Sample ML-105 was like photographic sample ML-104 except that compound B-1 was added to layer 2 at 0.043 g.

Photographic Sample ML-106 was like photographic sample ML-105 except that compound C-42 was added to layer 2 at 0.065 g and layer 3 at 0.043 g; compound C-40 was added to layer 5 at 0.065 g and layer 6 at 0.043 g; and silver chloride emulsion was omitted from layer 3.

Photographic Sample ML-107 was like photographic sample ML-104 except that the quantity of silver chloride emulsions in layers 2, 3, 5 and 6 was doubled and the quantities of compounds D-1 and D-4 in these layers was also doubled.

Photographic Sample ML-108 was like photographic sample ML-101 except that the quantity of silver chloride emulsions in layers 2, 3, 5 and 6 was doubled and the quantities of compounds D-3, D-15, D-16 and D-17 in these layers was also doubled. This change added about 1.0 micron to the film thickness.

Photographic Samples ML-201 through ML-208 were prepared analogously to samples ML-101 through ML-108 except that the silver chloride emulsions were replaced in the light sensitive layers by light sensitive silver iodobromide emulsions comprising about 3.7 mole percent iodide as follows:

in Layer 2: Red sensitive silver iodobromide emulsion average equivalent circular diameter 0.5 microns, average thickness 0.08 microns at 0.215 g; Red sensitive silver iodobromide emulsion, average equivalent circular diameter 1.0 microns, average grain thickness 0.09 microns.

in Layer 3: (ML-201 through ML-208) Red sensitive silver iodobromide emulsion, average equivalent circular diameter 1.2 microns, average grain thickness 0.13 microns at 0.538 g. in Layer 5: Green sensitive silver iodobromide emulsion, average equivalent circular diameter 0.5 microns, average grain thickness 0.09 microns at 0.215 g; green sensitive silver iodobromide emulsion, average equivalent circular diameter 1.0 microns, average grain thickness 0.09 microns at 0.592 g.

in Layer 6: Green sensitive silver iodobromide emulsion, average equivalent circular diameter 1.2 microns, average grain thickness 0.13 microns at 0.538 g.

in Layer 8: Blue sensitive silver iodobromide emulsion, average equivalent circular diameter 0.5 microns, average grain thickness 0.08 at 0.215 g; Blue sensitive silver iodobromide emulsion, average equivalent circular diameter 1.05 microns, average grain thickness 0.11 microns at 0.215 g.

in Layer 9: Blue sensitive silver iodobromide emulsion, average equivalent circular diameter 1.35 microns, average grain thickness 0.13 microns at 0.323 g.

Photographic Element Example 18

Display element

A color photographic display element (Photographic Sample P01) for color development was prepared by applying the following layers in the given sequence to a reflective support. The quantities of other materials are given in g per m2.

Layer 1 {Blue-Sensitive Layer} Blue sensitized silver chloride cubic emulsion with edge length ca. 0.58 microns at 0.28 g, yellow dye-forming image C-25 at 1.11 g with gelatin at 1.58 g.

Layer 2 {Interlayer} Oxidized developer scavenger S-1 at 0.10 g, with gelatin at 0.78 g.

Layer 3 {Green-Sensitive Layer} Green sensitized silver chloride cubic emulsion with edge length ca. 0.28 microns at 0.27 g, magenta dye-forming image coupler C-20 at 0.40 g with gelatin at 1.31 g.

Layer 4 {Interlayer} Oxidized developer scavenger S-1 at 0.006 g, dye DYE -10 at 0.28 g with gelatin at 0.65 g.

Layer 5 {Red-Sensitive Layer} Red sensitized silver chloride cubic emulsion with edge length ca. 0.28 microns at 0.20 g, cyan dye-forming image coupler C-4 at 0.44 g with gelatin at 1.12 g.

Layer 6 {Interlayer} Oxidized developer scavenger S-1 at 0.006 g, DYE-10 at 0.28 g with gelatin at 0.65 g.

Layer 7 {Protective layer} Gelatin at 1.11 g

This film was hardened at coating with 2% by weight to total gelatin of bisvinylsulfonylmethane. Surfactants, coating aids, scavengers, soluble absorber dyes and stabilizers were added to the various layers of this sample as is commonly practiced in the art.

EXAMPLE 19

Process Solutions and Process Sequences

| | | | | |
|---|---|---|---|---|
| Process A | | | | |
| Develop | 195" | Developer-I | | 38° C. |
| Bleach | 240" | Bleach-I | | 38° C. |
| Wash | 180" | | ca | 35° C. |
| Fix | 240" | Fix-I | | 38° C. |
| Wash | 180" | | ca | 35° C. |
| Rinse | 60" | Rinse | ca | 35° C. |
| Process B | | | | |
| Develop | 45" | Developer-II | | 35° C. |
| Bleach-Fix | 45" | Bleach-Fix | | 35° C. |
| Wash | 90" | | ca | 33° C. |
| Process C | | | | |
| Develop | 45" | Developer-II | | 35° C. |
| Bleach | 240" | Bleach-I | | 38° C. |
| Wash | 180" | | ca | 35° C. |
| Fix | 240" | Fix-I | | 38° C. |
| Wash | 180" | | ca | 35° C. |
| Rinse | 60" | Rinse | ca | 35° C. |
| Process D | | | | |
| Develop | 90" | Developer-II | | 35° C. |
| Bleach | 240" | Bleach-I | | 38° C. |
| Wash | 180" | | ca | 35° C. |
| Fix | 240" | Fix-I | | 38° C. |
| Wash | 180" | | ca | 35° C. |
| Rinse | 60" | Rinse | ca | 35° C. |
| Process E | | | | |
| Develop | 195" | Developer-I | | 38° C. |
| Stop | 60" | Stop | | 35° C. |
| Wash | 60" | | | 35° C. |
| Bleach-Fix | 120" | Bleach-Fix | | 35° C. |
| Wash | 180" | | ca | 33° C. |
| Rinse | 60" | Rinse | ca | 33° C. |
| Process F | | | | |
| Develop | 195" | Developer-I | | 38° C. |
| Stop | 60" | Stop | | 35° C. |
| Wash | 60" | | | 35° C. |
| Bleach | 240" | Bleach-II | | 35° C. |
| Wash | 180" | | ca | 33° C. |
| Fix | 240" | Fix-II | | 35° C. |
| Wash | 180" | | ca | 33° C. |
| Rinse | 60" | Rinse | ca | 33° C. |
| Process G | | | | |
| Develop | 45" | Developer-II | | 35° C. |
| Stop | 15" | Stop | | 35° C. |
| Wash | 15" | | | 35° C. |
| Bleach | 90" | Bleach-II | | 35° C. |
| Wash | 45" | | ca | 33° C. |
| Fix | 45" | Fix-II | | 35° C. |
| Wash | 90" | | ca | 33° C. |

The process solution compositions are as follows:

| | Tank |
|---|---|
| Developer-I | |
| Water | 800.0 mL |
| Potassium Carbonate, anhydrous | 34.30 g |
| Potassium bicarbonate | 2.32 g |
| Sodium sulfite, anhydrous | 0.38 g |
| Sodium metabisulfite | 2.96 g |
| Potassium Iodide | 1.20 mg |

-continued

| | Tank |
|---|---|
| Sodium Bromide | 1.31 g |
| Diethylenetriaminepentaacetic acid pentasodium salt (40% solution) | 8.43 g |
| Hydroxylamine sulfate | 2.41 g |
| (N-(4-amino-3-methylphenyl)-N-ethyl-2-aminoethanol) | 4.52 g |
| Water to make pH @ 80 F. 10.00 ± 0.05 | 1.0 L |
| Developer-II | |
| Water | 800.0 mL |
| Triethanolamine (100%) | 11.0 mL |
| Lithium Polystyrene Sulfonate (30%) | 0.25 mL |
| Potassium sulfite, anhydrous | 0.24 g |
| Blankophor REU | 2.3 g |
| Lithium Sulfate | 2.7 g |
| 1-Hydroxyethyl-1,1-diphophonic acid (60%) | 0.8 mL |
| Potassium Chloride | 1.8 g |
| Potassium Bromide | 0.020 g |
| Potassium Carbonate | 25.0 g |
| N,N-diethylhydroxylamine (85%) solution | 6.0 mL |
| (N-(4-amino-3-methylphenyl)-N-ethyl-2- aminoethyl-methanesulfonamide | 4.85 g |
| Water to make pH @ 77 F. 10.12 ± 0.05 | 1.0 L |
| Bleach-I | |
| Water | 500.0 mL |
| 1,3-propylenediamine tetraacetic acid | 37.4 g |
| 57% ammonium hydroxide | 70.0 mL |
| Acetic acid | 80.0 mL |
| 2-hydroxy-1,3-propylenediamine tetraacetic acid | 0.80 g |
| Ammonium Bromide | 25.0 g |
| Ferric nitrate nonahydrate | 44.85 g |
| Water to make pH 4.75 | 1.0 L |
| Bleach-II | |
| Water | 500.0 mL |
| 1,3-propylenediamine tetraacetic acid | 15.35 g |
| 45% Potassium hydroxide | 21.2 mL |
| Acetic acid | 5.63 mL |
| 2-hydroxy-1,3-propylenediamine tetraacetic acid | 0.5 g |
| Potassium Bromide | 24.0 g |
| Ferric nitrate nonahydrate | 18.33 g |
| Water to make pH 5.00 | 1.0 L |
| Fix-I | |
| Water | 500.0 mL |
| Ammonium Thiosulfate (58% solution) | 214.0 g |
| (Ethylenedinitrilo)tetraacetic cid disodium salt, dehydrate | 1.29 g |
| Sodium metabisulfite | 11.0 g |
| Sodium Hydroxide (50% solution) | 4.70 g |
| Water to make pH at 80 F. 6.5 ± 0.15 | 1.0 L |
| Fix-II | |
| Water | 500.0 mL |
| Sodium Thiosulfate pentahydrate | 42.7 g |
| (Ethylenedinitrilo)tetraacetic acid disodium salt, dehydrate | 1.0 g |
| Potassium sulfite (45%) | 35.6 mL |
| Potassium Hydroxide (45% solution) | 16.6 g |
| glacial Acetic Acid | 9.6 mL |
| Water to make pH adjust at 80 F. to 6.5 ± 0.15 | 1.0 L |

-continued

| | Tank |
|---|---|
| Bleach-Fix | |
| Water | 500.0 mL |
| Ammonium Thiosulfate (58%) | 80.0 mL |
| Sodium sulfite | 7.5 g |
| Ammonium Ferric Ethylenediainine Tetraacatic acid (44%) | 75.0 mL |
| Water to make pH adjust at 77 F. to 6.2 ± 0.15 | 1.0 L |
| Rinse | |
| Water | 900.0 mL |
| 0.5% Aqueous p-tertiary-octyl-(alpha-phenoxypolyethyl)-alcohol | 3.0 mL |
| Water to make | 1.0 L |
| Stop | |
| Water | 900.0 mL |
| Sulfuric Acid (18M) | 10.0 mL |
| Water to make pH at 80 F. 0.9 | 1.0 L |

EXAMPLE 20

Processing of Exposed Originating Elements

Samples of the originating elements described above and of a commercial color negative film as a CONTROL (comprises AgIBr emulsions at 6.47 g characterized in that the iodide content is about 2.7 mol % based on silver) were exposed to white light through a graduated density test object and then developed and desilvered according to processes A through F described above. The quantity of silver remaining in the elements after processing was determined by x-ray fluorescence techniques. The results of this evaluation are listed below in Table 5.

TABLE 5

Desilvering of originating film samples following various processing techniques. For convenience, the bleaching time associated with each process in listed following the process identification.

| Sample | <100>-faced Tabular AgCl | Initial Silver in g per $m^2$ | Process & (bleach time) | Residual silver in g per $m^2$ |
|---|---|---|---|---|
| ML-104 | yes | 3.55 | E (120 sec) | 0.0872 |
| ML-204 | no | 3.55 | E (120 sec) | 0.7220 |
| ML-105 | yes | 3.55 | E (120 sec) | 0.0678 |
| ML-205 | no | 3.55 | E (120 sec) | 0.3325 |
| ML-106 | yes | 3.55 | E (120 sec) | 0.0699 |
| ML-206 | no | 3.55 | E (120 sec) | 0.2819 |
| ML-107 | yes | 6.24 | E (120 sec) | 0.0839 |
| ML-207 | no | 6.24 | E (120 sec) | 1.0265 |
| ML-101 | yes | 3.55 | F (240 sec) | 0.0861 |
| ML-201 | no | 3.55 | F (240 sec) | 0.1302 |
| ML-102 | yes | 3.55 | F (240 sec) | 0.1119 |
| ML-202* | no | 3.55 | F (240 sec) | 0.0646 |
| ML-103* | yes | 3.55 | F (240 sec) | 0.1335 |
| ML-203* | no | 3.55 | F (240 sec) | 0.0764 |
| ML-104* | yes | 3.55 | F (240 sec) | 0.1302. |
| ML-204 | no | 3.55 | F (240 sec) | 0.1765. |
| ML-105 | yes | 3.55 | F (240 sec) | 0.0334. |
| ML-205 | no | 3.55 | F (240 sec) | 0.0484. |
| ML-106 | yes | 3.55 | F (240 sec) | 0.0291. |
| ML-206 | no | 3.55 | F (240 sec) | 0.484. |
| ML-107 | yes | 6.24 | F (240 sec) | 0.3111 |
| ML-207 | no | 6.24 | F (240 sec) | 2.0053 |
| ML-108 | yes | 6.24 | F (240 sec) | 0.2347 |
| ML-208 | no | 6.24 | F (240 sec) | 2.0581 |
| ML-702 | yes | 4.48 | A (240 sec) | 0.0129 |
| CONTROL | no | 6.47 | A (240 sec) | 0.0204 |
| ML-702 | yes | 4.48 | B (45 sec) | 0.4498 |
| CONTROL | no | 6.47 | B (45 sec) | 0.8737 |
| ML-702 | yes | 4.48 | C (240 sec) | 0.0075 |
| CONTROL | no | 6.47 | C (240 sec) | 0.0172 |

TABLE 5-continued

Desilvering of originating film samples following various processing techniques. For convenience, the bleaching time associated with each process in listed following the process identification.

| Sample | <100>-faced Tabular AgCl | Initial Silver in g per $m^2$ | Process & (bleach time) | Residual silver in g per $m^2$ |
|---|---|---|---|---|
| ML-702 | yes | 4.48 | D (240 sec) | 0.0043 |
| CONTROL | no | 6.47 | D (240 sec) | 0.0129 |

*Contains development inhibitors wherein the free valence capable of binding to silver is provided by a sulfur atom.

It is readily apparent that use of the <100> faced tabular silver chloride emulsions in the originating element enables improved silver removal compared to that obtained when silver iodobromide tabular emulsions are employed in the originating element.

EXAMPLE 21

Processing of Exposed Display Elements.

Samples of display element P01 were exposed to white light through a graduated density test element followed by development and desilvering according to processes A through G recited above. In all cases adequate desilvering of the display material was observed. Processes employing Developer-II are often preferred because they provide low fog levels in display material P01. Processes employing Developer-II can be used with a shorter development time or a lower development temperature. With other display materials, processes A through G can be employed.

EXAMPLE 22

Use of common process chemicals and common process conditions for color originating elements and color display elements.

Portions of Multilayer Sample ML-702 (an all AgCl color negative material comprising spectrally and chemically sensitized <100>-faced AgCl tabular shaped grains) and of a commercial color negative film as a CONTROL (comprises AgIBr emulsions at 6.47 g characterized in that the iodide content is about 2.7 mol % based on silver) were exposed to white light through a test object and processed according to PROCESS A, B, C or D recited above.

The images thus formed were optically printed on display element P01 and the display element processed according to PROCESS B or C.

Results of this experiment are described in TABLE 6 below.

Originating element sample ML-702 comprises spectrally and chemically sensitized <100>-faced camera speed AgCl tabular shaped grains. Originating element sample "CONTROL" comprises camera speed AgIBr grains. Display element sample P01 comprises slow AgCl cubic grains.

TABLE 6

Results of Color Process and Color Print Studies.

| Color Negative Sample | Color Negative Process | Color Print Process | Acceptability of Print |
|---|---|---|---|
| ML-702 | A | B | acceptable |
| control | A | B | acceptable |
| ML-702 | B | B | unacceptable - silver retained in negative |
| control | B | B | unacceptable - silver retained in negative |
| ML-702 (Inv) | C | B | acceptable |
| control | C | B | unacceptable - low negative gamma, color range |
| ML-702 | D | B | acceptable |
| control | D | B | unacceptable - low negative gamma, color range |
| ML-702 | A | C | higher effective printing speed - preferred |
| ML-702 | B | C | unacceptable - silver retained in negative |
| control | B | C | unacceptable - silver retained in negative |
| ML-702 (Inv) | C | C | acceptable |
| control | C | C | unacceptable - low negative gamma, color range |
| ML-702 (Inv) | D | C | acceptable |
| control | D | C | unacceptable - low negative gamma, color range |

It is readily apparent on examination of experimental data from the desilvering experiment as listed in Table 5 and the experimental data from the combined printing experiment as listed in Table 6 that color originating films comprising <100> AgCl emulsions which have been exposed and processed according to processes A, C, D, E, or F can be printed onto a display element which is then processed according to process A, B, C, D, E, F or G to provide a finished display print which is not marred by silver stains and which provides an acceptable print color range.

EXAMPLE 23

Use of common process chemicals and common process conditions for color negative materials and color print materials.

Portions of Multilayer Sample ML-704 (an all AgI color negative material comprising spectrally and chemically sensitized <100>-faced AgI tabular shaped grains) and the CONTROL film previously described were loaded into a camera fitted with an 85mm lens and exposed to a common scene. The exposed negatives were then developed and desilvered according to PROCESS A, B, C, or D as recited in Example 7.

The resultant images were optically printed onto display element P01 and the display element developed and desilvered according to PROCESS B or C. The picture quality of the common scene in the color prints thus formed were evaluated as described in Example 7 and comparable results were obtained.

EXAMPLE 24

EM-15c Control Tabular AgCl <111>-faced precipitated in the presence of a crystal habit controlling amount of a spectral sensitizing dye before and during nucleation and precipitation of the silver halide grains; average ECD 1.1 microns, average thickness 0.08 microns; Blue sensitized using sensitizing dye SS-1.

Photographic Sample 801 was prepared by applying the following layers to a clear support in the order indicated. Quantities of components are expressed in grams per square meter.

Layer 1 (antihalation layer) comprising 0.34 g gray silver and 2.44 g gelatin.

Layer 2 (light sensitive layer) comprising 0.43 g of EM-15c, 0.54 g of image dye forming coupler C-1 and 0.154 g gelatin.

Layer 3 (protective layer) comprising 2.15 g of gelatin.

The layers additionally comprised alpha-4-nonylphenyl-omega-hydroxy-poly(oxy-(2-hydroxy-1,3-propanediyl)) and (para-t-octylphenyl)-di(oxy-l,2-ethanediyl)-sulfonate as surfactants. The sample was hardened at coating with bivinylsulfonyl methane at 2% by weight to gelatin.

Photographic Sample 802 was like photographic sample 801 except that 0.054 g of DIR compound D-1 was added to layer 2.

Photographic Sample 803 was like photographic sample 801 except that 0.054 g of DIR compound D-1 and 0.054 g of compound B-1 were added to layer 2.

Photographic Sample 804 was like photographic sample 801 except that 0.054 g of DIR compound D-3 was added to layer 2.

Photographic Sample 805 was like photographic sample 801 except that 0.054 g of of DIR compound D-3 and 0.054 g of compound B-1 were added to layer 2.

Photographic Samples 806 through 810 were like photographic samples 801 through 805 respectively except that comparative emulsion EM-15c was replaced by an equal quantity of <100>-faced tabular grain emulsion EM-10 (of like spectral sensitization).

Photographic Samples 811 through 813 were like photographic sample 806 except that DIR compound D-20 or BAR compounds B-1 or D-28 were employed in combination with the preferred <100>-faced tabular silver halide emulsion to further illustrate the properties of these combinations. The identities and quantities of these compounds are listed in Table 8 below.

Image coupler C-1 is a cyan dye-forming image coupler; compound D-1 enables imagewise release of a substituted benzotriazole development inhibitor during a development process; compound D-3 and D-20 enable imagewise release of a substituted mercaptotetrazole development inhibitor during a development process; compound B-1 enables imagewise release of a solubilized aliphatic mercaptan bleach accelerator compound during a development process; and compound D-28 enables imagewise release of a solubilized aromatic mercaptan bleach accelerator during a development process. The couplers were provided as photographic coupler dispersions as known in the art.

EXAMPLE 25

Extent of Development as a function of emulsion crystal habit DIR compound choice and BAR compound choice.

This experiment was designed to illustrate the relative extent of development of tabular shaped AgCl emulsions as a function of crystal habit in the presence of Development Inhibitor Releasing (DIR) compounds and optional Bleach Accelerator Releasing (BAR) compounds.

Unexposed portions of Photographic Samples 801 through 810 were treated with a solution like DEVELOPER-I from which the paraphenylene diamine developing agent was omitted for 195 s at 38 C. followed by a wash. The quantity of silver remaining in the samples after processing was determined by x-ray fluorescence techniques. The <100>-faced tabular AgCl containing samples and the <111>-faced tabular AgCl samples with an incorporated surface stabilizer contained essentially the same quantity of silver after this process'sequence as was originally contained in the unprocessed samples. This control experiment serves to illustrate that contact of these silver halide emulsions with this developer-like solution does not lead to excessive silver disolution during a development step.

Additional portions of Photographic Samples 801 through 810 were then exposed to white light through a graduated density test object and developed using DEVELOPER-I for 195 s at 38 C., followed by a wash and fixing using FIX-I for 240' at 38 C., followed by a wash and drying. The quantity of silver remaining in the samples in a high exposure (Dmax) region after processing was determined by x-ray fluorescence techniques. This experiment is used to determine the quantity of silver developed in a high exposure region for each like pair of samples (control and experiment), differing only in that the control samples contained a <111>-faced AgCl tabular emulsion with surface stabilizer while the experiment contained a {100>-faced AgCl tabular emulsion without surface stabilizer. The quantity of developed silver was compared. This comparison is indicated in Table 7 below for each pair as a percent.

TABLE 7

Extent of development as a function of emulsion crystal habit, DIR compound choice and BAR compound choice

| Sample | Emulsion | BAR Compound and Quantity | DIR Compound and Quantity | Percent Silver Developed |
|---|---|---|---|---|
| 801 control | EM-15c | none | none | 97% |
| 806 | EM-10 | none | none | 100% |
| 802 control | EM-15c | none | D-3 (0.054) | 76% |
| 807 | EM-10 | none | D-3 (0.054) | 100% |
| 803 control | EM-15c | B-1 (0.054) | D-3 (0.054) | 80% |
| 808 | EM-10 | B-1 (0.054) | D-3 (0.054) | 100% |
| 804 control | EM-15c | none | D-1 (0.054) | 77% |
| 809 | EM-10 | none | D-1 (0.054) | 100% |
| 805 control | EM-15c | B-1 (0.054) | D-1 (0.054) | 82% |
| 810 | EM-10 | B-1 (0.054) | D-1 (0.054) | 100% |

As is readily apparent on examination of the experimental data presented in Table 7, the photographic samples containing the <111>-faced tabular shaped AgCl crystals, precipitated in the presence of a crystal habit controlling amount of a spectral sensitizing dye before and during nucleation and precipitation of the silver halide grains, are more difficult to develop than are the photographic samples containing the <100>-faced tabular shaped AgCl crystals which do not require a crystal habit controlling substance to be present during grain formation or use. This difficulty in development appears to be greatly exacerbated in the presence of both DIR compounds and BAR compounds. This experiment confirms that the sensitizing dyes and other grain surface stabilizers required to maintain crystal morphology in the case of the <111>-faced tabular grains can interfere with development. The samples containing the <100>-faced silver chloride emulsions exhibit this property.

EXAMPLE 26

Desilvering as a function of emulsion crystal habit, DIR compound choice and BAR compound choice.

This experiment was designed to illustrate the relative desilvering of AgCl emulsions as a function of crystal habit in the presence of Development Inhibitor Releasing (DIR) compounds and optionally Bleach Accelerator Releasing (BAR) compounds. Photographic Samples 801 through 813 were exposed to white light through a graduated density test object and developed and desilvered according to PROCESS B. The quantity of silver remaining in the samples in a high exposure (Dmax) region after processing was determined by x-ray fluorescence techniques.

These values of unremoved silver are listed for each sample in Table 8 below.

TABLE 8

Desilvering as a function of emulsion crystal habit, DIR compound choice and BAR compound choice.

| Sample | Emulsion | BAR Compound and Quantity | DIR Compound and Quantity | Metallic Silver |
|---|---|---|---|---|
| 801 control | EM-15c | none | none | 0.040 g |
| 802 control | EM-15c | none | D-3 (0.054) | 0.261 g |
| 803 control | EM-15c | B-1 (0.054) | D-3 (0.054) | 0.184 g |
| 804 control | EM-15c | none | D-1 (0.054) | 0.024 g |
| 805 control | EM-15c | B-1 (0.054) | D-1 (0.054) | 0.016 g |
| 806 | EM-10 | none | none | 0.038 g |
| 807 | EM-10 | none | D-3 (0.054) | 0.250 g |
| 808 | EM-10 | B-1 (0.054) | D-3 (0.054) | 0.076 g |
| 809 | EM-10 | none | D-1 (0.054) | 0.025 g |
| 810 | EM-10 | B-1 (0.054) | D-1 (0.054) | 0.003 g |
| 811 | EM-10 | D-28 (0.054) | none | 0.008 g |
| 812 | EM-10 | none | D-20 (0.054) | 0.214 g |
| 813 | EM-10 | B-1 (0.054) | D-20 | 0.067 g |

As can be readily appreciated, the BAR compound functions to accelerate bleaching, thereby removing silver deposits which greatly detract from the colorfulness of images viewed or printed from these films. The specific degree of silver removal will depend on the choice of identity and quantity of image coupler, BAR compound and other film constituents. Combinations suitable for specific applications are readily ascertained by those skilled in the art. These compounds can also be used in combination with the other photographically useful compounds described elsewhere.

As is readily apparent on examination of the experimental data presented in Table 8 , the photographic samples containing the <111>-faced tabular shaped AgCl crystals, precipitated in the presence of a crystal habit controlling amount of a spectral sensitizing dye before and during nucleation and precipitation of the silver halide grains, are more difficult to desilver than are the photographic samples containing the <100>-faced tabular shaped AgCl crystals which do not require a crystal habit controlling substance to be present during grain formation or use. It would appear that the sensitizing dyes and other grain surface stabilizers required to maintain crystal morphology in the case of the <111>-faced tabular grains can interfere with desilvering.

It is additionally apparent that the nitrogen based development inhibitor released in samples 809 and 810 lends itself to a surprisingly large improvement in desilvering relative to that observed for sample 806. It is further apparent that the bleach accelerator released from compound B-1 provides a surprisingly large improvement in desilvering when compared to the other samples.

The invention has been described in detail with particular reference to preferred embodiments thereof, but it will be understood that variations and modifications can be effected within the spirit and scope of the invention.

What is claimed is:

1. A method of processing an exposed and developed originating color silver halide photographic element comprising the steps of desilvering the photographic element, by blixing the photographic element with a solution containing a bleaching agent and a fixing agent, or bleaching the photographic element with a solution containing a bleaching agent and fixing the photographic element with a solution containing a fixing agent;

wherein the photographic element comprises a radiation sensitive emulsion containing a silver halide grain population comprised of at least 50 mole percent chloride, based on total silver forming the grain population projected area, wherein at least 50 percent of total grain projected area is accounted for by intrinsically stable tabular grains (1) bounded by {100} major faces having adjacent edge ratios of less than 10 and (2) having an aspect ratio of at least 2;

wherein the silver halide content of the photographic element comprises at least 50 mole % silver chloride and no more than 2 mole % silver iodide;

wherein the photographic element further contains a bleach accelerator releasing compound; and wherein the photographic element is free of a desilvering rate retarding amount of a development inhibitor having a free sulfur valence which binds to silver.

2. The method of claim 1 wherein the tabular silver halide grains have an aspect ratio of at least 8.

3. The method of claim 1 wherein the tabular silver halide grains have thicknesses of less than 0.3 microns.

4. The method of claim 1 wherein the tabular silver halide grains contain at least 70 mole percent chloride.

5. A method of processing an exposed and developed originating color silver halide photographic element comprising the steps of blixing the photographic element with a solution containing a bleaching agent and a fixing agent;

wherein the photographic element comprises a radiation sensitive emulsion containing a silver halide grain population comprised of at least 50 mole percent chloride, based on total silver forming the grain population projected area, wherein at least 50 percent of total grain projected area is accounted for by intrinsically stable tabular grains (1) bounded by {100} major faces having adjacent edge ratios of less than 10 and (2) having an aspect ratio of at least 2, wherein the silver halide content of the photographic element comprises at least 50 mole % silver chloride and no more than 2 mole % silver iodide, wherein the blixing solution comprises less than 0.75 moles/liter of thiosulfate, and less than 0.25 moles/liter of a ferric aminopolycarboxylic acid complex;

wherein the photographic element further contains a bleach accelerator releasing compound; and wherein the photographic element is free of a desilvering rate retarding amount of a development inhibitor having a free sulfur valence which binds to silver.

6. The method of claim 5 wherein the photographic element is desilvered in less than 4 minutes.

7. The method of claim 5 wherein the tabular silver halide grains have an aspect ratio of at least 8.

8. The method of claim 5 wherein the tabular halide grains have thicknesses of less than 0.3 microns.

9. The method of claim 5 wherein the tabular silver halide grains contain at least 70 mole percent chloride.

10. A method of processing an exposed and developed originating color silver halide photographic element comprising the steps of desilvering the photographic element, by bleaching the photographic element with a solution containing a bleaching agent and fixing the photographic element with a solution containing a fixing agent;

wherein the photographic element comprises a radiation sensitive emulsion containing a silver halide grain population comprised of at least 50 mole percent chloride, based on total silver forming the grain population projected area, wherein at least 50 percent of total grain projected area is accounted for by intrinsically stable tabular grains (1) bounded by {100} major faces having adjacent edge ratios of less than 10 and (2) having an aspect ratio of at least 2;

wherein the silver halide content of the photographic element comprises at least 50 mole % silver chloride and no more than 2 mole % silver iodide;

wherein the bleaching solution comprises less than 0.075 moles/liter of a ferric aminopolycarboxylic acid complex;

wherein the fixing solution comprises less than 0.25 moles/liter of thiosulfate;

wherein the photographic element further contains a bleach accelerator releasing compound; and wherein the photographic element is free of a desilvering rate retarding amount of a development inhibitor having a free sulfur valence which binds to silver.

11. The method of claim 10 wherein the photographic element contains less than 5 grams of silver per square meter, and is desilvered in less than 8 minutes.

12. The method of claim 10 wherein the tabular silver halide grains have an aspect ratio of at least 8.

13. The method of claim 10 wherein the tabular silver halide grains have thicknesses of less than 0.3 microns.

14. The method of claim 10 wherein the tabular silver halide grains contain at least 70 mole percent chloride.

* * * * *